US010876311B1

(12) United States Patent
Schmidt

(10) Patent No.: US 10,876,311 B1
(45) Date of Patent: Dec. 29, 2020

(54) POOL SKIMMER DEVICES, SYSTEMS, AND METHODS

(71) Applicant: Robert Douglas Schmidt, San Diego, CA (US)

(72) Inventor: Robert Douglas Schmidt, San Diego, CA (US)

( * ) Notice: Subject to any disclaimer, the term of this patent is extended or adjusted under 35 U.S.C. 154(b) by 0 days.

(21) Appl. No.: 16/516,013

(22) Filed: Jul. 18, 2019

Related U.S. Application Data

(60) Provisional application No. 62/862,570, filed on Jun. 17, 2019.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.12, 416.1, 416.2, 776
See application file for complete search history.

(56) References Cited

U.S. PATENT DOCUMENTS 3,567,020 A * 3/1971 Whitaker ..... E04H 4/1272 210/94
3,616,916 A 11/1971 Greene
4,212,740 A 7/1980 Greene
5,830,350 A 11/1998 Voss
7,727,387 B2 * 6/2010 Goggin ..... E04H 4/1272 210/136
8,721,881 B1 5/2014 Smith
8,728,307 B2 * 5/2014 Iacovacci ..... B01D 21/0012 210/167.1
9,581,478 B1 * 2/2017 Smith ..... G01F 1/666
9,879,439 B2 1/2018 Norberto, III
9,945,139 B2 4/2018 Noberto, III et al.
10,260,247 B2 4/2019 Noberto, III et al.
2014/0202941 A1 * 7/2014 Iacovacci ..... B01D 21/0027 210/167.18
2014/0209546 A1 * 7/2014 Smith ..... E04H 4/1272 210/776

* cited by examiner

*Primary Examiner* — Fred Prince
(74) *Attorney, Agent, or Firm* — Knobbe Martens Olson & Bear LLP

(57) ABSTRACT

A powered pool skimmer device can include a funnel assembly comprising a the funnel having a wide opening and a narrow opening, and a funnel profile extending between the wide opening and the narrow opening, a filter assembly positioned below the funnel assembly, a pump assembly positioned below the filter assembly, the pump assembly including a pump configured to draw water through the funnel assembly and filter assembly and exhaust it through an exhaust, and a main body extending along an axis, wherein the funnel assembly, the filter assembly, and the pump assembly are positioned within the main body and arranged along the axis.

19 Claims, 42 Drawing Sheets

POOL SKIMMER DEVICES, SYSTEMS, AND METHODS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

This application relates to pool skimmer devices, systems, and methods.

Description

Swimming pools are enjoyed by many for leisure and exercise in both private and public settings. To provide healthy conditions and maximum enjoyment, it is important to ensure that water within a swimming pool remains clean, clear, and free from debris. For this reason, swimming pools generally include circulation and filtration systems that are designed to clean the water.

Many swimming pools accumulate unwanted debris, such as leaves, pollen, seeds, insects, etc., on the surface of the water. Commonly, existing circulation and filtration systems may be ineffective at removing this debris from the water's surface. Accordingly, pool owners frequently and undesirably are required to manually capture and remove debris from the water's surface using a pool skimmer net.

SUMMARY

In a first aspect, a pool skimmer device is disclosed. The device includes a mounting plate configured to attached to a pool skimmer basket, an extension body extending from the mounting plate to a distal end, and a funnel positioned at the distal end of the extension body, the funnel comprising a wide opening positioned at the distal end of the extension body and a narrow opening, and a funnel profile extending between the wide opening and the narrow opening.

The device can include one or more of the following features in any combination: (a) wherein a distance between the mounting plate and the funnel is adjustable; (b) wherein the extension body extends through an opening in the mounting plate, such that the distal end of the extension body is positioned on a first side of the mounting plate, and a proximal end of the extension body is positioned on a second side of the mounting plate, and the extension body is movably engaged with the opening in the mounting plate such that the distance between the mounting plate and the funnel can be adjusted by moving the extension body relative to the mounting plate; (c) wherein the extension body comprises a plurality of telescoping body sections, wherein the plurality of telescoping body sections comprise at least a top telescoping body section connected to the funnel and a bottom telescoping body section attached to the mounting plate; (d) wherein the plurality of telescoping body sections comprise at least three body sections; (e) a waterproof liner extending between the top telescoping bottom section and the bottom telescoping body section; (f) wherein the mounting plate comprises an attachment mechanism for securing the mounting plate to the skimmer basket; (g) wherein the funnel profile is at least partially defined by a portion of the function $y=-1/x$; (h) at least one float connected to at least one of the extension body and the funnel, the float configured to float on the surface of the water thereby adjusting the distance between the mounting plate and the funnel automatically as a water level changes; (i) wherein the at least one float is configured to be positioned at most 2 inches above the funnel, such that the funnel is positioned at most 2 inches below the surface of the water; (j) wherein the at least one float is configured to be positioned at most 1 inch above the funnel, such that the funnel is positioned at most 1 inch below the surface of the water; (k) wherein the funnel is removable and can be replaced by another funnel having a different funnel profile; (l) a pipe extending downward from the narrow opening of the funnel; and/or (m) wherein the pipe is at least 2 inches, at least 4 inches, or at least 6 inches in length.

In another aspect, a pool skimmer method is disclosed. The method includes attaching a pool skimmer device to a pool skimmer basket, the pool skimmer device including an extension body and a funnel, adjusting the extension body such that the funnel is positioned at most 2 inches below the surface of the water when the pool skimmer device is positioned within a pool skimmer, and positioning the pool skimmer basket and pool skimmer device within the pool skimmer.

The method can include one or more of the following features in any combination: (a) wherein adjusting the extension body occurs automatically based on floats attached to at least one of the extension body and the funnel, the floats configured to float on the surface of the water; (b) selecting a mounting plate from among a plurality mounting plates based on the pool skimmer basket, attaching the mounting plate to the pool skimmer basket, and attaching the extension body to the mounting plate; (c) activating a pump of a filtration system, wherein the pump is configured to suck water from a bottom portion of the pool skimmer; (d) attaching a tube to a narrow opening of the funnel; and/or (e) removing the funnel from the pool skimmer device, and replacing the funnel with another funnel having a different funnel profile to change a flow characteristic of the pool skimmer device.

In another aspect, a skimmer door device configured to be positioned in front of an aperture of pool skimmer of a pool is disclosed. The skimmer door device includes a frame configured to be secured to the pool skimmer in front of the aperture of the pool, the frame comprising a rear plate and two lateral tracks, one of the two lateral tracks positioned on each side of the rear plate; a door slidably received within the lateral tracks and configured to move up and down within the two lateral tracks to cover the aperture of the pool skimmer; and a float attached to the door, the float configured to float on a surface of water within the pool to adjust the position of the door.

The device can include one or more of the following features in any combination: (a) wherein the rear plate is configured to contact a sidewall of the pool, and the device further comprises a gasket configured to create a seal between the rear plate and the sidewall; (b) wherein the float comprises a first float positioned on a first side of the frame and a second float positioned on a second side of the frame, the first and second floats positioned on opposite sides of the aperture of the pool skimmer when the device is installed; (c) wherein the float is attached to the door with a riser, and wherein the riser is configured to position a top of the door at most 2 inches below the surface of the water; (d) wherein the riser is adjustable; (e) at least one mounting support attached to the frame and configured to secure frame to the aperture of the pool skimmer; (f) wherein the at least one mounting support comprises a first portion comprising a foot on a first end a threaded opening on a second end, a second portion comprising a foot on a second end and a threaded second end received within the threaded opening of the first portion, wherein the length of the mounting support can be adjusting by threading the second portion into and out of the first portion; (g) wherein a width between the two lateral tracks is adjustable; and/or (h) at least one of bearings or wheels within the two lateral tracks.

In another aspect, a pool skimmer method is disclosed. The method includes attaching a pool skimmer door device to an a pool skimmer, the pool skimmer device comprising a door slidably received within a frame; and adjusting the position of the door such that a top of the door is positioned at most 2 inches below the surface of the water.

The method can include one or more of the following features in any combination: (a) wherein adjusting the position of the door occurs automatically based on one or more floats attached to the door and the funnel, the one or more floats configured to float on the surface of the water; (b) activating a pump of a filtration system, wherein the pump is configured to suck water from a bottom portion of the pool skimmer; (c) adjusting a length of riser that connects the one or more floats; (d) attaching a pool skimmer device to a pool skimmer basket, the pool skimmer device including an extension body and a funnel, adjusting the extension body such that the funnel is positioned at most 2 inches below the surface of the water when the pool skimmer device is positioned within the pool skimmer, and positioning the pool skimmer basket and pool skimmer device within the pool skimmer; (e) wherein adjusting the extension body occurs automatically based on floats attached to at least one of the extension body and the funnel, the floats configured to float on the surface of the water; (f) selecting a mounting plate from among a plurality mounting plates based on the pool skimmer basket, attaching the mounting plate to the pool skimmer basket, and attaching the extension body to the mounting plate; (g) attaching a tube to a narrow opening of the funnel; (h) replacing the funnel with another funnel having a different funnel profile to change a flow characteristic of the pool skimmer device; and/or (i) removing the skimmer door device.

In another aspect, a powered pool skimmer device is disclosed. The device includes a funnel assembly comprising a the funnel having a wide opening and a narrow opening, and a funnel profile extending between the wide opening and the narrow opening; a filter assembly positioned below the funnel assembly; a pump assembly positioned below the filter assembly, the pump assembly including a pump configured to draw water through the funnel assembly and filter assembly and exhaust it through an exhaust; and a main body extending along an axis, wherein the funnel assembly, the filter assembly, and the pump assembly are positioned within the main body and arranged along the axis.

The device can include one or more of the following features in any combination: (a) wherein the pump assembly is no more than 6 inches below the filter assembly; (b) wherein the funnel assembly further comprises a funnel extension extending from the narrow opening of the funnel; (c) wherein the funnel assembly further comprises a funnel collar surrounding the funnel; (d) wherein the funnel assembly is configured to float within the main body along the axis; (e) wherein the filter assembly comprises a filter bag attached to the funnel assembly with a ring; (f) wherein the exhaust comprises an exhaust tee; (g) a storage housing configured to enclose the main body in a first configuration, and lower the main body into a pool in a second configuration; (h) wherein the main body is attached to a lift/extension board of the storage housing by one or more adjustable lift pipes; (i) wherein the lift/extension board is slidably connected to a plurality of slide channels of the storage housing; (j) wherein the main body is positioned within a skimmer sleeve comprising a skimmer aperture and a skimmer device access; (k) wherein the skimmer sleeve is configured to be positioned within an in-concrete frame configured to be installed in a wall of a pool; and/or (l) wherein the main body is removable from the skimmer sleeve and the in-concrete frame through the skimmer device access.

In another aspect, a powered pool skimmer method is disclosed. The method includes positioning a powered pool skimmer comprising a funnel assembly, a filter assembly positioned below the funnel assembly, and a pump assembly positioned below the filter assembly such that the funnel assembly is no more than 2 inches below the surface of water in a pool; and activating a pump of the pump assembly to pump water through the funnel assembly and filter assembly to an exhaust back into the pool.

The method can include one or more of the following features in any combination: (a) positioning a storage housing of the powered pool skimmer on an edge of the pool, removing the powered pool skimmer from the storage housing, and lowering the powered pool skimmer into the pool; (b) wherein position the powered pool skimmer such that the funnel assembly is no more than 2 inches below the surface of the water comprises floating the funnel assembly within a main body of the powered pool skimmer; (c) installing an in-concrete frame into a sidewall of the pool, installing a skimmer sleeve into the in-concrete frame, the skimmer sleeve comprising a pool skimmer aperture extending to the sidewall of the pool, and inserting the powered pool skimmer into the skimmer sleeve; (d) wherein inserted the powered pool skimmer into the skimmer sleeve comprises removing an exhaust port of the pump assembly, sliding the powered pool skimmer into the skimmer sleeve, and reinstalling the exhaust port; (e) wherein the pump assembly is no more than 6 inches below the filter assembly; (f) wherein the funnel assembly further comprises a funnel extension extending from a narrow opening of the funnel; and/or (g) wherein the filter assembly comprises a filter bag attached to the funnel assembly with a ring.

BRIEF DESCRIPTION OF THE DRAWINGS

The features and advantages of the pool skimmer devices, systems, and methods described herein will become more fully apparent from the following description and appended claims, taken in conjunction with the accompanying drawings. These drawings depict only several embodiments in accordance with the disclosure and are not to be considered limiting of its scope. In the drawings, similar reference numbers or symbols typically identify similar components, unless context dictates otherwise. The drawings may not be to scale.

FIG. 9A illustrates the skimmer device in an extended configuration.

FIG. 14A illustrates the telescoping door in a raised position.

22A. The powered pool skimmer device shown in FIG. 15A will insert into this rectangular powered pool skimmer sleeve.

Figure 15A:
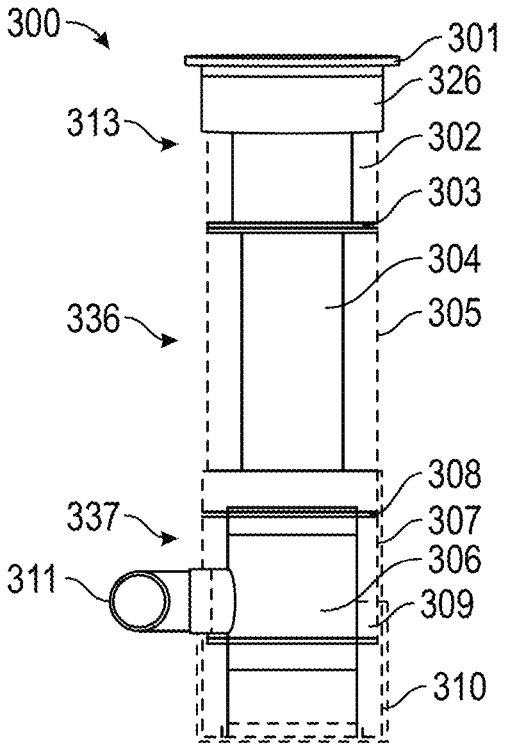
FIG. 15A is a side view of an embodiment of a powered pool skimmer device.
Figure 22A:
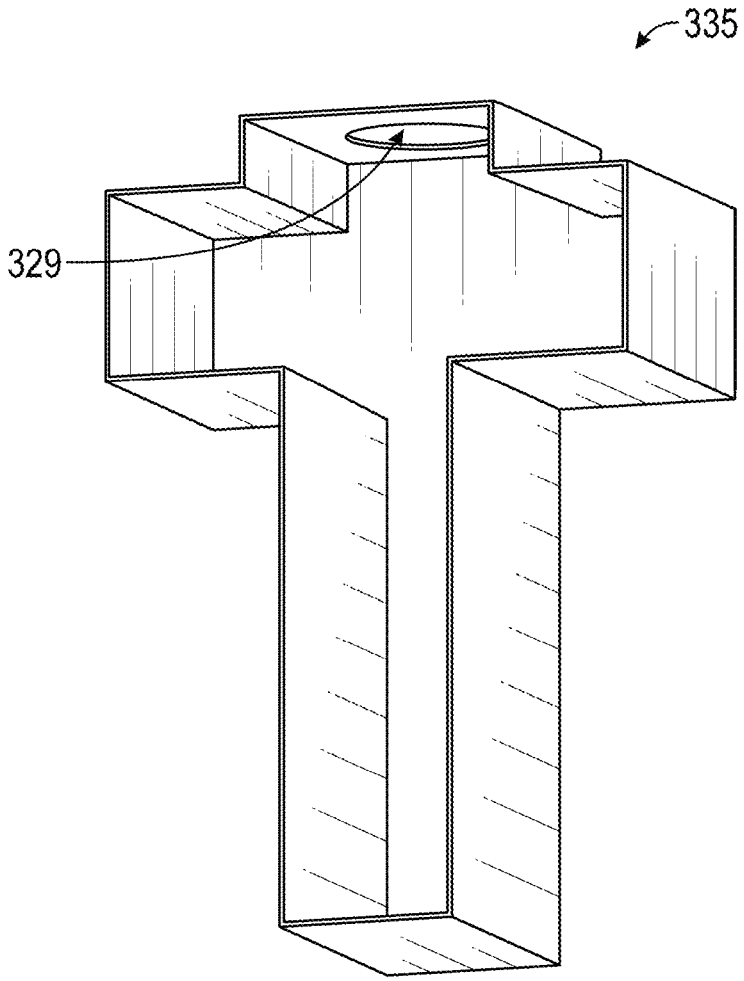
FIG. 22A is a perspective view of an embodiment of a rectangular frame that can be installed in the sidewall of a swimming pool to house the skimmer device sleeve of FIG. 21A.
Figure 22B:
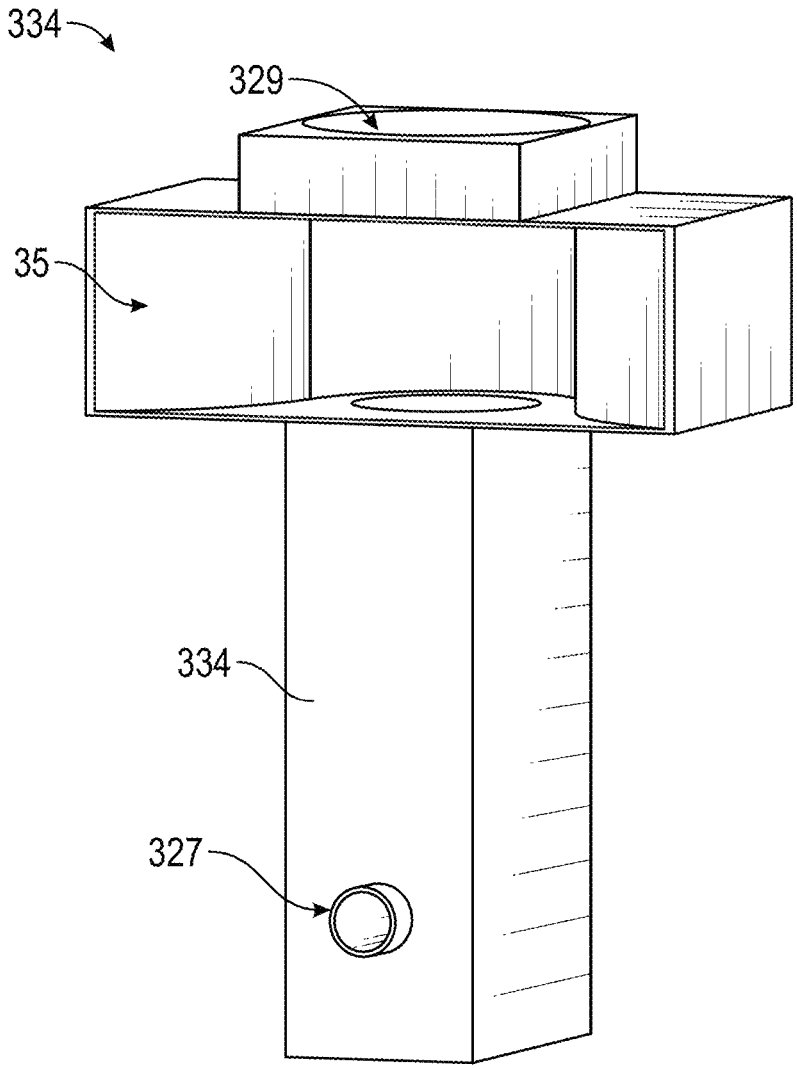
FIG. 22B is the embodiment of a rectangular powered pool skimmer device sleeve, which will be housed in the permanently installed rectangular frame represented in FIG.
Figure 22C:
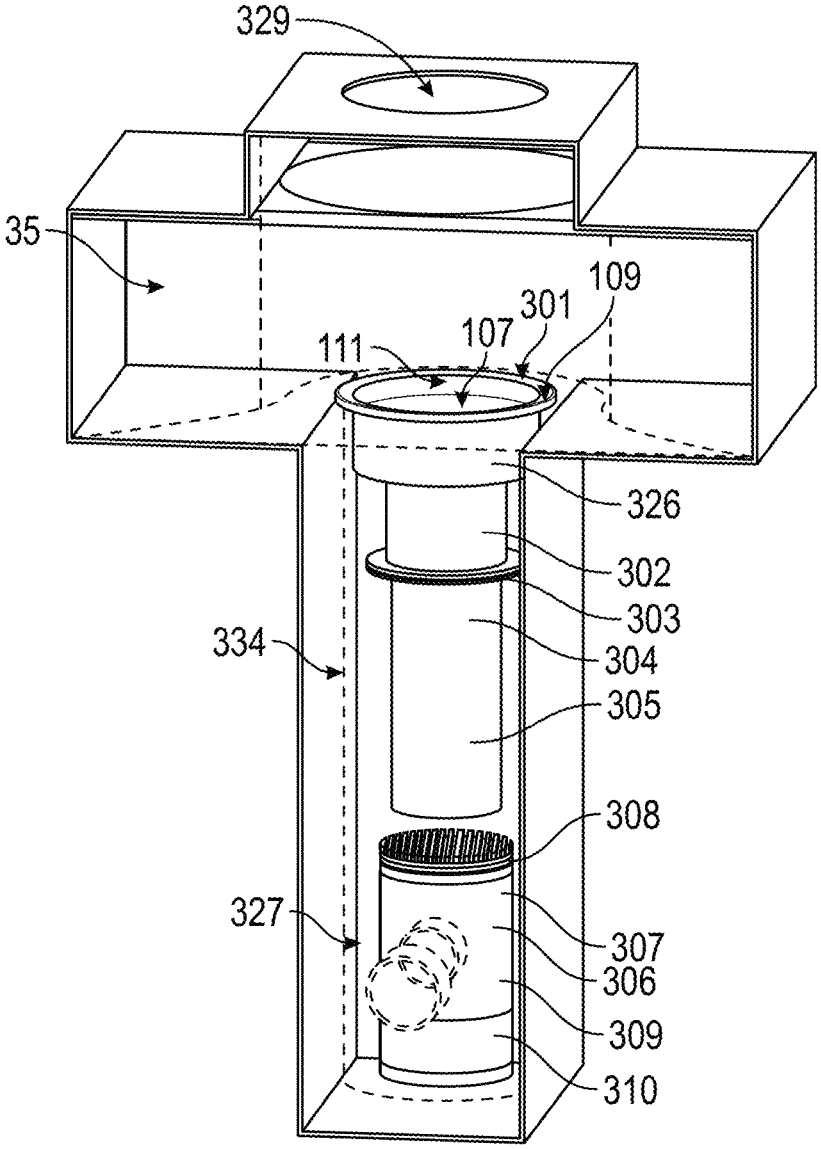

FIG. 22C is the embodiment of the powered pool skimmer device shown in FIG. 15A inserted into the rectangular powered pool skimmer device sleeve shown in FIG. 22B.

Figure 22D:
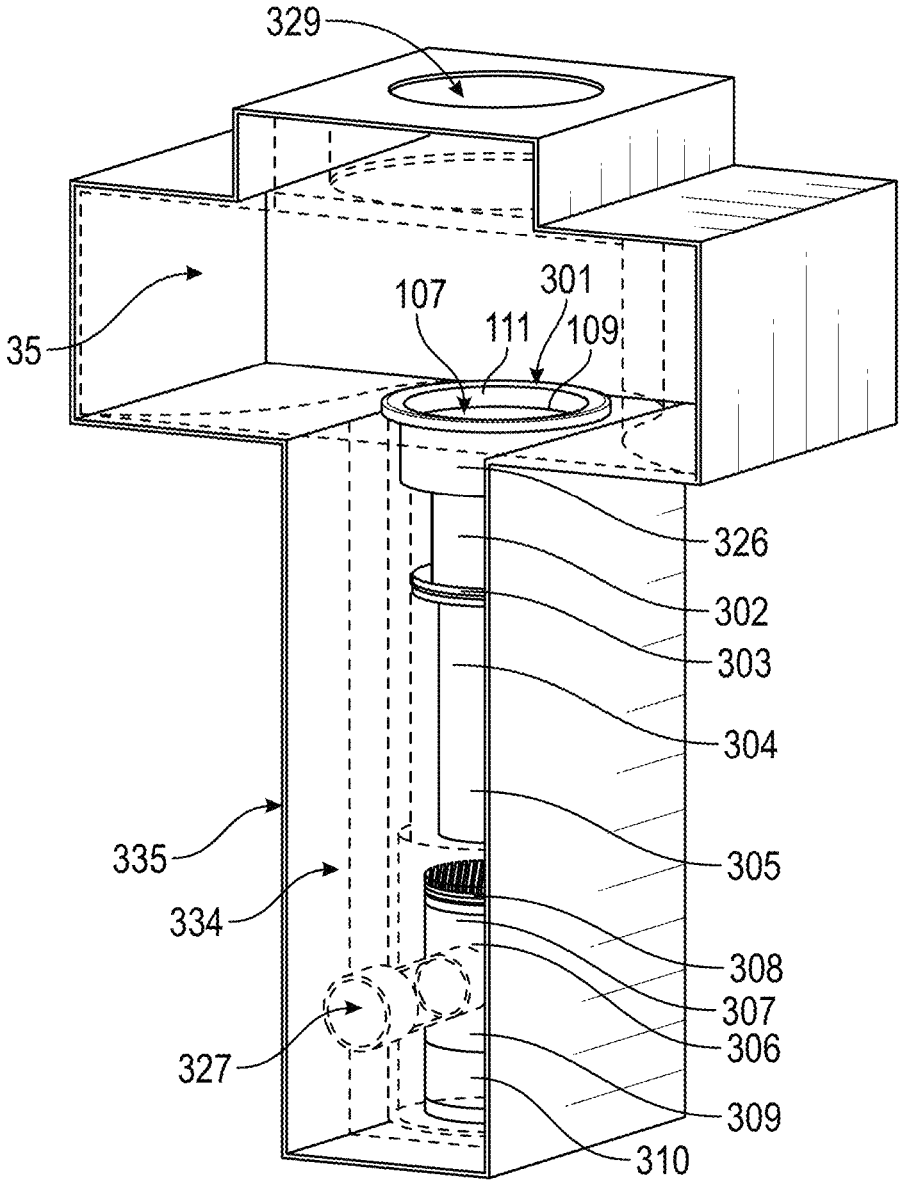

FIG. 22D is the embodiment of the powered pool skimmer device shown in FIG. 15A inserted into the rectangular powered pool skimmer device sleeve shown in FIG. 22B, which is housed in rectangular frame shown in FIG. 22A.

Figure 22E:
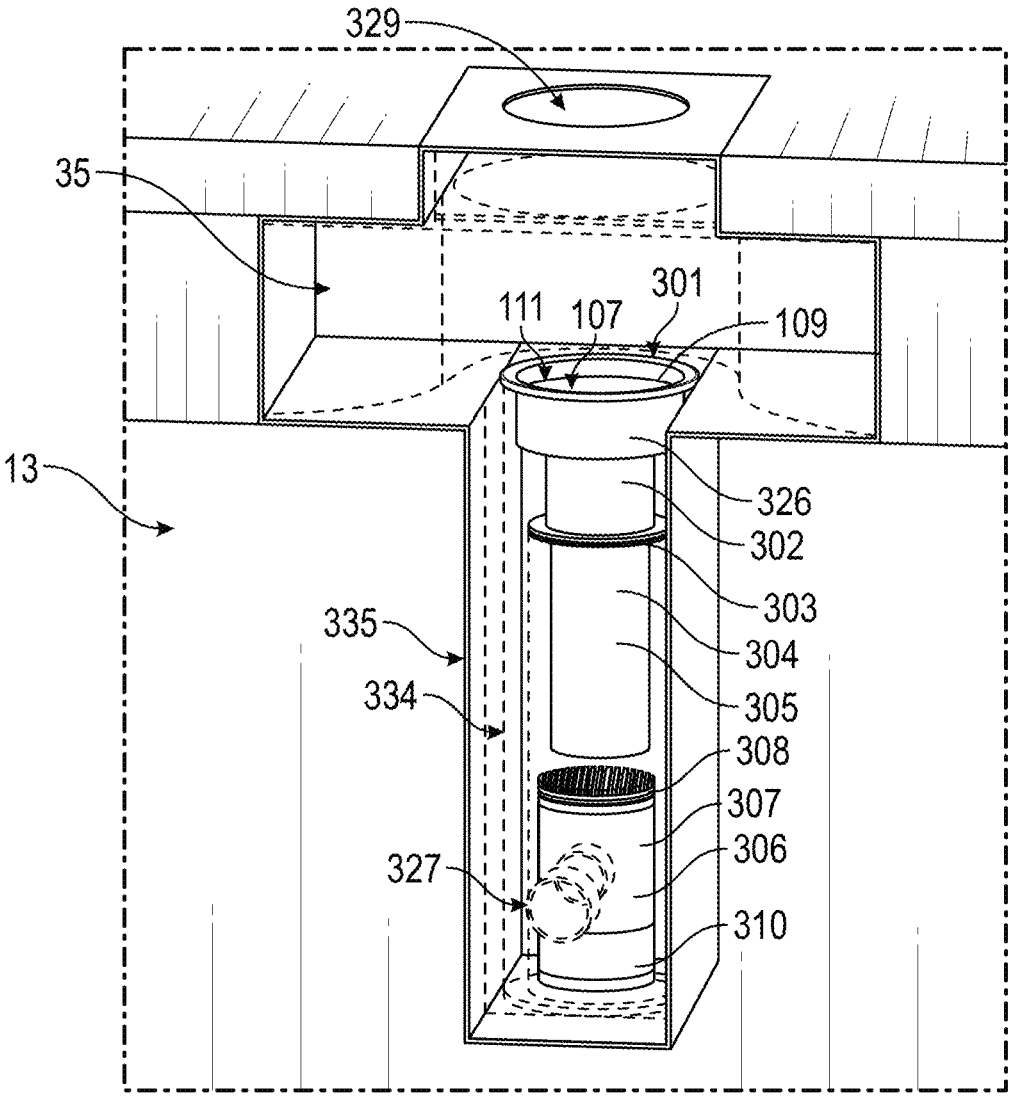

FIG. 22E shows the rectangular frame represented in FIG. 22A installed in the wall of a swimming pool. In the rectangular frame shown in FIG. 22A, the rectangular powered pool skimmer device sleeve shown in FIG. 22B has been placed, and the powered pool skimmer device shown in FIG. 15A is inserted into the rectangular sleeve. The lower and upper parts in front of the pool wall and deck, but not in front of the skimmer aperture, will be covered with covers similar to the covers that cover the bottom filters in most pools.

DETAILED DESCRIPTION

This application relates to devices, systems, and methods that are configured to clean a pool, such as a swimming pool. The devices, systems, and methods may be configured, in particular, to clean debris, such as pollen, insects, seeds, leaves, etc., from the surface of the water in a pool. As will be described in greater detail below, the devices, systems, and methods may be configured to use the surface tension of the water to pull in debris from the surface of the water.

Figure 2:
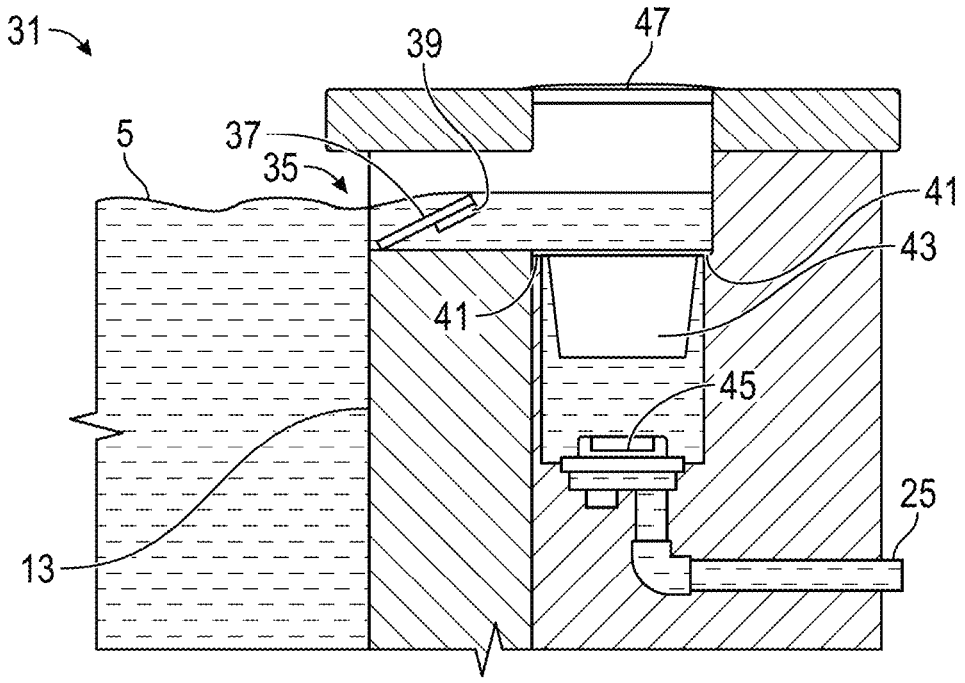
FIG. 2 is a cross-sectional view of an embodiment of a pool skimmer.

Generally, swimming pools include pool skimmers in an effort to clear the surface of the water from debris. An example of such a skimmer is shown in FIG. 2 described below. These skimmers, however, do not work effectively, often failing to sufficiently clean the surface of the pool of debris. For example, with such a skimmer, even after the debris has entered the skimmer, it may not be sucked into the filter. This can be particularly true for smaller debris (such as pollen, small insects, seeds, etc.) as these types of debris float and do not saturate. Further, debris trapped in the skimmer may float out of the skimmer and back into the pool after the filter is powered off. Again, this can be particularly true for small debris which can often float over or around the pool skimmer's weir door.

The following discussion presents detailed descriptions of the several embodiments of the pool skimmer devices, systems, and methods shown in the figures. These embodiments are not intended to be limiting, and modifications, variations, combinations, etc., are possible and within the scope of this disclosure. As will be discussed in more detail below, these pool skimmer devices, systems, and methods can be used to efficiently and effectively clean the surface of a pool.

Figure 1:
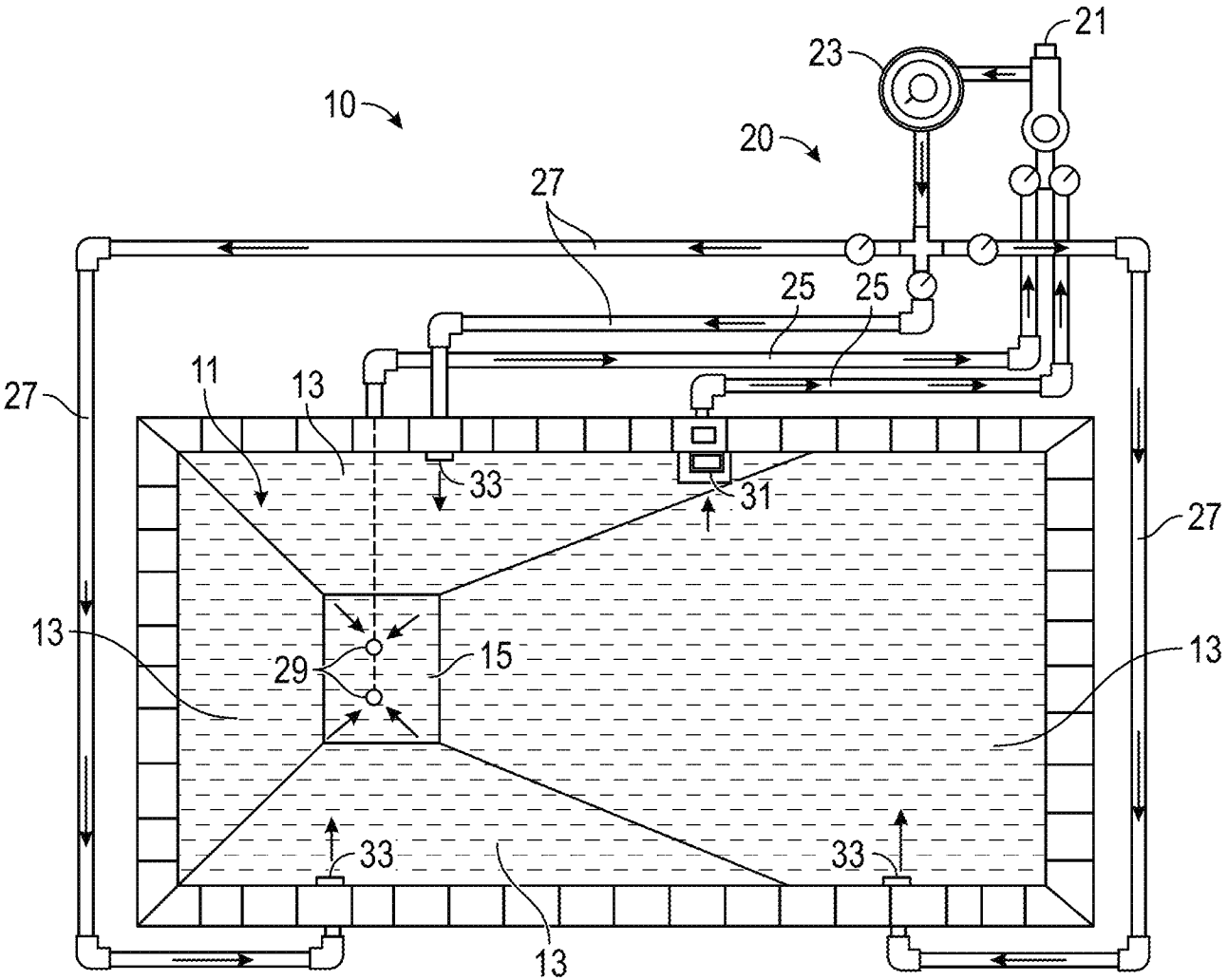
FIG. 1 is a schematic illustration of an embodiment of a pool system.

FIG. 1 is a schematic illustration of an embodiment of a pool system 10. As illustrated, the pool system 10 includes a pool 11 and a circulation and filtration system 20. The pool system 10 may be representative of an outdoor pool system, an indoor pool system, an inground pool system, an above ground pool system, or any other type of pool system. The pool 11 of the pool system 10 can include freshwater or saltwater. The pool 11 of the pool system 10 includes sidewalls 13 and the bottom surface 15 that contain the water of the pool 11. Although illustrated with a generally rectangular shape, the pool 11 can be formed with any suitable shape as desired.

The pool system 10 includes a circulation and filtration system 20 configured to circulate and clean the water of the pool 11. Various types of circulation and filtration systems 20 can be used. As illustrated, the circulation and filtration system 20 includes a water pump 21 that circulates water from the pool 11 through various suction lines 25 and return lines 27. The water pump 21 also circulates the pool water through a filter 23.

Example flow of water through the circulation and filtration system 20 of the pool system 10 will now be described with reference to FIG. 1. As illustrated, the pool system 10 includes two main drains 29 positioned in the bottom surface 15 of the pool 11. The water pump 21 pulls water from the pool 11 through the main drains 29 and corresponding suction lines 25.

The pool system 10 also includes a pool skimmer 31. The pool skimmer 31 can be positioned in a sidewall 13 of the pool 11. An example pool skimmer 31 is shown in greater detail in the cross-sectional side view of FIG. 2, which is described in more detail below. As shown in FIGS. 1 and 2, the pool skimmer 31 is positioned in the sidewall 13 of the pool 11 near the water line of the water in the pool 11. The water pump 21 also pulls water from the pool 11 through the pool skimmer 31 and the corresponding suction line 25. The water pump 21 then pumps the water in the suction lines 25 through the filter 23. After passing through the filter 23, the water pump 21 moves the water through return lines 27. In the illustrated embodiment the pool system 10 includes three returns 33 through which the water is returned to the pool 11.

The pool skimmer 31 attempts to clean the surface of the water of the pool 11 as the pump 23 pulls water through the pool skimmer 31. The conventional process by which the pool skimmer 31 will be described with reference to FIG. 2.

FIG. 2 is a cross-sectional view of an embodiment of the pool skimmer 31 of the pool system 10 of FIG. 1. As shown, the pool skimmer 31 includes an aperture 35 formed in the sidewall 13 of pool 11. The aperture 35 is generally provided at the surface 5 of the water in the pool at 11. The aperture 5 may be generally rectangular, although other shapes are possible. The aperture 35 may be formed in the coping of the sidewall 13 of the pool 11. The aperture 35 allows water from the surface 5 of the pool 11 (for example, the top 0 to 5 inches of water) to enter into the pool skimmer 31 through the aperture 35.

The pool skimmer 31 can include a weir door 37 configured to close the aperture 35. The weir door 37 can comprise a hinged door and a float 39. The float 39 is configured to raise the weir door 37 to close the aperture 35 (for example, such that the top of the weir door 37 is positioned at the surface 5 of the water). When the pump 21 (FIG. 1) is active, the pull of water through the pump 21 may cause water from the pool 11 to flow over the weir door 37 and into the pool skimmer 31.

Figure 3:
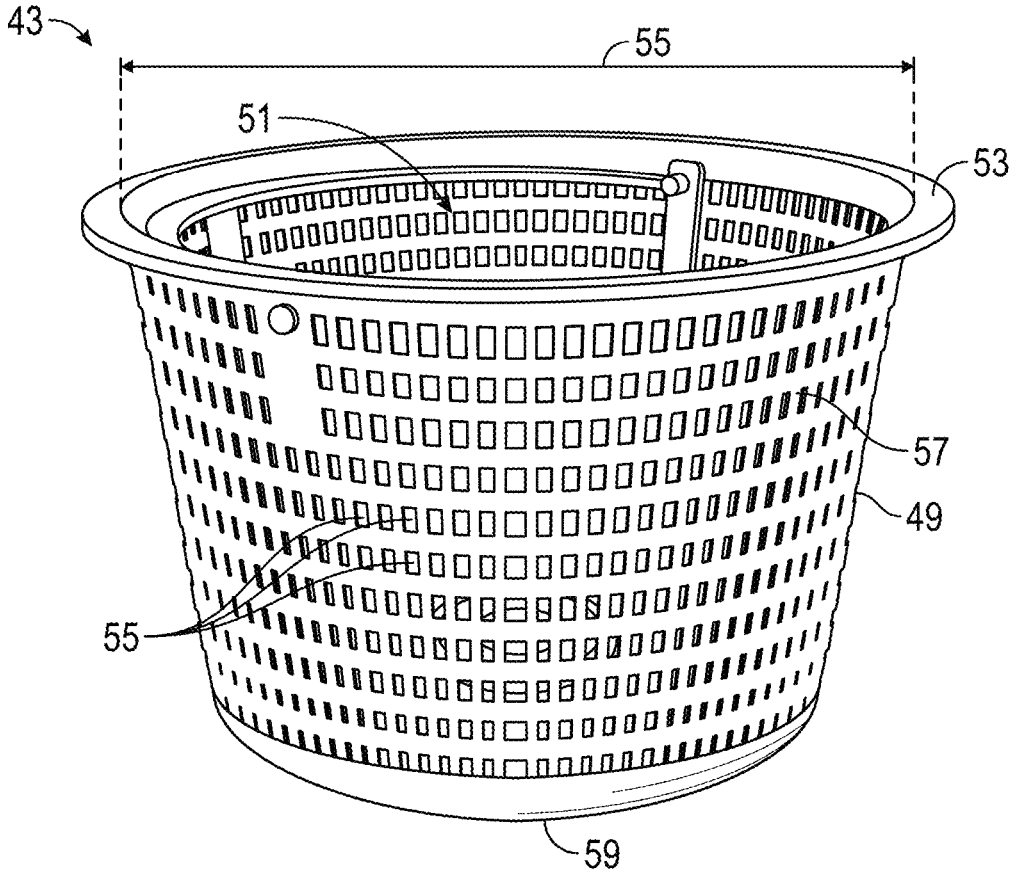
FIG. 3 is a perspective view of an embodiment of a skimmer basket.

Within the pool skimmer 31, the pool skimmer includes a skimmer basket 43. The skimmer basket 43 can be supported by a ledge 41 or other supporting structure within the pool skimmer 31. An example skimmer basket 43 is shown in FIG. 3, which is described in more detail below. The skimmer basket 43 is generally configured to serve as a filter or strainer (for example, including perforated openings or mesh) configured to prevent debris (e.g., debris larger than the perforated openings) from being sucked through pool skimmer 31 and into the water pump 21.

Below the skimmer basket 43, the pool skimmer 31 can, in some embodiments, include a float valve 45. The float valve 45 can be configured as a safety device for the water pump 21. If the water gets low in the pool 11, a float inside the float valve 45 can fall down to shut off the pool skimmer 31 such that the water pump 21 only pulls water from the main drains 29 of the pool 11. This can prevent damage to the water pump 21 caused by running the pump dry. In some embodiments, a pool system 10 can have the line to the bottom filter capped. However, there are many installations where this opening is not capped, and a pipe extends to the bottom filter opening. In these configurations, the float valve 45 is available.

FIG. 2 further illustrates a portion of the suction line 25 that connects the pool skimmer 31 to the water pump 21. In use, the water pump 21 pulls water over the weir door 37 and into the pool skimmer 31. The water is then pulled down through the skimmer basket 43, which strains larger debris from passing therethrough. The water is then pulled through the float valve 45 (if installed) and suction line 25 to the water pump 21. Large debris may be caught within the skimmer basket 43. Some small debris may also become saturated and enter the skimmer basket 43. When the water pump 21 is disengaged, however, much of the debris in the skimmer basket 43 is free to float back up to the surface 5 of the water and join small debris that is already floating above the skimmer basket 43. In some instances, the floating debris is able to float over or around the weir door 37, through the aperture 35, and back into the pool 11. Thus, a pool skimmer 31 as shown in FIG. 2 can be inefficient at cleaning the surface 5 of the water, leading many pool owners to run their filtration and circulation systems at high power and/or for an extended duration in an effort to get small floating debris to actually submerge and enter the suction line 25 to the filter 23.

Another problem with pool skimmers 31 such as shown in FIG. 2 is that they are often only able to trap and remove debris from the surface 5 of the pool water when the debris moves close to the aperture 35 of the pool skimmer 31 so as to be sucked into the skimmer basket 43. This can leave a large portion the pool surface uncleaned. The pool skimmer 31 has no mechanism for pulling the surface 5 of the water into the pool skimmer 31.

FIG. 3 is a perspective view of an embodiment of the skimmer basket 43 of the pool skimmer 31 of FIG. 2. In the illustrated embodiment, the skimmer basket 43 includes a main body 49. As shown, the main body 49 of the skimmer basket 43 comprises a tapered cylindrical or frustoconical shape. Other shapes for the main body 49 of the skimmer basket 43 are also possible, such as fully cylindrical or even rectangular. In FIG. 3, the main body 49 of the skimmer basket 43 comprises side walls 49 and bottom wall 59. The skimmer basket 43 also comprises an upper opening 51 surrounded by a rim 53.

The upper opening 51 provides an entrance into the skimmer basket 43. The upper opening 51 can have a diameter 55 as shown. Various pool supply manufacturers provide different types of skimmer baskets 43 for different types of pool skimmers 31. Accordingly, the diameter 55 of the upper opening 51 may be different depending on the specific embodiment of the skimmer basket 53. Although the upper opening 51 is described as having a diameter 55, in some embodiments, the skimmer basket 43 (and in particular the upper opening 51) may be non-circular (e.g., square or rectangular). The rim 53 can be configured to engage with the ledge 41 of the pool skimmer 31 (FIG. 2) to support the skimmer basket 41 within the pool skimmer 31.

Additionally, as illustrated, the main body 49 of the skimmer basket 43 (e.g., the sidewalls 57 and or bottom wall 59 can include a plurality of apertures 55 (such as perforations or openings) configured to provide straining functionality for the skimmer basket 43. The size of the apertures 55 can vary depending on the specific embodiment. In some embodiments, the apertures 55 can be replaced with or include a mesh.

FIGS. 4A-10D illustrate views and various components of embodiments of pool skimmer devices that can be used to improve the efficiency of a pool skimmer, such as the pool skimmer 31 of FIGS. 1 and 2. The pool skimmer devices can include a funnel shaped opening that allows water to enter the filter suction pipe through a large diameter opening that tapers to a smaller diameter opening. The pool skimmer devices can positioned the funnel shaped opening just below the surface of the water, which can induce flow through the devices. Water from the surface of the pool can simply fall and follow the funnel shape into the skimmer (as shown in FIG. 6A). The skimmer devices can be configured to attach to conventional skimmer baskets, such as the skimmer basket 43. The wide opening of the funnel of the skimmer can allow water to enter the funnel shape into a lower smaller opening, and then into the skimmer basket 43. As will be described in more detail below, the pool skimmer devices described may induce a vortex to force small floating debris into the skimmer basket of the pool skimmer by raising the suction hole toward the waterline in the pool skimmer.

The skimmer devices can be configured to position the larger opening of the funnel at a predetermined depth just below the surface of the water in the pool. When the opening of the funnel is near the surface, the water level in the skimmer device may be lower than the water level in the pool skimmer. This can cause the water to follow the shape of the funnel into the lower part of the funnel and into the basket below. If the skimmer device's opening is deeper than the water in the pool skimmer, the water may swirl and create a strong vortex that may suck debris into the lower part of the funnel and into the basket below.

Floating debris in pool water is trapped within the surface tension of the water. As will become more fully apparent from the following description, when water enters the funnel of the skimmer device, the surface will warp and be pulled into the wide opening, through the narrow opening, and into the attached debris catching skimmer basket. Along with pulling the surface water into the skimmer basket, all or much of the small floating debris, such as pollen, dust, bugs, small leaves, pieces of deteriorating thermo-pool covers, etc., will also be pulled into the skimmer basket. Inside the skimmer basket, there are two places for the small floating debris to go. It can float back up, but it is unlikely to go back through the narrow opening of the funnel. It will instead rise into the raised edge that circles the narrow opening of the funnel (see FIG. 6B). This can prevent small debris from escaping the skimmer basket and entering back into the pool. The debris can also be sucked into the pool filter, assuming it is sufficiently small so as to pass through the skimmer basket.

Further, since the debris can be mixed into the water as it flows through the funnel of the skimmer device, it can be temporarily less buoyant. Also, the debris can now be much closer to the filter opening located at the bottom of the pool skimmer. The turbulence within the basket can also be increased by the skimmer device, which forces the debris particles closer to the bottom of the basket. These and other features of the skimmer devices described herein will become more fully apparent from the descriptions of the non-limiting examples of FIGS. 4A-10D.

Figure 4A:
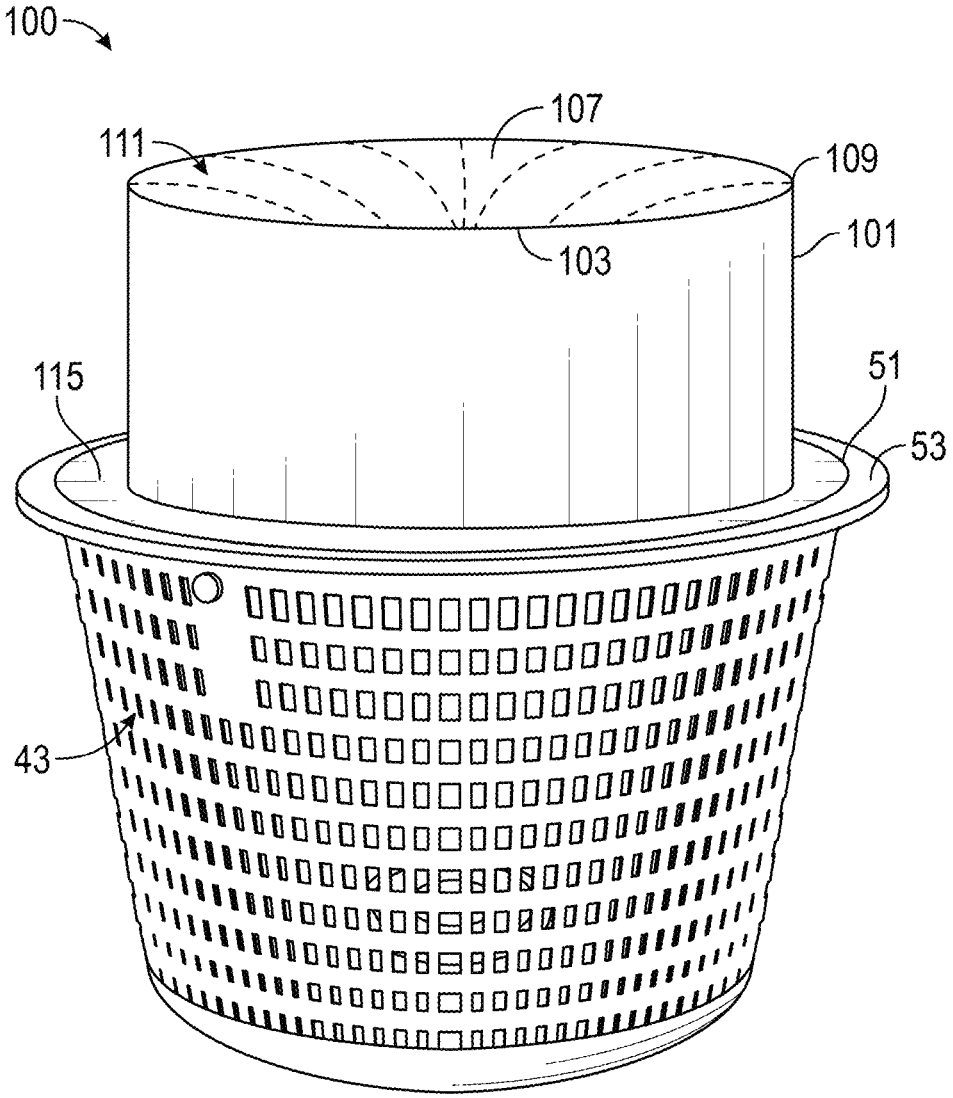
FIG. 4A is a perspective view of an embodiment of a skimmer device.

FIG. 4A is a perspective view of an embodiment of a skimmer device 100. As shown in this example, the skimmer device 100 can be attached or attachable to the skimmer basket 43 (described above with reference to FIG. 3). When attached to the skimmer basket 43 and installed in the pool skimmer 31 (FIG. 2) the efficiency of the pool skimmer 31 for cleaning the surface 5 of the pool 11 can be greatly increased.

In the illustrated embodiment, the skimmer device 100 includes an extension body 101. The extension body 101 can extend upward from the skimmer basket 43. The extension body 101 can extend between a distal end 103, and a proximal end 105. The distal end 103 can be positioned above the skimmer basket 43. The proximal end 105 can be positioned within the skimmer basket 43, as shown in the cross-sectional views of FIGS. 4B and 4C. In the illustrated embodiment, the extension body 101 comprises a generally cylindrical tube, although other shapes are also possible. In some embodiments, the extension body may comprise a cross-sectional shape that corresponds to the shape of the upper opening 51 of the skimmer basket 43. In some embodiments, the extension body 101 may comprise a telescoping body as shown, for example, in FIGS. 9A-9C, described below.

Figure 5A:
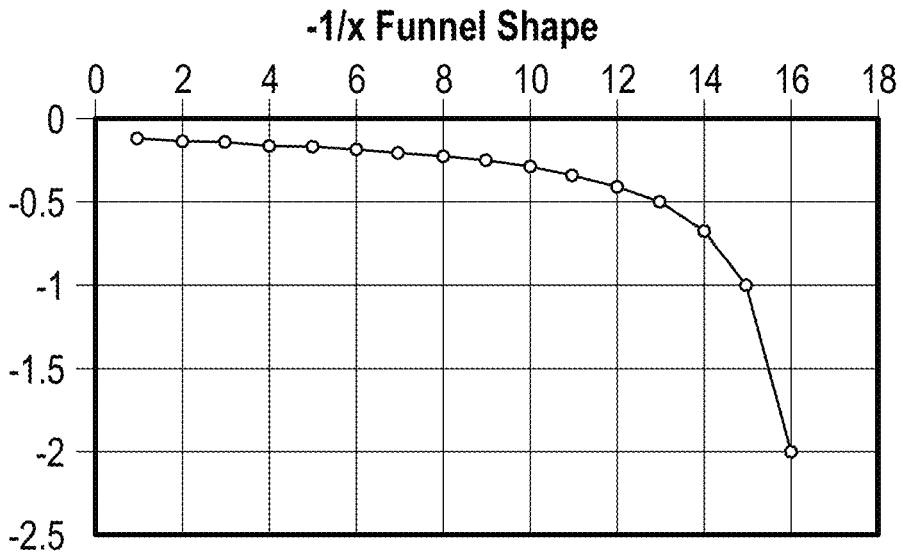
FIG. 5A is a graph illustrating a −1/x curve, which may be used to define the shape of a funnel of a skimmer device according to some embodiments.
Figure 5B:
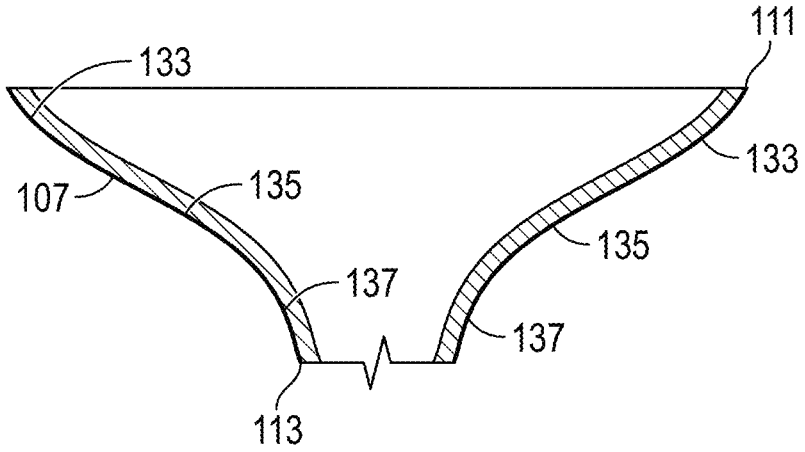
FIG. 5B illustrates another shape for a funnel of a skimmer device according to some embodiments.

The skimmer device 100 can include a funnel 107. The funnel 107 can be positioned at the distal end 103 of the extension body 101. The funnel 101 may comprise various profiles or shapes. Different profiles may produce different flow effects on water that flows through the funnel. Several example profiles are shown in FIGS. 5A and 5B, which are described below. As shown in FIG. 4A, the funnel 107 can include a lip 109. The lip 109 can be engaged with the distal end 103 of the extension body 101 so that the extension body 101 supports the funnel 107. In some embodiments, the lip 109 is permanently attached to the distal end 103 of the extension body 101. For example, the funnel 107 and the extension body 101 can be integrally formed or permanently connected. In some embodiments, the lip 109 is selectively attachable to the distal end 103 of the extension body 101. When the lip 109 is selectively attachable, the extension body 101 may be configured to slide into (or otherwise selectively engage with) the lip 109. The lip 109 can include a collar that wraps around extension body 101. Selective attachment of the lip 109 to the extension body 101 can allow for funnel replacement and experimentation, for example, allowing a funnel 107 of one profile or shape to be removed and replaced with a funnel 107 of a different profile or shape.

Figure 4B:
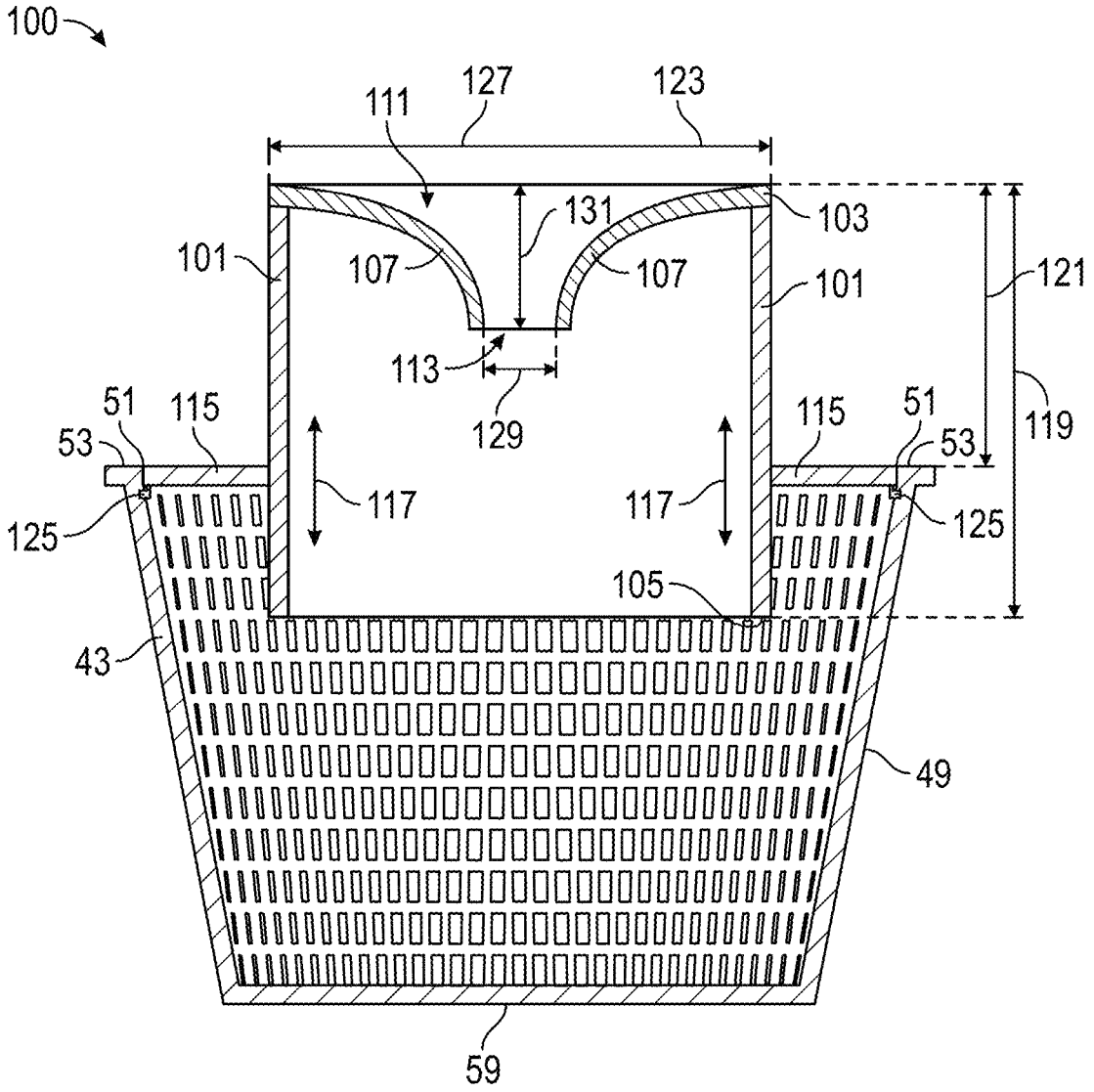
FIG. 4B is a cross-sectional side view the skimmer device of FIG. 4A.
Figure 4C:
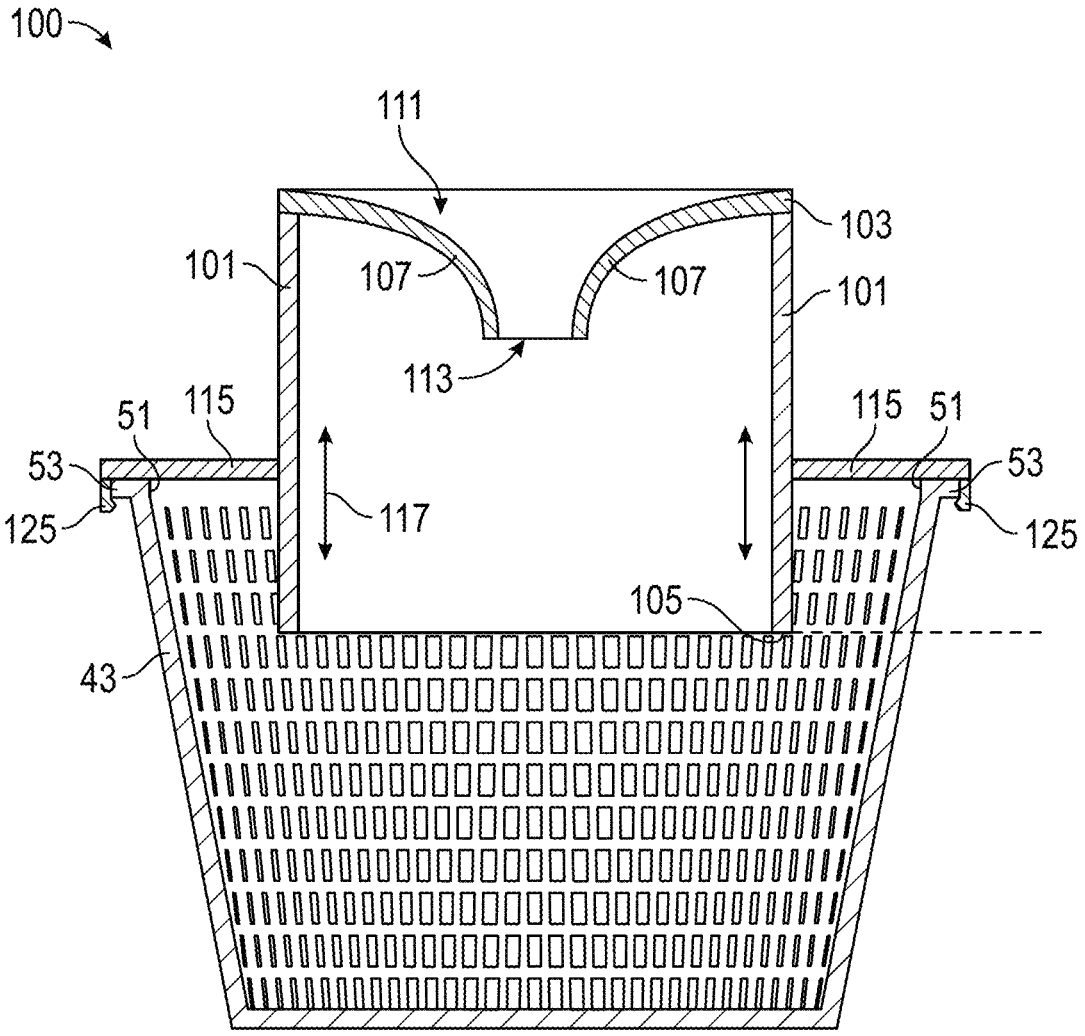
FIG. 4C is a cross-sectional side view of another embodiment of a skimmer device.

In general, the funnel 107 tapers from a wide opening 111 at the top of the funnel 107 to a more narrow opening 113 at the bottom of funnel 107 (see, for example, the narrow opening 113 within the extension body 101 in the cross-sectional views of FIGS. 4B and 4C). Various sizes for the wide opening 111 and the narrow opening 113 are possible. For example, in one embodiment that has been built and tested, the wide opening 111 is approximately six inches and the narrow opening 113 is approximately four inches, in another built and tested embodiment, the wide opening 111 is approximately six inches and the narrow opening 113 is approximately two inches. In both of these cases, the funnel profile between the wide opening 113 and the narrow opening 111 follows the formula $-1/x$ (as described below with reference to FIG. 5A), with x ranging from 3 to 2 in the larger funnel and x ranging from 3 to 1 in the smaller funnel. These are only examples, and other sizes of the wide and narrow openings 111, 113 and profiles for the funnel 107 are possible as described below. In some embodiments, the funnel 107 can be manufactured from a clear or transparent material such that users can see what is in the skimmer basket 43 (e.g., the debris). This need not be the case in all embodiments. The funnel 107 may be made from an opaque material.

In some embodiments, the lip 109 may comprise a smooth rounded raised edge around the wide opening 111. Such a rounded edge may catch small floating debris that is persistently floating and also allow water to more smoothly enter the funnel 107. The shape of the lip 109 and/or wide opening 111 may be smooth and round or have ridges that help increase the pull of the surface water. For example, the lip 109 can comprises a raised opening with several ridges or notches formed therein through which water can flow into the funnel 107. This, however, need not be the case in all embodiments. In some embodiments, a rounded edge can be applied to the wide opening 111 or lip 109 of the funnel 107. In some embodiments, certain parts of the rounded edge can be flattened to allow more water flow in through these flattened areas.

The skimmer device 100 can be attached or attachable to the skimmer basket 43 with a mounting plate 115. The mounting plate 115 can be provided with an outer diameter that is configured to correspond to the diameter 55 of the opening 51 of the skimmer basket 43. Mounting plates 115 can be provided in different sizes that are selected and configured to fit different skimmer baskets 43, such that the skimmer device 100 can be made universal or generally universal by providing a plurality of different sized mounting plates 115 configured to work with different sized skimmer baskets 43. In some embodiments, the mounting plate 115 is configured to fit within the upper opening 51 of the skimmer basket 43 (see FIG. 4B). In some embodiments, the mounting plate 115 is configured to fit over the upper opening 51 of the skimmer basket 43, for example, resting on top of the rim 53 of the skimmer basket 43 (see FIG. 4C).

The extension body 101 can be configured to position the funnel 107 of the skimmer device 100 just below the surface 5 of the water. In some embodiments, the height of the extension body 101 relative to the mounting plate 115 and/or skimmer basket 43 is fixed. In other embodiments, however, the height at which the extension body 101 positions the funnel 107 may be adjustable. This may be advantageous as the depth at which the skimmer basket 43 is positioned within the pool skimmer can vary (e.g., according to the pool or pool skimmer manufacturer) and because the water level in the pool can change. Due to these variabilities, it may be advantageous to have an adjustable extension body 101, such as will be described with reference to FIGS. 4B, 4C and 9A-9C.

Although this description is made with reference to a skimmer device 100 that is attachable to the skimmer basket 43, in some instances, the skimmer device 100 and the skimmer basket 43 may be integrally formed.

FIG. 4B is a cross-sectional side view the skimmer device 100 of FIG. 4A. As shown in FIG. 4B, the extension body 101 can extend through the mounting plate 115. This allows the distal end 103 of the extension body 101 to be positioned above the mounting plate 115 and the proximal end 105 of the extension body 101 to be positioned below the mounting plate 115. In some embodiments, the height of the distal end 103 of the extension body 101 above the mounting plate 115, represented in FIG. 4B as the height 121, can be adjusted by sliding the extension body 101 up and down through the mounting plate 115. In some embodiments, the height 121 is adjustable from a position at which the proximal end 105 is positioned at the same level as the mounting plate 115 (i.e., a highest setting) to a position at which the distal end 103 is positioned at the same level as the mounting plate 115 (i.e., a lowest setting).

Figure 6A:
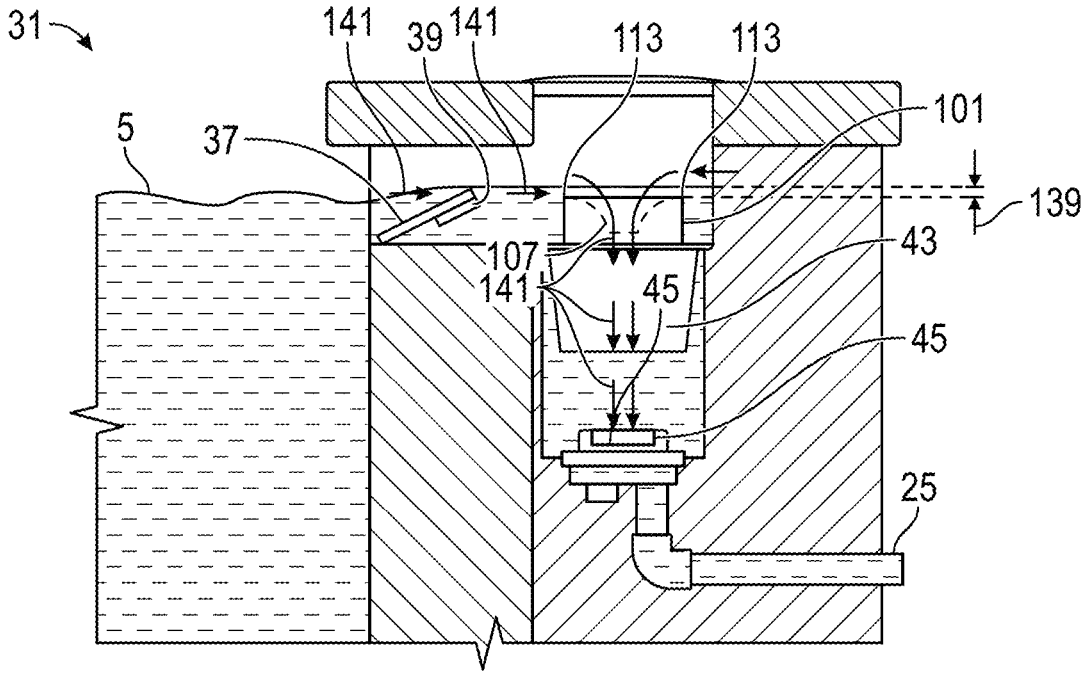
FIG. 6A is a cross-sectional view of an embodiment of a pool skimmer with a skimmer device installed and illustrates example flow therethrough when a pump of a pool system is active.
Figure 7A:
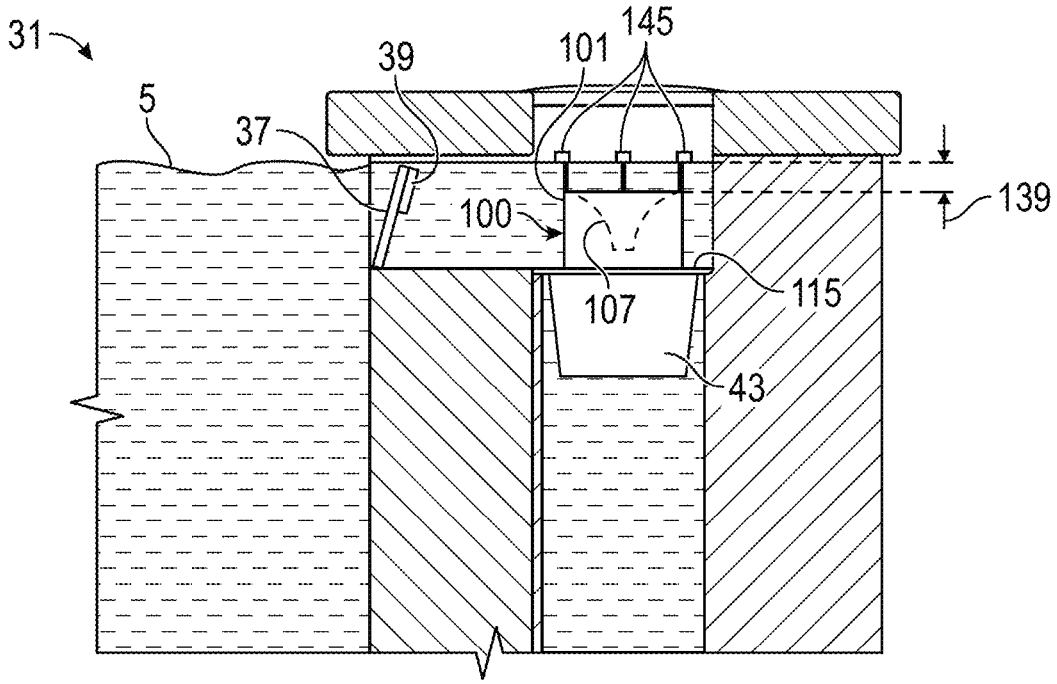
FIG. 7A illustrates an embodiment of a skimmer device that includes floats that automatically adjust a height of the skimmer device as a water level in a pool changes. The skimmer device is illustrated in a cross-sectional view of an embodiment of a pool skimmer. In the illustrated example, the water level is high.
Figure 7B:
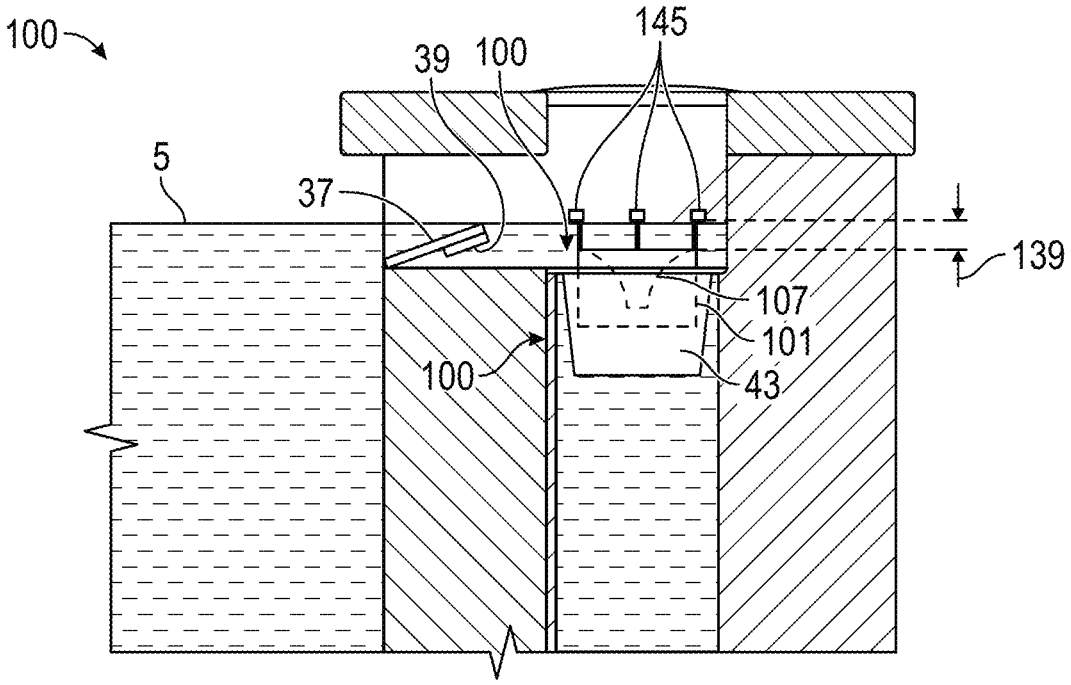
FIG. 7B illustrates the skimmer device with floats of FIG. 7A in a cross-sectional view of the pool skimmer in an example where the water level is lower than in FIG. 7A.

The adjustment of the height 121 can be configured such that the distal end 103 and/or the wide opening 111 of the funnel 107 can be positioned at a depth 139 below the surface 5 of the water (as shown in FIGS. 6A, 7A, 7B). Adjustment of the height 121 can be manual or automatic. Manual adjustment can comprise, for example, sliding the extension body 101 up or down through the mounting plate 115. In some embodiments, the mounting plate 115 and the extension body 101 can be threaded, such that manual adjustment comprises twisting the extension boy 101 with respect to the mounting plate 105. Automatic adjustment of the height 121 can be accomplished with floats 145, as described below with reference to FIGS. 7A-7C, for example).

In some embodiments, the lowest setting may be determined, in part, based on the shape of the sidewalls 49 of the skimmer basket 43. For example, if the sidewalls 49 are sharply tapered, the proximal end 105 may contact the sidewalls 49 of the skimmer basket at the lowest setting. This can be avoided, for example, by decreasing the overall diameter 127 of the extension body 101 or utilizing a telescoping extension body 101 as shown, for example, in FIGS. 9A-9C.

Various dimensions for the skimmer device 100 are illustrated in FIG. 4B, including a length 119 of the extension body 101, a height 121 of the extension body 101 above the mounting plate 106, a diameter 127 of the wide opening 111 of the funnel 107 (also the diameter 127 of the extension body 101 and hole through the mounting plate 115), a diameter 129 of the narrow opening 113 of the funnel 107, and a depth 131 of the funnel 107 (i.e., a distance between the wide opening 111 at the top of the funnel 107 and the narrow opening 113 at the bottom of the funnel 107.

The length 119 of the extension body 101 can be, for example, about 12 inches, about 10 inches, about 8 inches, about 6 inches, or about 4 inches, as well as lengths in between, above, and below any of the listed values. The height 121 of the extension body 101 above the mounting plate 106 (which can be representative of a total adjustment distance for the extension body 101) can be, for example, about 12 inches, about 10 inches, about 8 inches, about 6 inches, or about 4 inches, as well as lengths in between, above, and below any of the listed values.

The diameter 127 of the wide opening 111 of the funnel 107 can be, for example, about 10 inches, about 8 inches, about 6 inches, or about 4 inches, as well as lengths in between, above, and below any of the listed values. The diameter 129 of the narrow opening 113 of the funnel 107 can be, for example, about 5 inches, about 4 inches, about 3 inches or about 2 inches, or about 1 inch, as well as lengths in between, above, and below any of the listed values. In some embodiments, the ratio of the diameter 127 of the wide opening 111 of the funnel 107 to the diameter 129 of the narrow opening 113 is about 10 to 1, about 8 to 1, about 6 to 1, about 5 to 1, about 4 to 1, about 3 to 1, about 2 to 1 about 1.75 to 1, about 1.5 to 1, about 1.3 to one, about 1.25 to 1, about 1.2 to 1, or about 1.1 to 1. Other ratios are also possible. The depth 131 of the funnel 107 between the wide opening 111 at the top of the funnel 107 and the narrow opening 113 at the bottom of the funnel 107 can be, for example, about 6 inches, about 5 inches, about 4 inches, about 3 inches, or about 2 inches as well as lengths in between, above, and below any of the listed values.

Figure 4D:
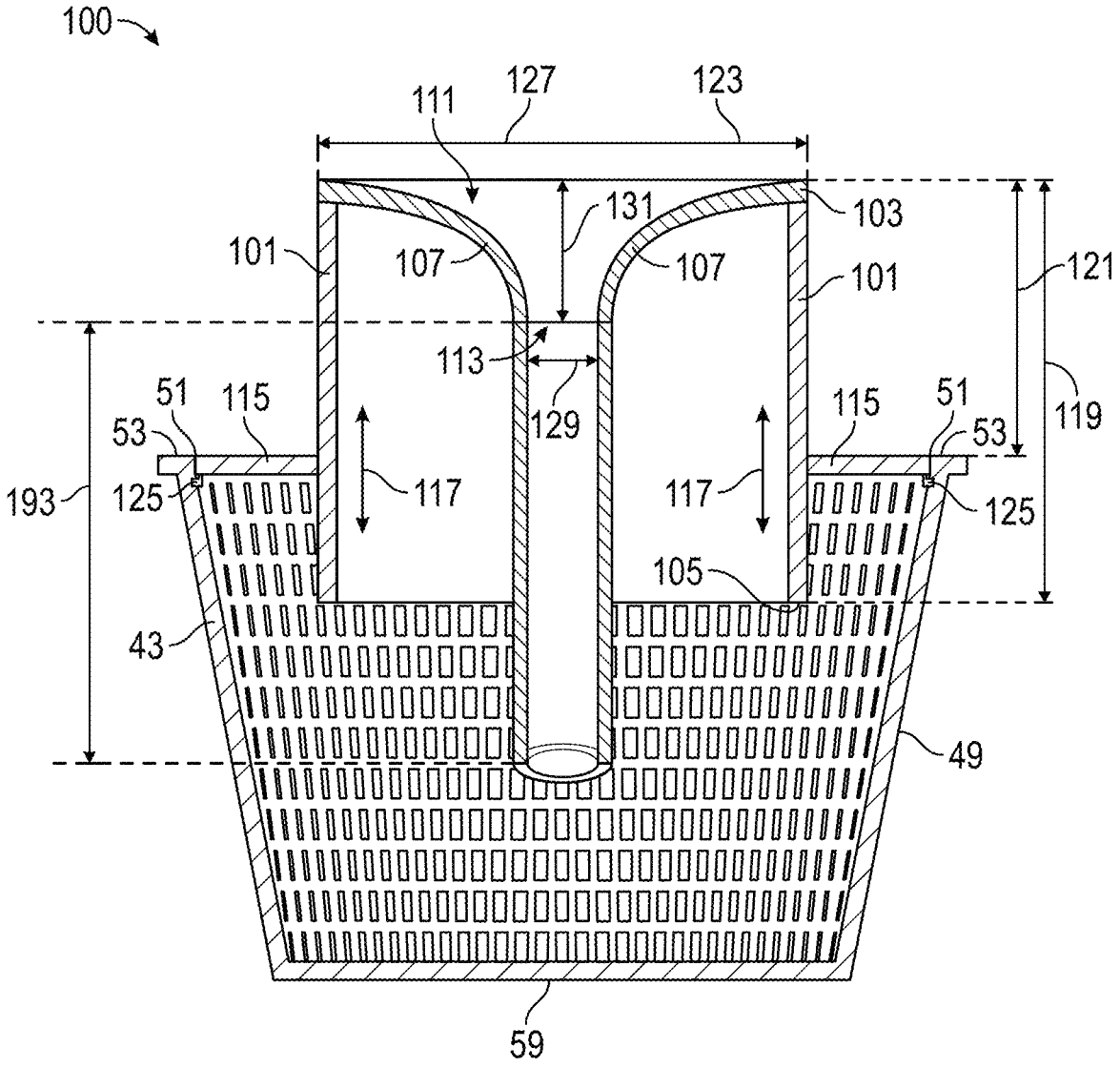
FIG. 4D illustrates an example of a skimmer device that includes a funnel extender.

Several prototypes have been built and tested with positive results. In one example, the funnel is approximately 2.87 inches (72.8 mm) in overall height. The inside diameter of wide opening 111 is 6.67 inches (160.2 mm). The inside diameter of narrow opening 113 is 4 inches (101.6 mm). The ratio of the wide opening to the narrow opening is 1.58. In this example, a six-inch pipe was appended to narrow opening 113 as shown in FIG. 4D, which can help with the inner water level. In another example, the funnel is approximately 2.87 inches (72.8 mm) in overall height. The inside diameter of wide opening 111 is 6.0 inches (152.4 mm). The inside diameter of narrow opening 113 is 2 inches (50.8 mm). This funnel ratio of the wide opening to the narrow opening is 3. In this example a four-inch pipe was appended to narrow opening 113 is a four-inch pipe as shown in FIG. 4D, which can help with the inner water level.

As noted previously, the mounting plate 115 can be available in different sizes to accommodate different skimmer baskets 43. As such, the outer diameter of the mounting plate 115 can be selected to correspond with a particular skimmer basket 43. An inner diameter of an opening through the mounting plate 115 can be selected to correspond to the diameter 127 of the extension body 101.

FIG. 4B illustrates an example of the skimmer device 100, wherein the mounting plate 115 is configured to fit within the upper opening 115 of the skimmer basket 43. In the illustrated example, the mounting plate 115 comprises fastening mechanisms 125 that are configured to secure the mounting plate 115 to the skimmer basket 43. In the illustrated example, the fastening mechanisms 125 comprise hooks that are configured to engage with the apertures 55 (or other features) of the skimmer basket 43. The arm length of hook 125 may be longer than as illustrated, in order to reach a suitable connection place within the basket. For example, in some embodiments, the fastening mechanism 125 can extend deeper into the basket 43 (such as at least 1 inch or more into the basket 43). Other mechanisms for securing the mounting plate 115 to the skimmer basket 43 are also possible.

FIG. 4C is a cross-sectional side view of another embodiment of a skimmer device 100. In this embodiment, the mounting plate 115 is configured to be placed on top of the lip 53 of the skimmer basket 43 (rather than inside the opening 51 as in the example of FIG. 4B). In some embodiments, such an embodiment may be advantageous, as it may not require as precise a fit between the mounting plate 115 and the skimmer basket 43. However, the mounting plate 115 can still be available in different sizes to accommodate different skimmer baskets 43.

FIG. 4C also illustrates an alternative embodiment for the fastening mechanism 125. In this embodiment, the fastening mechanisms 125 comprise compliant arms that are configured to latch over and around the rim 53 of skimmer basket 43. Other types of fastening mechanisms 125 are also possible. For example, the mounting plate 115 may fit snugly within the skimmer basket 43, which may eliminate any need for fastening mechanisms 125. In such cases, for example, a small amount of silicone (or other water proof adhesive or fastening substance) may be used to adhere the mounting plate 115 within the skimmer basket 43. Another example would be to use a silicone band or stainless steel spring that hooks to the holes on the bottom of the basket.

In some embodiments, it can be desirable that, when attached, the mounting plate 115, is parallel to the surface of the water. Therefore, in some embodiments, shims can be inserted between the mounting plate 115 and the skimmer basket 43 to level the mounting plate 115. Other methods and mechanisms for leveling the mounting plate 115 are also possible.

FIG. 4D illustrates another embodiment of the skimmer device 100, in which a pipe 191 has been appended to the narrow opening 113 of the funnel 107. The pipe 191 can extend down from the funnel 107 towards the point of suction within the pool skimmer 31. Inclusion of the pipe 191 can facilitate suction through the funnel 107, effectively lowering the water level within the funnel 107. It should be noted that this effect can also occur without the pipe 191. The pipe 191 can comprise a length 193 as shown. In some embodiments, the length 193 can be about 2 inches, about 3 inches, about 4 inches, about 5 inches, about 6 inches, about 7 inches, or about 8 inches, as well as lengths in between, above, and below any of the listed values.

As noted above, different embodiments may include funnels 107 with different profiles. The profile of the funnel 107 can contribute to the flow of water through the funnel 107, and different profiles can produce different effects. For example, certain profiles may induce a smooth or laminar flow, while other profiles may induce a more turbulent flow. Certain profiles may even produce a vortex that swirls the water as it flows through the funnel 107. In some embodiments of the skimmer device 100, the funnel 107 may be removable and replaceable with a funnel 107 having a different profile to produce a different effect. Funnels shaped like an actual vortex (e.g., described by the formula $y=-1/x$) may be advantageous because this shape may not require any rotational movement of the water to produce a vortex. However, if the pump is not powerful enough to create the proper flow to achieve a vortex through the funnel 107, then a turbulent or swirling flow through the funnel may also be desirable. In some embodiments, a goal of the funnel 107 is to get the floating debris on the surface to enter the basket. Therefore, different funnel profiles may be needed for different situations.

FIG. 5A is a graph illustrating a $-1/x$ curve, which may be used to define the profile or shape of the funnel 107 of the skimmer device 100 according to some embodiments. The $-1/x$ curve may approximate or closely resemble the funnel shape used in spillways, and, also resemble an actual vortex shape. The funnel 107 can comprise a profile that matches or approximates the shape of the graph from the point $x=8$ to point $x=16$. The shape from point $x=12$ to point $x=15$ may also be a beneficial shape, with a cylindrical funnel extension pipe 191 attached to narrow opening 113, as shown in FIG. 4D A funnel 107 having a profile that approximates the shape of the $-1/x$ curve may be advantageous in that the transition from the wide opening 111 of the funnel 107 to the narrow opening 113 of the funnel 117 is very smooth and gradual. In such an embodiment, as water flows over the edge of the funnel 107, the funnel 107 initially includes a shallow slope that increases into a much steeper slope in a smooth fashion. Flow through this type of funnel 107 may be smooth and turbulence may be limited. Water not only has high surface tension, but it is also cohesive. The cohesive property of the water causes it to adhere to the path created by the profile of the funnel 107. If the profile is gradual to steep, then the water will be encouraged to follow the profile into the extension pipe 191 (see FIG. 4D). This is the same effect that a swirling vortex created by rotational flow of water, except the narrow opening 113 can be much wider than a natural vortex lower opening.

FIG. 5B illustrates another profile or shape for the funnel 107 of the skimmer device 100 according to some embodiments. In this example, the profile includes an upper portion 133, a middle portion 135, and a lower portion 137. The upper portion 133 includes an initially steep slope from the wide opening 111. The slope becomes less steep in the middle portion 135, and then steep again in the lower portion 137. This profile may be considered more of a traditional funnel. This profile may cause the water to crash into and through the narrow opening 113. The effect can be very similar to a toilet flush, where the turbulence allows for debris to fall into the narrow opening 113.

The two profiles illustrated in FIGS. 5A and 5B are only examples, and other profiles are possible. For example, the funnel 107 may comprise a profile that is somewhere between the two illustrated profiles, or an entirely different funnel altogether. In some embodiments, the profile of the funnel 107 can be optimized to increase the efficiency of the skimmer device 100.

FIG. 6A is a cross-sectional view of an embodiment of the pool skimmer 31 with an embodiment of the skimmer device 100 installed and illustrates example flow therethrough when the pump 21 of a pool system 10 is active. As shown, the skimmer device 100 can be attached to the skimmer basket 43, and the skimmer basket 43 can be inserted into the pool skimmer 31. The height of the extension body 101 can be adjusted (manually or automatically) such that the wide opening 111 of the funnel 107 is at a depth 139 below the surface 5 of the water.

When the water pump 21 is engaged, water can be pulled through the suction line 25 at the bottom of the pool skimmer 31. When the skimmer device 100 is installed, this causes water to fall/flow through the funnel 107 of the skimmer device 100 and into the skimmer basket 43. As the water falls/flows through the funnel 107, the surface tension of the water pulls the surface of the water into and through the funnel 107. Debris that is on the surface 5 of the water is pulled along with the water and through the funnel 107 into the skimmer basket 43. In FIG. 6A, arrows 141 illustrate example flow of water and debris along the surface 5 of the water and into the skimmer basket 43. In some instances, the water and debris can be accelerated as it falls/flows through the funnel 107. This acceleration may help to drive debris down into the skimmer basket 43. Smaller debris may flow through the skimmer basket 43 and into the suction line 25.

Figure 6B:
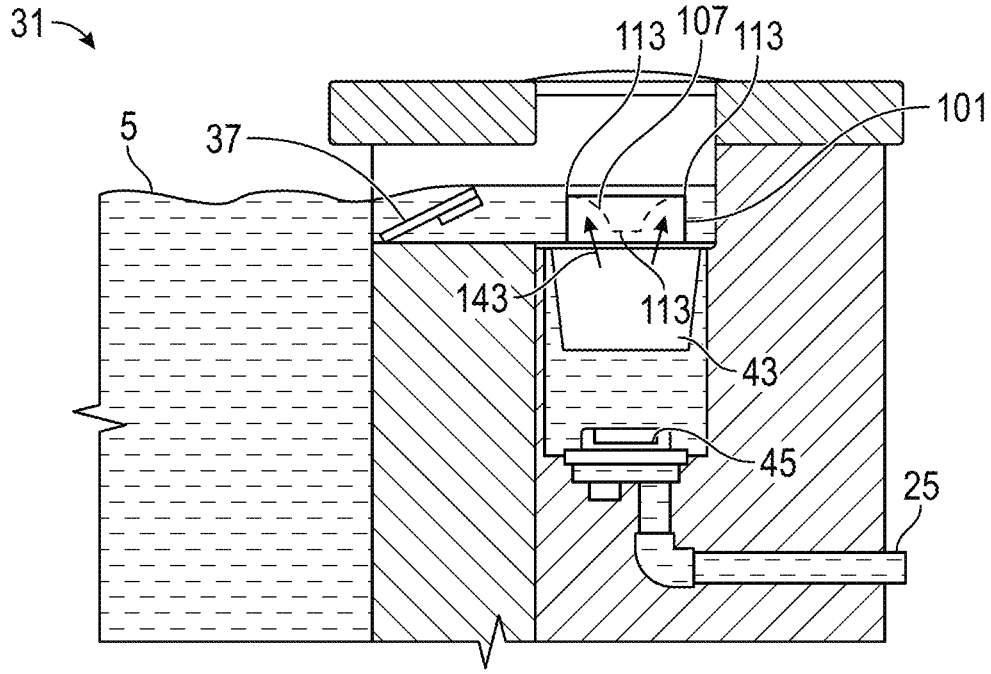
FIG. 6B is a cross-sectional view of an embodiment of a pool skimmer with a skimmer device installed and illustrates example capture of debris below a funnel of the skimmer device.

In the event that debris within the skimmer basket 43 begins to float, it is unlikely that the debris will float back up through the narrow opening 113 of the funnel 107. This can be because the narrow opening 113 is sufficiently small and because water continues to flow through the narrow opening 113 while the water pump 21 is engaged. Rather, any floating debris will float upwards and be trapped below the funnel 107 as shown in FIG. 6B. This causes trapped debris to remain within the skimmer device 100, which improves its ability to clean the surface of the pool.

FIG. 6A also illustrates the distance or depth 139 at which the funnel 107 is positioned below the surface 5 of the water. In some embodiments, it can be preferable to position the funnel 107 at a depth that is just below the surface 5 of the water. For example, the funnel 107 can be positioned at a depth 139 that is about 0.125 inches, about 0.25 inches, about 0.5 inches, about 0.75 inches, about 1.0 inches, about 1.25 inches, about 1.5 inches, about 1.75 inches, or about 2.0 inches below the surface 5 of the water. Positioning the funnel 107 just below the surface of the water can facilitate flow through the funnel 107 and maximize the ability of the skimmer device use the surface tension of the water to pull debris towards and through the funnel 106.

FIG. 6B is a cross-sectional view of an embodiment of a pool skimmer 31 with the skimmer device 100 installed and illustrates example capture of debris below a funnel 107 of the skimmer device 100. Arrows 113 illustrate that debris that floats up from the skimmer basket 43 can be caught below the funnel 107. Further, even when the water pump 21 is deactivated and water does not flow through the funnel 107, the narrow opening 113 can be sufficiently small that trapped debris is unlikely to float therethrough and thus will likely remain within the skimmer basket 43.

FIG. 7A illustrates an embodiment of the skimmer device 100 that includes floats 145 that automatically adjust the depth of the skimmer device 100 as a water level in a pool changes. The skimmer device 100 is illustrated in a cross-sectional view of an embodiment of the pool skimmer 31. In the illustrated example of FIG. 7A, the water level is high.

As shown in FIG. 7A, floats 145 can be attached to the skimmer device 100 so that the depth at which the funnel 107 is positioned below the surface 5 of the water is maintained even as the water level changes. Example floats 145 are shown and described in more detail with reference to FIGS. 10A-10D. At this juncture, it suffices that the floats 145 are sufficiently buoyant such that they are always positioned at or on the surface 5 of the water and that the floats 145 are positioned above the funnel 145 at a distance that corresponds with the desired depth 139. Thus, since the floats 145 are positioned are always on the surface of the water, the top of the funnel 107 can be maintained at the desired depth 139 for maximum efficiency.

The extension body 101 can be configured such that it adjusts up and down automatically as the floats 145 are raised or lowered with the water level. For example, as shown in FIG. 7A, the surface 5 of the water is at a high level. The floats 145 remain on the surface 5 and pull the extension body 101 upward such that the funnel remains positioned at the desired depth 139 below the surface 5 of the water.

FIG. 7B illustrates the skimmer device 100 with floats 145 of FIG. 7A in a cross-sectional view of the pool skimmer 31 in an example where the water level is lower than in FIG. 7A. As illustrated, although the surface 5 of the water has fallen, the floats 145 remain on the surface 5 and the funnel 107 remains positioned at the desired depth 139 below the surface of the water. As shown in dashed lines in FIG. 7B, the extension body 101 has fallen down inside the skimmer basket 43 in this example.

Figure 7C:
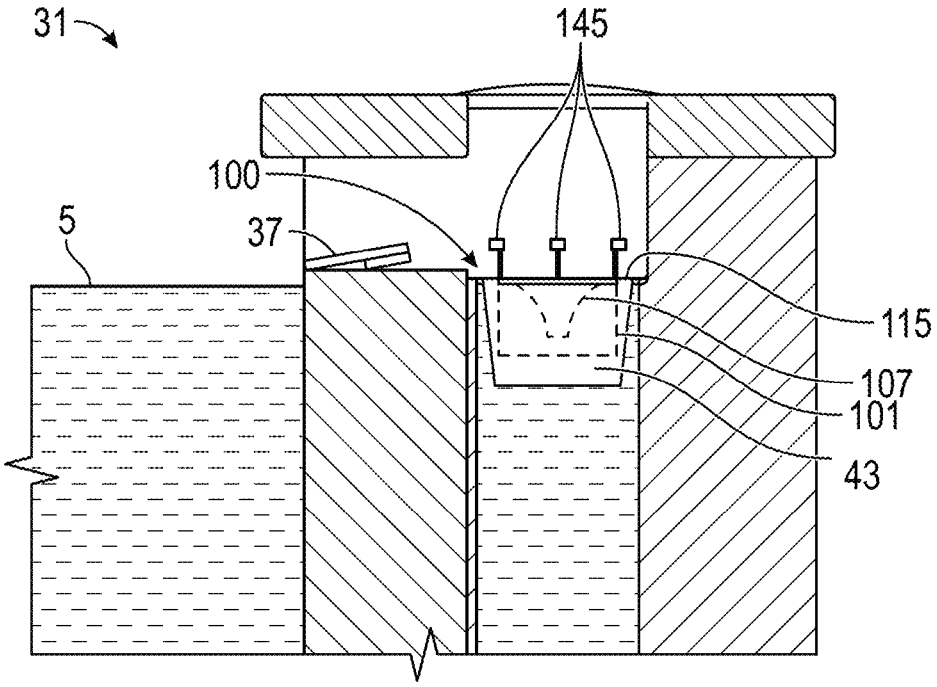
FIG. 7C illustrates the skimmer device with floats of FIG. 7A in a cross-sectional view of the pool skimmer in an example where the water level is lower than the entry opening of the pool skimmer.

FIG. 7C illustrates the skimmer device 100 with floats 145 of FIG. 7A in a cross-sectional view of the pool skimmer 31 in an example where the water level is lower than the entry aperture 35 of the pool skimmer 31. In this example, the water level has fallen so low that the extension body 101 has fallen to its lowest position inside the skimmer basket 43. Because the water level 5 is too low, the floats 145 are now positioned above the surface 5 of the water. This can be an advantageous configuration for the skimmer device 100 because when the water level falls this low the extension body 101 and funnel 107 fall all the way down into the skimmer basket 43 such that the skimmer device 100 is not at fault for causing the water pump 101 to run dry.

Figure 7D:
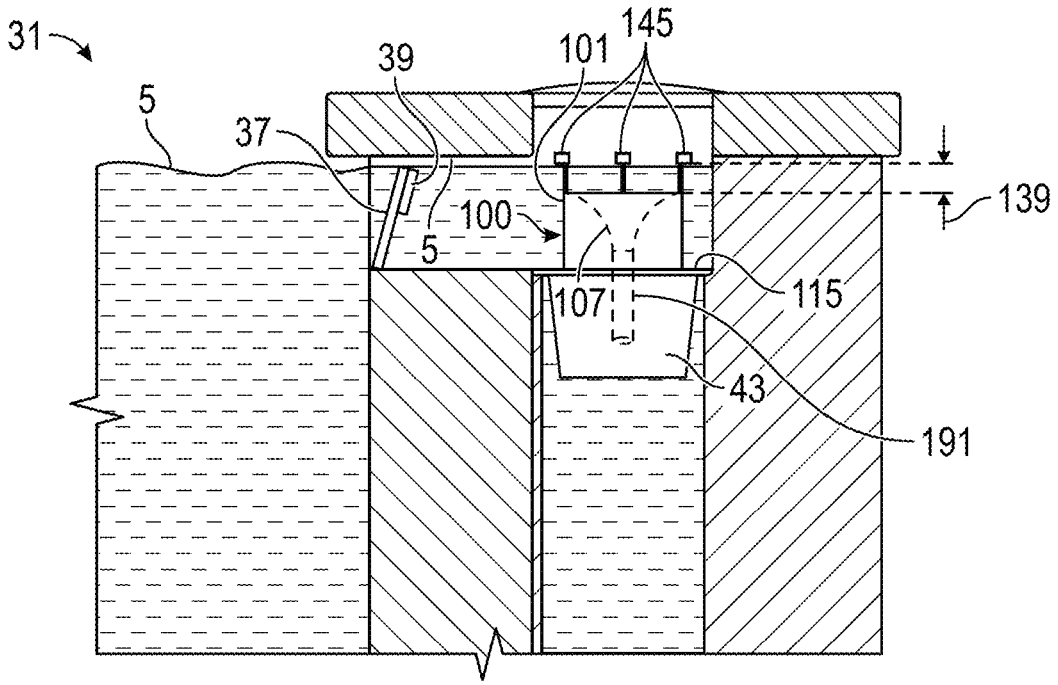
FIG. 7D illustrates an example of the skimmer device with floats and a funnel extender.

FIG. 7D illustrates an example of the skimmer device 100 in which the pipe 191 has been appended to the bottom of the funnel 107. The skimmer device 100 includes floats 145 that can be used to maintain the funnel at the proper depth 149. In some embodiments, the pip 191 can limit the lowest level of the funnel 107 by contact with the basket 43.

Figure 8:
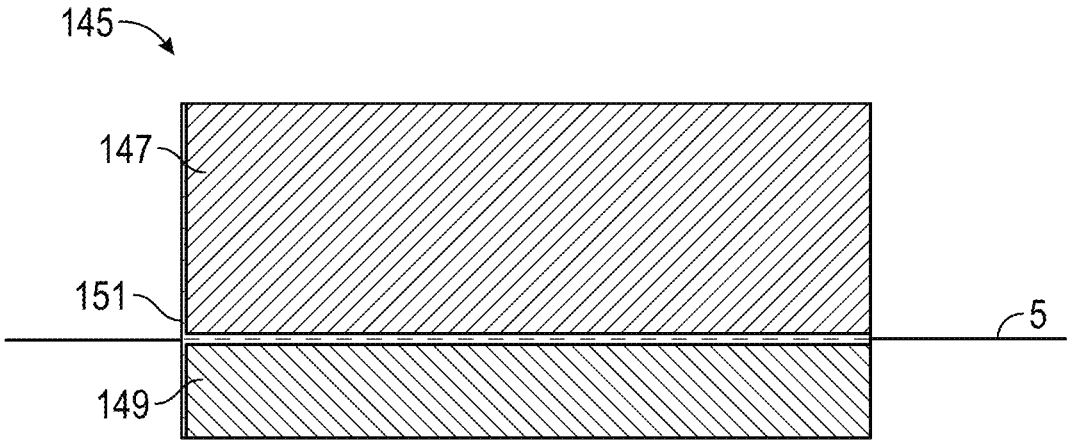
FIG. 8 illustrates an embodiment of a float for a skimmer device.

FIG. 8 illustrates an embodiment of a float 145 for the skimmer device 100. In the illustrated embodiment, the float 145 can comprise a container 151. The float 145 can also comprise a buoyant portion 147 and a weighted portion 149. The theory is that when the weighted portion 149 is under water, it is easier to float due to buoyancy. However, when it reaches the surface of the water, the weighted portion 149 loses buoyancy and is reluctant to rise above the surface 5. In some instances, it is possible to more precisely determine the depth at which the float 145 floats, by adding enough weight to keep the funnel under water, and enough buoyancy to keep the weights at the surface 5 of the water. In some embodiments, weight can be added to the container 151 to adjust the size and weight of the weighted portion 149 to adjust the depth of the funnel.

Figure 9A:
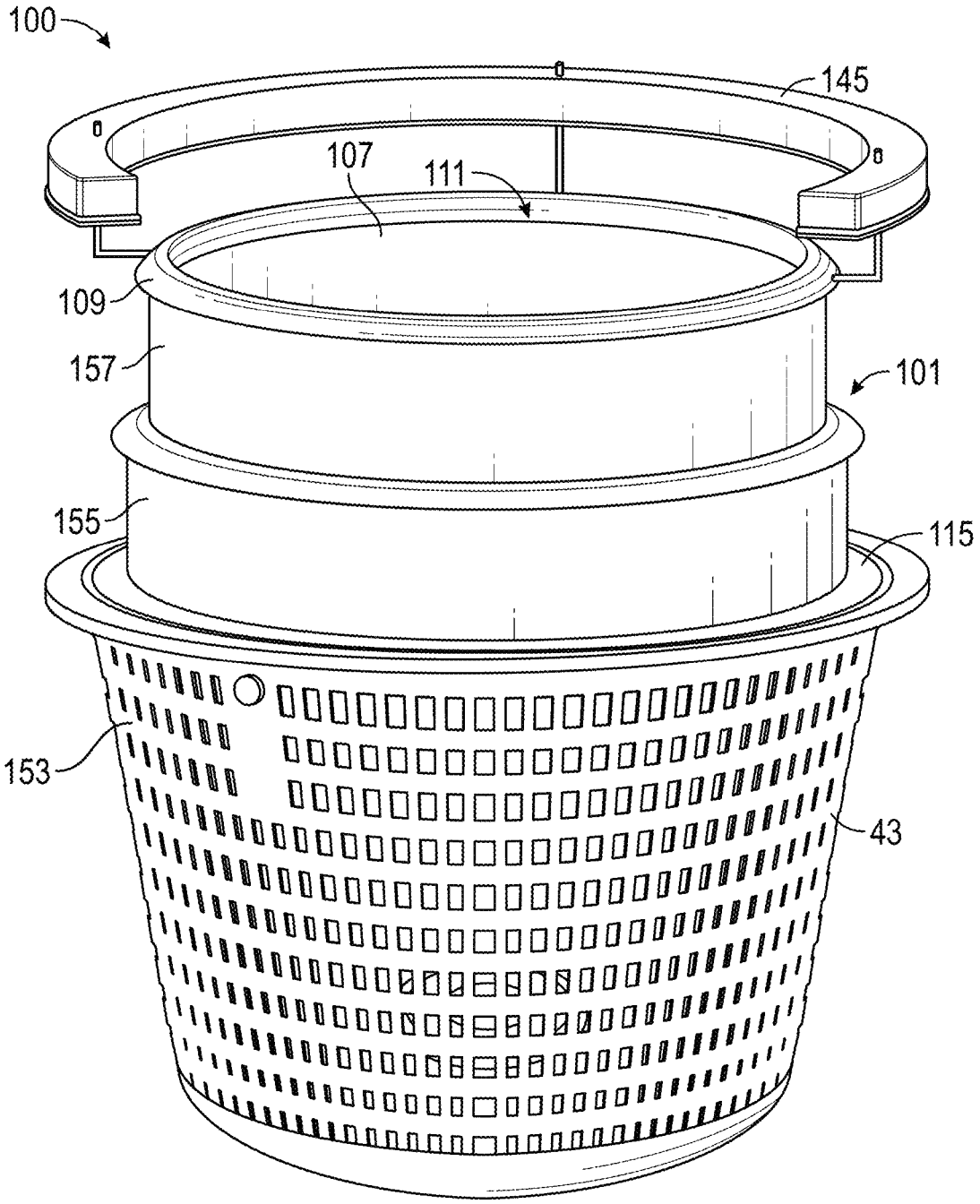
FIG. 9A is a perspective view of an embodiment of a skimmer device including a telescoping tubular body and a float that is configured to automatically adjust a height thereof as a water level in a pool changes.

FIG. 9A is a perspective view of an embodiment of the skimmer device 100 that includes a telescoping extension body 101 and a float 145 that is configured to automatically adjust a depth thereof as the water level in the pool changes. FIG. 9A illustrates the skimmer device 100 in an extended configuration. In this example, the extension body 101 comprises three telescoping body sections 153, 155, 157. Each telescoping body section 153, 155, 157 can comprise a cylindrical section configured to telescope with the adjacent body sections 153, 155, 157 above and below it. The lowest body section 153 can be configured to attach to a mounting plate 115 that attaches to the skimmer basket 43 as described above.

A telescoping extension body 101 may be advantageous because it can allow the wide opening 111 of funnel 107 to be wider. As mentioned above, skimmer baskets 43 that include highly tapered sides may interfere with a rigid extension body 101 as shown in FIGS. 4A-4C because, as the extension body is lowered within the skimmer basket 43, it may interfere with the sides of the skimmer basket 43. The telescoping extension body 101 may eliminate or reduce this problem because as the telescoping extension body 101 is lowered, the telescoping body sections 153, 155, 157 stack inside of each other rather than extending down into the skimmer basket 43.

Figure 10A:
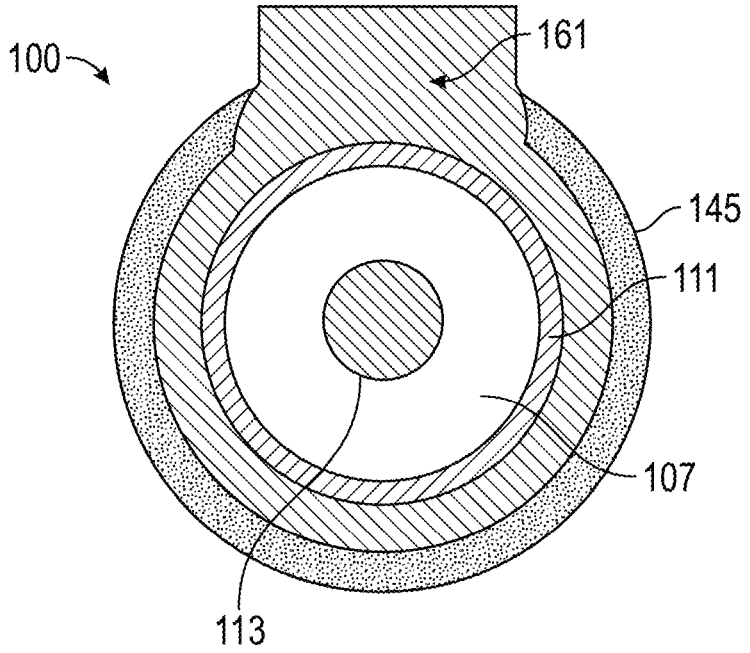
FIG. 10A is a top view of an embodiment of a skimmer device including a U-shaped float.

The skimmer device 100 of FIG. 9A also includes a U-shaped float 145. The U-shaped float 145 may be configured to surround the wide opening 111 to the funnel 107 and to include a missing section (i.e., the open portion of the U) that allows water to flow in towards the funnel 107. A U-shaped float is also shown in FIG. 10A, described below.

Figure 9B:
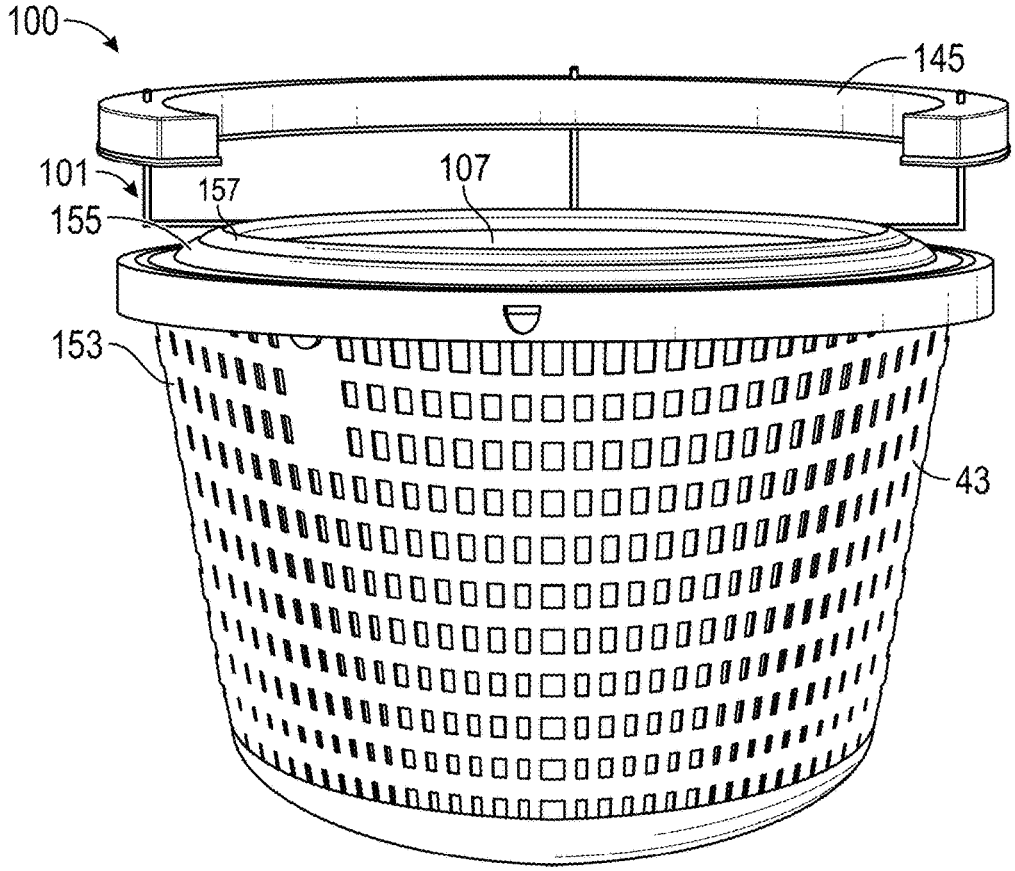
FIG. 9B is a perspective view of the skimmer device of FIG. 9A in a collapsed configuration.

FIG. 9B is a perspective view of the skimmer device 100 of FIG. 9A in a collapsed configuration. As shown, the telescoping body telescoping body sections 153, 155, 157 nest inside of each other such that the wide opening 111 of the funnel 107 is approximately level with the top of the skimmer basket 43.

Figure 9C:
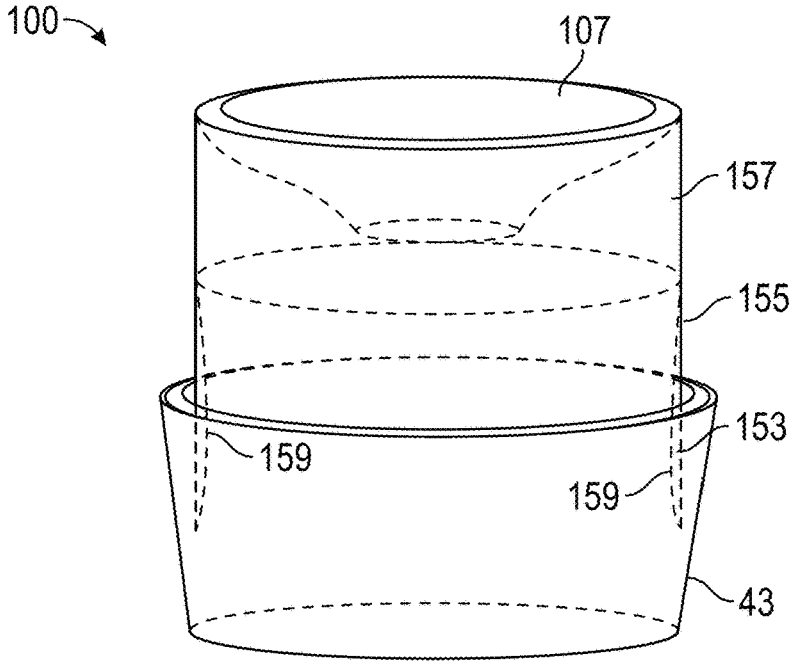
FIG. 9C is a schematic view of the skimmer device of FIG. 9A, illustrating a liner of the telescoping tubular body.

FIG. 9C is a schematic view of the skimmer device 100 of FIG. 9A, illustrating a liner 159 of the telescoping extension body 101. The liner 159 can be provided to improve waterproofing between the different telescoping body sections 153, 155, 157. In some embodiments, the liner 159 comprises a thin layer of flexible waterproof material, such as plastic, that is attached to the top telescoping body section 153 and the bottom telescoping body section 157 as shown. Silicone O-rings may also be used to inhibit water flow through the section joints. In FIG. 9C, the floats 145 are not shown, but they may be included so that the height of the telescoping extension body 101 is automatically adjustable with changes in the water level.

FIGS. 9A-9C illustrate a telescoping extension body 101 with three telescoping body sections 153, 155, 157. Other numbers of telescoping body sections can be included in other embodiments, including two, three, four, five, or more telescoping body sections.

FIG. 10A is a top view of an embodiment of the skimmer device 100 including a U-shaped float 145. In this embodiment, the U-shaped float 145 includes an opening 161 that allows water to flow there through and into the funnel 107. In the illustrated embodiment, the U-shaped float 145 surrounds the wide opening 111 of the funnel 107. The narrow opening 113 of the funnel 107 is also shown. This configuration places the weight around the perimeter of the wide opening 111 of the funnel 107. There can be a gap between the U-shaped float 145 and the wide opening 111 of the funnel 107 that allows water to flow around the funnel opening, and then down into the funnel 107.

Figure 10B:
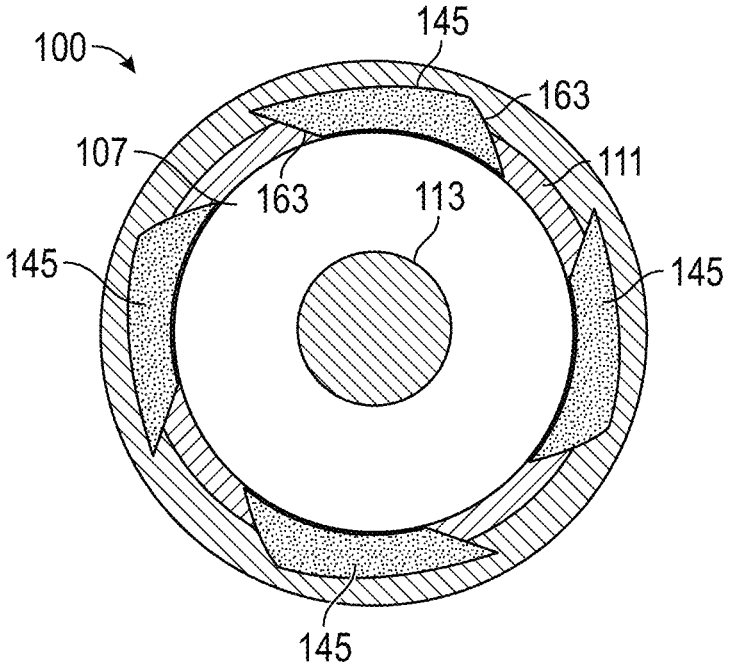
FIG. 10B is a top view of an embodiment of a skimmer device including four floats configured to induce a vortex flow.

FIG. 10B is a top view of an embodiment of the skimmer device 100 including four floats 145 configured to induce a vortex flow. In the illustrated embodiment, the funnel 107, wide opening 111 and narrow opening 113 are shown. Four floats 145 are positioned around the funnel 107 (e.g., at ninety-degree increments). Water can flow between the floats 145 to enter the funnel 107. Faces 163 of the floats 145 can be angled to induce a vortex flow. In some embodiments, the floats 145 are also designed to include vortexes within the skimmer device 100 with a clockwise in the Northern Hemisphere and counter-clock wise in the Southern Hemisphere.

Figure 10C:
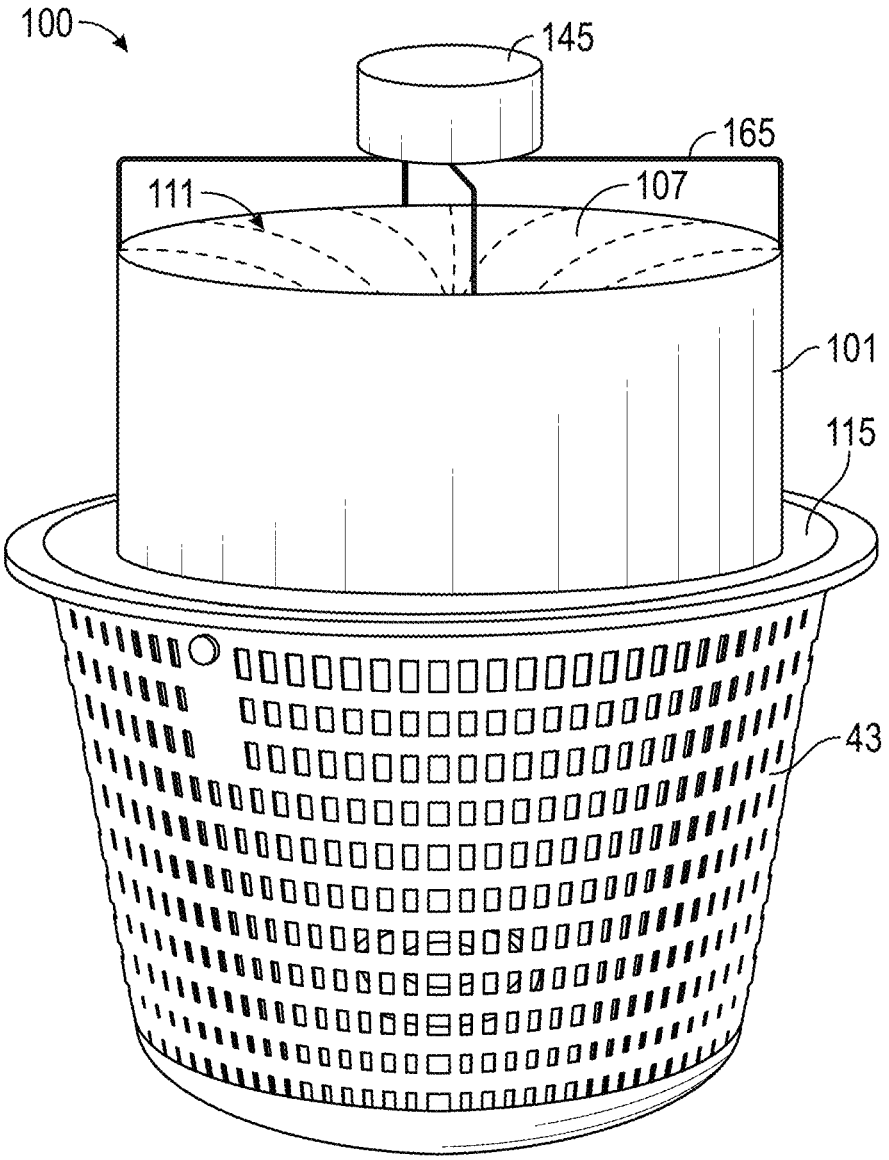
FIG. 10C is a perspective view of an embodiment of a skimmer device including a center float.

FIG. 10C is a perspective view of an embodiment of the skimmer device 100 including a center float 145. In this embodiment, the float 145 is positioned over the funnel 107 and the diameter of the float 145 is smaller than the diameter of the wide opening 111 of the funnel 107. As shown, the float 145 is supported by arms 165, which can be connected to the funnel 107.

Figure 10D:
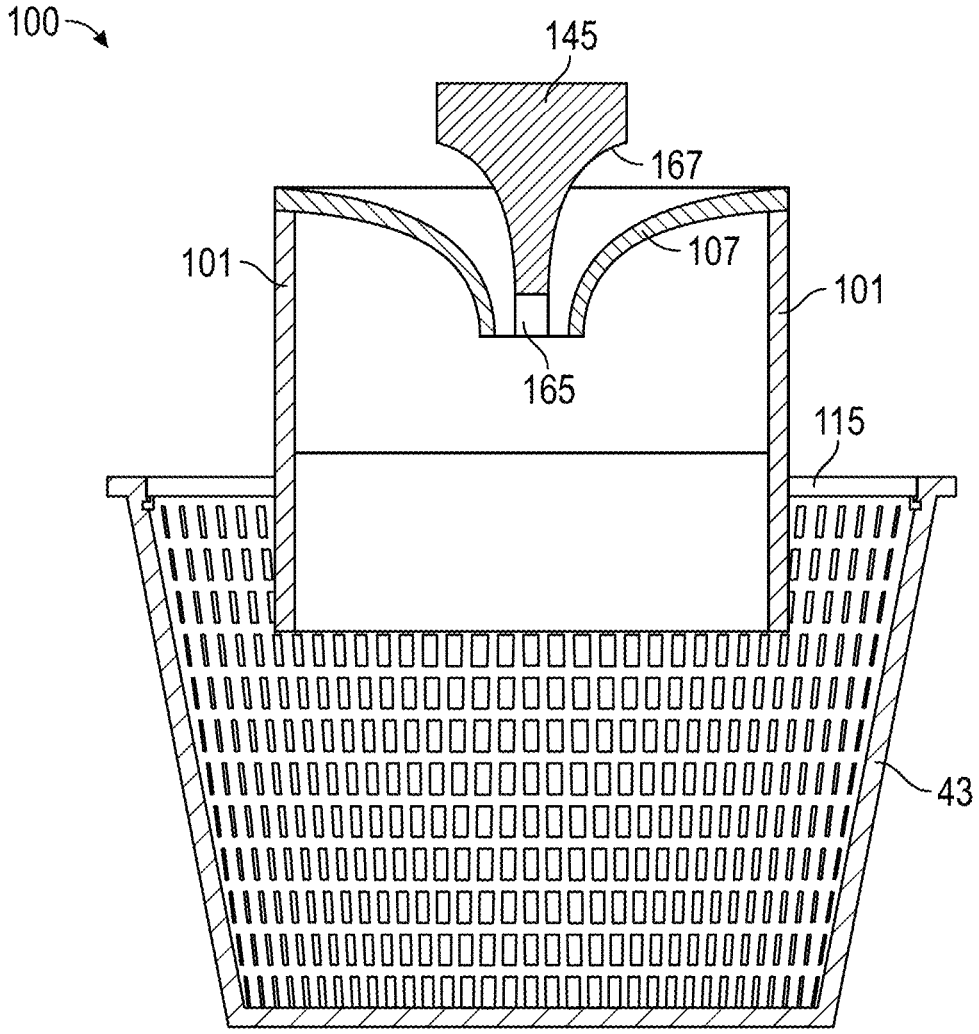
FIG. 10D is a cross-sectional view of an embodiment of a skimmer device including a funnel-shaped float.

FIG. 10D is a cross-sectional view of an embodiment of a skimmer device 100 including a funnel-shaped float 145. The funnel-shaped float 145 can include an inner face 167 that mirrors the profile of the funnel 107 and may provide a channel between the float 145 and the funnel 107 for the water to flow through. In this example, arms 165 supporting the float are connected to the bottom of the funnel 107.

FIGS. 11-14D relate to a skimmer door device 200 for a pool skimmer, such as the pool skimmer 31 described above with reference to FIGS. 1 and 2. In some embodiments, the skimmer door device 200 can be used in conjunction with the skimmer device 100 described above. In some embodiments, the skimmer door device 200 can be used alone (i.e., with a conventional pool skimmer 31). As will be described in more detail below, the skimmer door device 200 is configured to improve the efficiency of the pool skimmer 31.

As noted above, small debris, such as pollen, small insects, seeds, etc., floating on the surface of a swimming pool can be difficult to suck into the pool's filter. Conventional pool skimmers 31 (such as is shown in FIG. 2) are used in an attempt to clean the surface of the pool, but conventional pool skimmers 31 can often be ineffective for several reasons. For one, the suction point of most pool skimmers 31 (e.g., the suction line 25 which is connected to the pool's pump 21) is too far below the water level of the pool to effectively clean the surface of the pool. Often, the opening to the suction line 25 may be as deep as four or five inches (or deeper). Since the suction point of the pool skimmer 31 is so deep, it sucks in water from below the surface. Debris floating on the surface can be unaffected. This effect is commonly seen in a bathtub. As water initially drains from the tub (while the tub is still quite full), the surface of the water is unaffected. As the water level drops, a vortex forms above the drain, which extends to the surface and pulls the surface of the water down into the drain. Such a vortex only forms when the suction point (the drain) is sufficiently close to the surface of the water (e.g., when the water in the tub is sufficiently low).

Because the suction point in conventional pool skimmers 31 is so deep, it is difficult for the suction from the pump 21 to pull surface debris into the pool skimmer 31, down through the skimmer basket 43, and into the filter 23. Further, wind and surface tension can also impede the pool skimmer's ability to pull the surface of the water into the pool skimmer 31. The skimmer door device 200 described below with reference to FIGS. 11-14D can solve or alleviate these problems of conventional pool skimmers 31 by facilitating suction of the surface of the water of the pool into the pool skimmer.

As described above with reference to FIG. 2, most pool skimmers 31 include weir doors 37. These weir doors 37 are generally primarily designed to keep debris that has entered the pool skimmer 31 from escaping the pool skimmer (although such doors can often be ineffective). Weir doors 37 of conventional pool skimmers 31 are generally hinged at the bottom, near aperture 35 of the pool skimmer 31, such that they can pivot down and inward to allow water to enter the pool skimmer 31 (see FIG. 2). This allows water to flow over the weir door 37 and into the pool skimmer 31. The weir door 37 also includes a float 39, such that the top of the weir door 37 is generally at the surface 5 of the water. This conventional design of a weir door 37 does little to draw or induce flow of water into the pool skimmer 31.

The skimmer door device 200 described herein can be installed in place of (or in addition to) a conventional weir door 37 of a pool skimmer 31 so as to draw or induce flow of water into the pool skimmer 31. In particular, the skimmer door device 200 is configured to pull the surface of the water of the pool into the pool skimmer 31, which can facilitate drawing debris floating on the surface of the pool into the pool skimmer 31. This can be achieved, as will be described below, by positioning the skimmer door device 200 at the immediate aperture 35 of the pool skimmer 31 into the pool and positioning a door of skimmer door device 200 such that a top edge of the door is just below the surface of the water.

Figure 11:
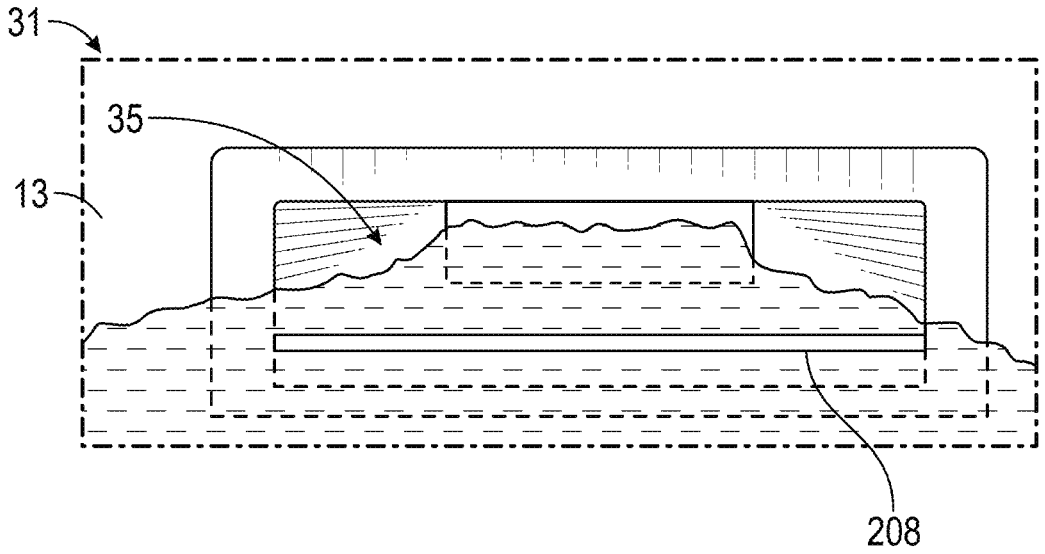
FIG. 11 is a perspective view of an embodiment of an aperture of a pool skimmer and illustrates placement of a door of a skimmer door device.

FIG. 11 is a perspective view of an embodiment of an aperture 35 of a pool skimmer 31 and illustrates placement of a door 204 of a skimmer door device 200. As shown, the door 204 is placed at the aperture 35 at the immediate juncture between the pool skimmer 31 and the pool. This placement can give the skimmer door device 200 the most access to surface water. In contrast, consider the weir door 37 shown in FIG. 2. Because the weir door 37 opens inward, the top edge of the weir door 37 is set back from the aperture 35 of the pool skimmer 31. For the skimmer door device 200 described herein, the door 204 can be maintained at the immediate aperture 35 of the pool skimmer 31 because the door 204 can be a vertical door. That is the door 204 can be oriented vertically and need not pivot inward to open as will be described more fully below.

Further, as shown in FIG. 11, the door 204 can be positioned such that the top edge of the door 204 is just below (e.g., about 0.125 inches, about 0.25 inches, about 0.5 inches, about 0.75 inches, about 1.0 inches, about 1.25 inches, about 1.5 inches, about 1.75 inches, or about 2.0 inches below the surface of the water). Since the top of the door 204 is just below the surface of the water and its placement is very close to where the pool water enters the pool skimmer 31, the skimmer door device 200 can induce a great pull on the surface of the water. This pull causes the velocity of the surface water to speed up and flow over the door 204, allowing the pool skimmer 31 to filter much greater amounts of surface water when compared with a conventional pool skimmer alone (including weir door 37).

Figure 12A:
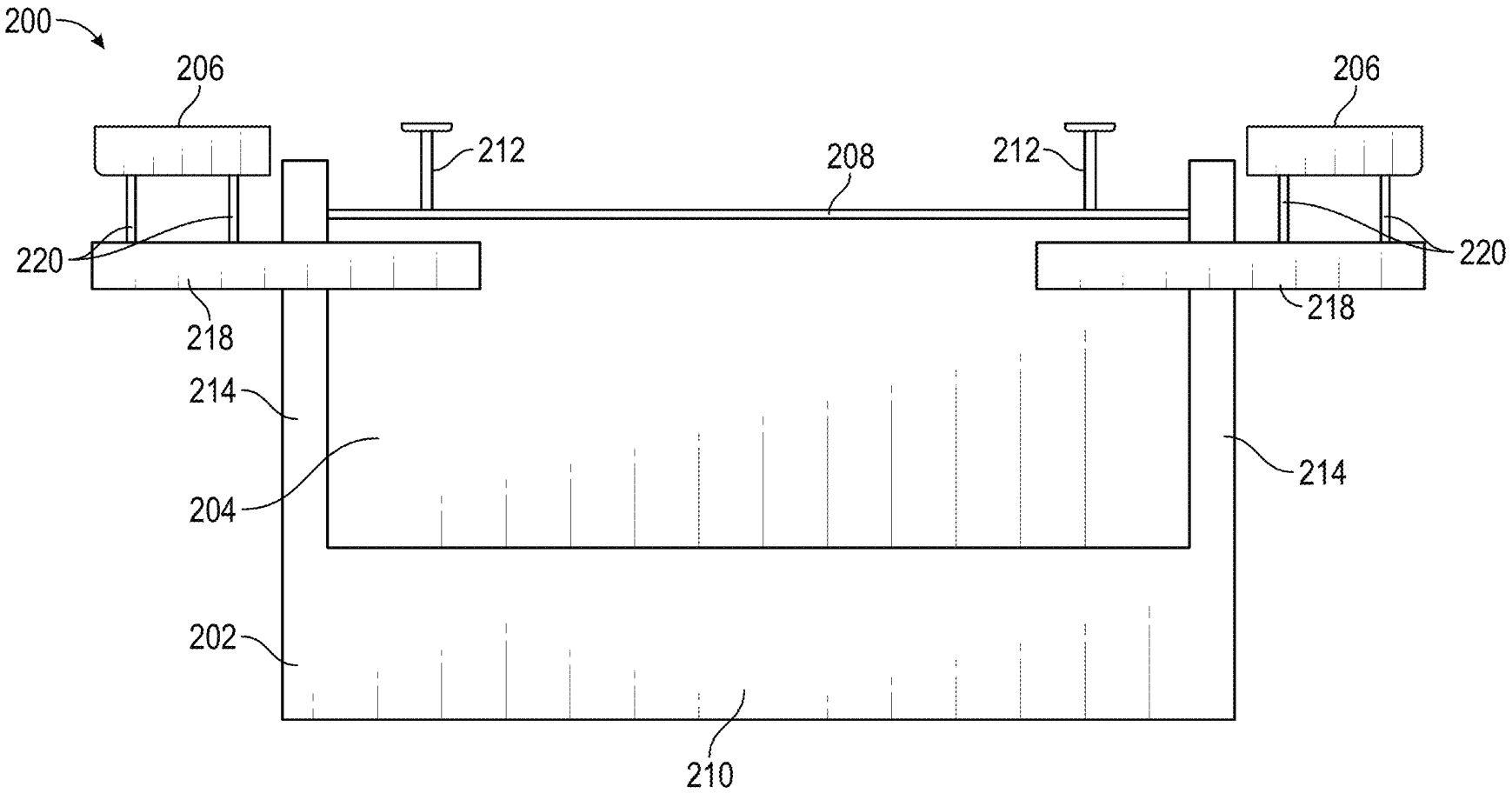
FIG. 12A illustrates a front view of an embodiment a skimmer door device.
Figure 12B:
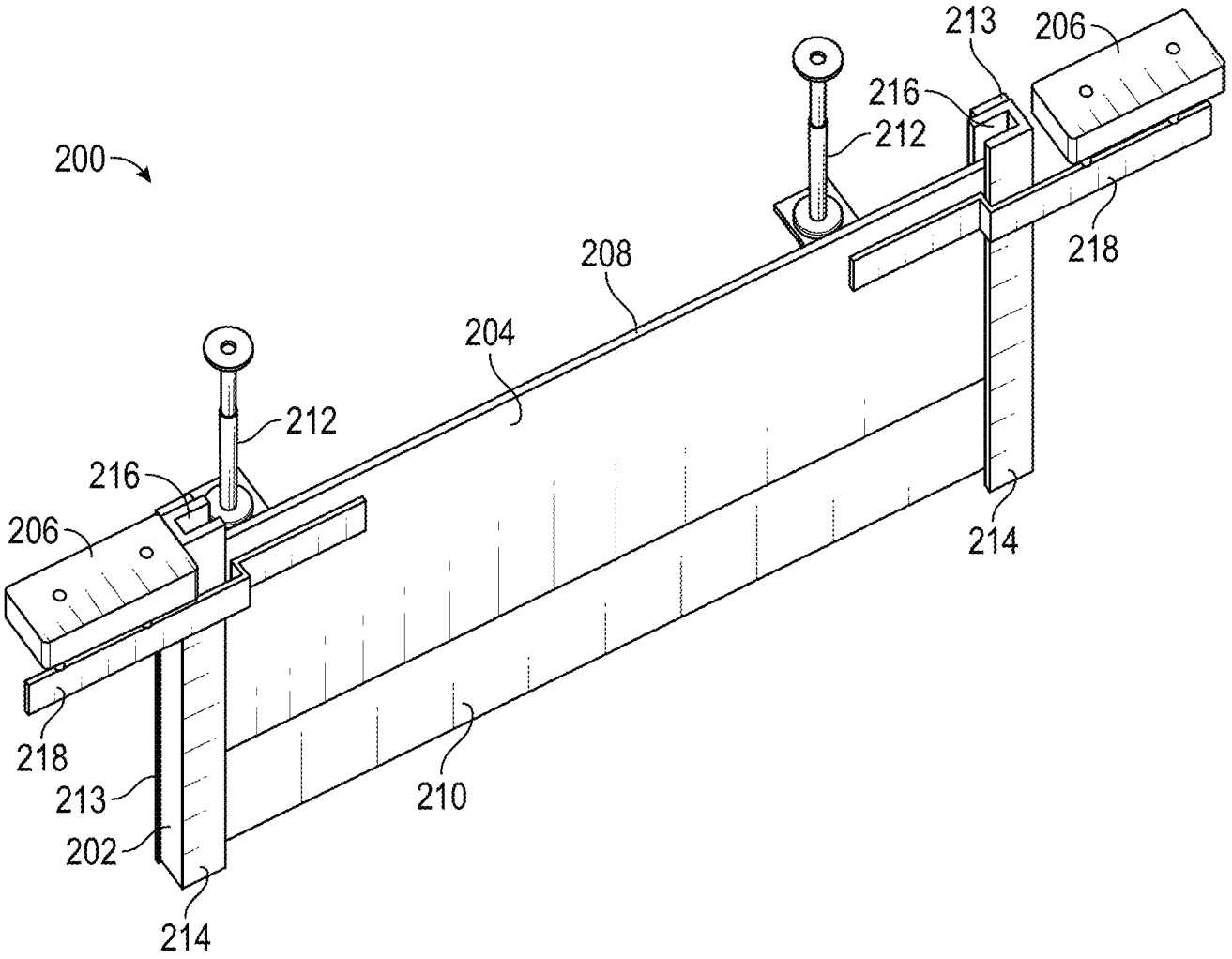
FIG. 12B illustrates a perspective view of the skimmer door device of FIG. 12A.
Figure 12C:
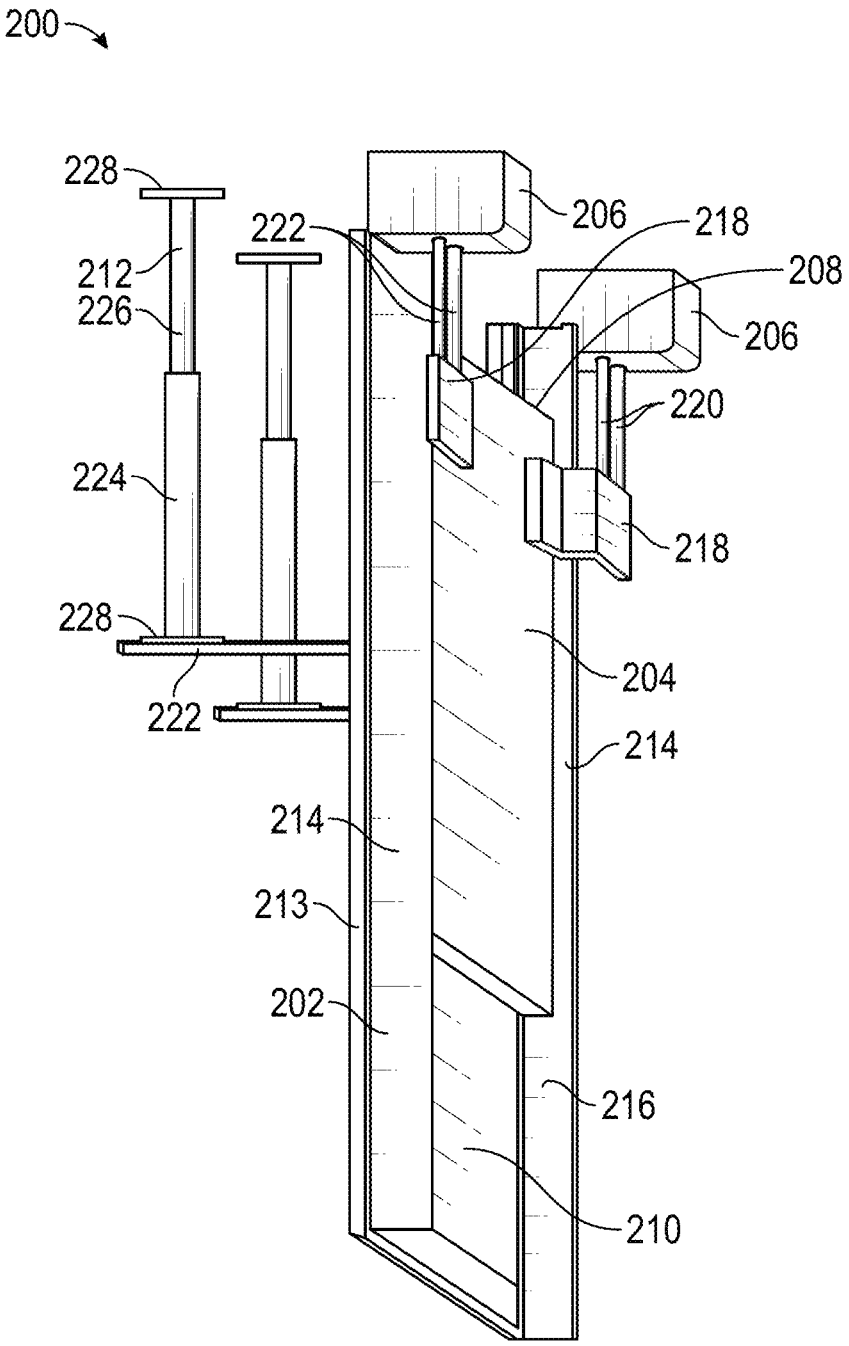
FIG. 12C illustrates a side perspective view of the skimmer door device of FIG. 12A.

An embodiment of the skimmer door device 200 is shown in FIGS. 12A-12C. FIG. 12A illustrates a front view, FIG. 12B illustrates a perspective view, and FIG. 12C illustrates a side perspective view of the skimmer door device 200. In the illustrated embodiment, the skimmer door device 200 includes a frame 202 configured to hold a door 204. The door 204 can move vertically (up and down) relative to the frame 202. When installed (FIG. 13) the skimmer door device 200 is positioned in front of (e.g., at or immediately in front of) the aperture 35 of a pool skimmer 31 such that the door 204 is positioned over the aperture 35.

As illustrated, the skimmer door device 200 includes floats 206 that are attached to the door 204. The floats 206 are configured such that their buoyancy causes them to remain on the surface of the water. The door 204 is attached to the floats 206, such that the door 204 moves up and down with the floats 206 as the water level in the pool changes. Additionally, the floats 206 are positioned relative to the door 204 such that a top edge of the door 204 is positioned just below the surface of the water. This will be described in greater detail below.

The frame 202 can be configured to mount to the aperture 35 of the pool skimmer 31 and position the vertical door 204 relative to the pool skimmer 31. In the illustrated embodiment, the frame 202 includes a rear plate 210. When installed the rear plate 210 can be positioned against the sidewall 13 of the pool. The rear plate 210 may include an opening at its upper end so that the rear plate does not obstruct the aperture 35 of the pool skimmer 31. As best seen in FIGS. 12B and 12C, a gasket 213 (or other sealing material) may be included on the rear surface of the rear plate 210 of the frame 202. The gasket 213 may be configured to form a seal between the frame 202 and the sidewall 13 of the pool. In some embodiments, the water pressure in the pool may press the rear plate 210 and gasket 213 against the sidewall 13 of the pool to create the seal. The seal may be watertight, although this need not be the case in all embodiments.

The frame 202 may also include mounting supports 212 as shown. The mounting supports 212 can be configured to mount or otherwise secure the frame 202 relative to the aperture 35 of the pool skimmer 31. In the illustrated embodiment, two mounting supports 212 are shown. Other numbers of mounting supports 212 can be included in other embodiments. As best seen in FIG. 12C, in the illustrated embodiment, the mounting supports 212 comprise a bracket 222 that projects laterally (e.g., horizontally) from the rear surface of the rear plate 210. The bracket 222 can be positioned such that it extends into the aperture 35 of the pool skimmer 31 (see FIG. 13, which shows the skimmer door device 200 in an installed position).

In the illustrated embodiment, each of the mounting supports 212 further includes a first portion 224 that extends upward from the bracket 222. A second portion 226 is adjustably attached to the first portion 224, such that the overall height of the mounting support 212 can be adjusted. For example, the second portion 226 can screw into the first portion 224 such that the height of the mounting support 212 can be adjusted by varying how far into or out of the first portion 224 the second portion 226 is screwed. As the height of the mounting support 212 is adjusted, feet 228 on opposite ends of the mounting support are pressed into the pool skimmer 31 to secure the frame 202 thereto. As will be described below with reference to FIG. 13, this can provide a mechanism for securing the frame 202 to the pool skimmer 31. Other mechanisms for securing the frame 202 to the pool skimmer 31 are also possible.

As shown in FIGS. 12A-12C, the frame 202 further includes lateral tracks 214 positioned at each of its lateral sides. The lateral tracks 214 may extend vetically (up and down) when the skimmer door device 200 is installed. The lateral tracks 214 are configured to receive the door 204 and permit the dor 204 to move up and down through the tracks. As shown in FIG. 12B, the lateral tracks 214 can include grooves 216 configured to receive lateral edges of the door 204. In some embodiments, the trackes 214 and/or lateral edges of the door 204 can include wheels or bearings that facilitate movement of the door 204 relative to the frame 202.

In some embodiments, the frame 202 is configured such that a width between the lateral tracks 214 is adjustable. For example, the width of the frame 202 can be adjusted to receive doors 204 of different widths. This can allow the skimmer door device 200 to be used with pool skimmers 31 that have apertures 35 of different widths. This only applies to door 208, as that door fits inside of the skimmer 31. In some embodiments, the frame 202 that covers the skimmer aperture may not be extendable. For very large apertures, there can be a longer model available or the frame 202 may be able to be elongated, but without elongating the door 204 itself. By the way, there will also have to be adapters to allow door 200 or door 204 to fit curved walls.

As shown in FIGS. 12A-12C, the floats 206 are attached to the door 204. In the illustrated embodiment, brackets 218 are attached to the front face of the door 204 and project laterally outward beyond the tracks 214. The floats 206 are then attached to the bracket 218 by risers 220. The rises extend upward (e.g., vertically) from the flanges 218 such that the floats 206 cam be positioned above the top edge 208 of the door 204. The length of the risers 220 can be configured such that, when the floats 206 are posotioned on the surface of the water, the top edge 208 of the door 204 is positioned just below (e.g., about 0.125 inches, about 0.25 inches, about 0.5 inches, about 0.75 inches, about 1.0 inches, about 1.25 inches, about 1.5 inches, about 1.75 inches, or about 2.0 inches below the surface of the water) the surface of the water.

In some embodiments, the rises 220 comprise adjustable risers. This can permit the distance between the the floats 206 and the top edge 208 of the door 204 to be adjusted so as to optimize flow of water over the top edge of the door 204 and into the pool skimmer 31.

As shown in FIG. 12A, in the illustrated embodiment, the brackets 218 extend laterally away from the door 204 such that the floats 206 are positioned laterally beyond the lateral edges of the door 204. This can position the floats 206 laterally beyond the aperture 35 of the pool skimmer 31. This can be advantageous as the floats 206 will not restrict flow of water into the pool skimmer 31. This position of the floats 206, however, need not be required, and in some embodiments, the floats 206 can be positioned directly above the door 204.

The floats 206 can be any buoyant material that is sufficiently buoyant to lift the door up and down as the water level in the pool changes. In some embodiments, the floats 206 can be configured similar to the floats 145 of FIG. 8 (described above).

The skimmer door device 200 shown in FIGS. 12A-12C allows for the door 204 to slide up and down within the frame 202. The frame 202 can be placed in front of a aperture 35 of the pool skimmer 31 so that when the door 204 is completely up the aperture 35 is almost completely blocked, saved for a small space above the top edge 208 of the door 204. Water can flow through this space over the top edge 208 of the door 204 and into the pool skimmer 31.

The skimmer door device 200 can be automatically adjustable so that it continues to function as desired as the water level in the pool changes. The floats 206 remain at the surface of the water, no matter what the water level is. The door 204 positioned just below the floats 206 such that the desired depth for the door 204 is maintained. Further, because the risers 220 are adjustable, the depth of the door 204 can be set as desired. This can keep the door 204 at a constant depth below the surface of the water, which can cause surface water to rapidly enter the aperture 35 of the pool skimmer 31.

Figure 13:
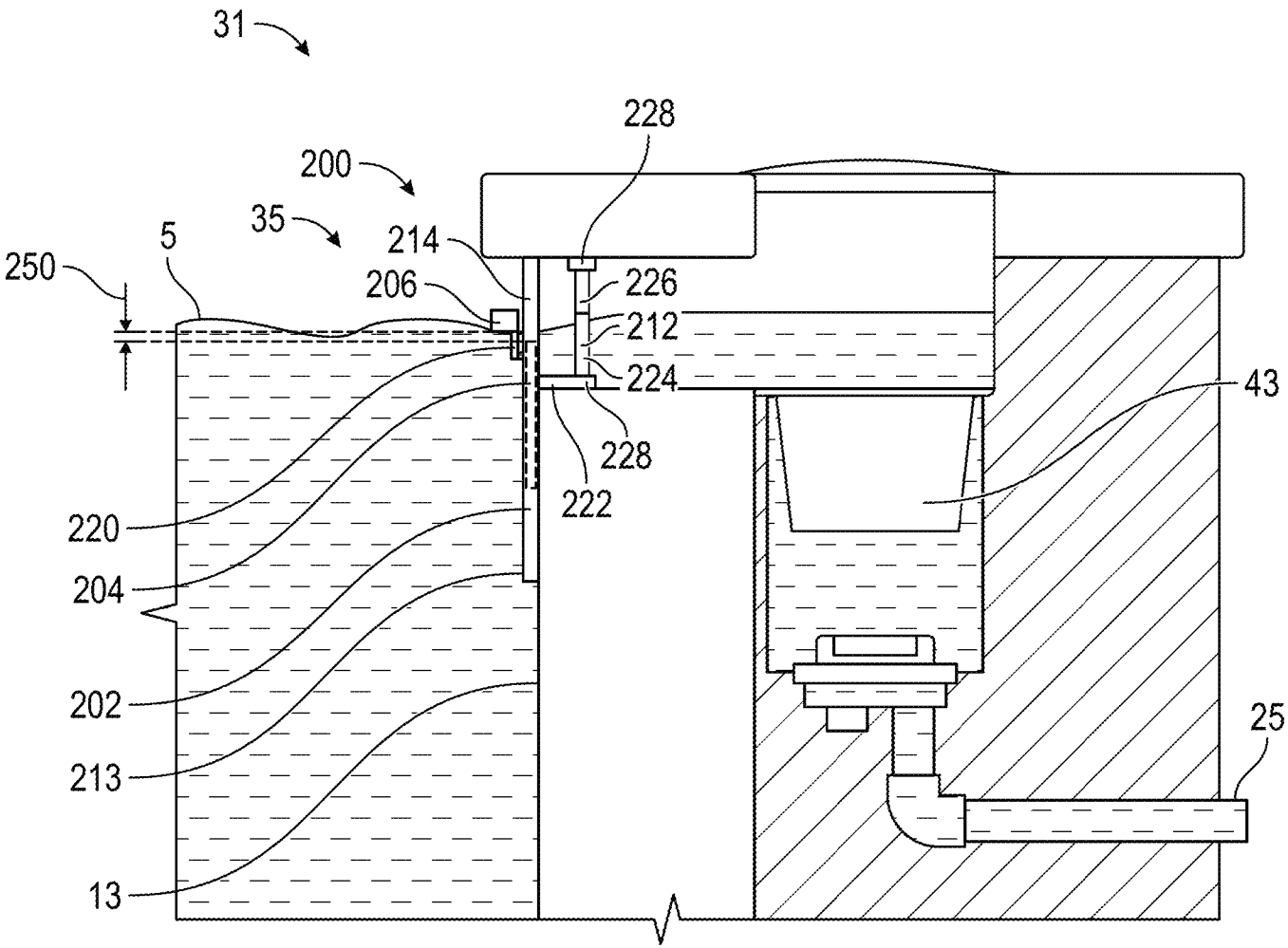
FIG. 13 is a cross-sectional view of an embodiment of a pool skimmer with the skimmer door device of FIG. 12A installed at the aperture thereof.

FIG. 13 is a cross-sectional view of an embodiment of the pool skimmer 31 with the skimmer door device 200 installed at the aperture 35 thereof. In this figure, a desired installation position of the skimmer door device 200 is shown. As illustrated, the skimmer door device 200 is installed at the immediate aperture 35 of the pool skimmer 31. The frame 202 is positioned against the sidewall 13 of the pool such that the door 204 is positioned over the aperture 35. The gasket 213 can be compressed between the frame 202 and the sidewall 213 to form a seal.

The frame 202 is secured in place by the mounting supports 212. The mounting supports 212 are positioned within the aperture 35. As illustrated, bracket 228 extends laterally into the aperture 35. The mounting supports 212 are then pressed against top and bottom surfaces of the pool skimmer 35 to hold the frame 202 in place. The height of the mounting supports 212 can be increased or decreased by adjusting the second portion 226 relative to the first portion 224 to secure the feet 228 of the mounting supports 212 in place.

In FIG. 13, the door 204 is illustrated in dashed lines because it is positioned within the frame 202. As shown, the door 204 is attached to the floats 206 by the risers 220. The length of the rises 220 (which as noted above can be adjustable) positions the door relative to the floats 206. The floats 206 are on the surface 5 of the water. Thus, the top edge 208 of the door 204 is positioned below the surface 5 of the water by a distance or depth 250. The depth 250 can be, for example, about 0.125 inches, about 0.25 inches, about 0.5 inches, about 0.75 inches, about 1.0 inches, about 1.25 inches, about 1.5 inches, about 1.75 inches, or about 2.0 inches, as well as other depth above, below or in between any of the listed values.

As shown, the door 204 thus blocks most of the aperture 35 leaving only a small space above the door 204 for water to flow through. This can cause water to accelerate over the door 204 and into the pool skimmer 31. In particular, this can draw the surface of the water over the door 204 and into the pool skimmer 31.

Figure 14A:
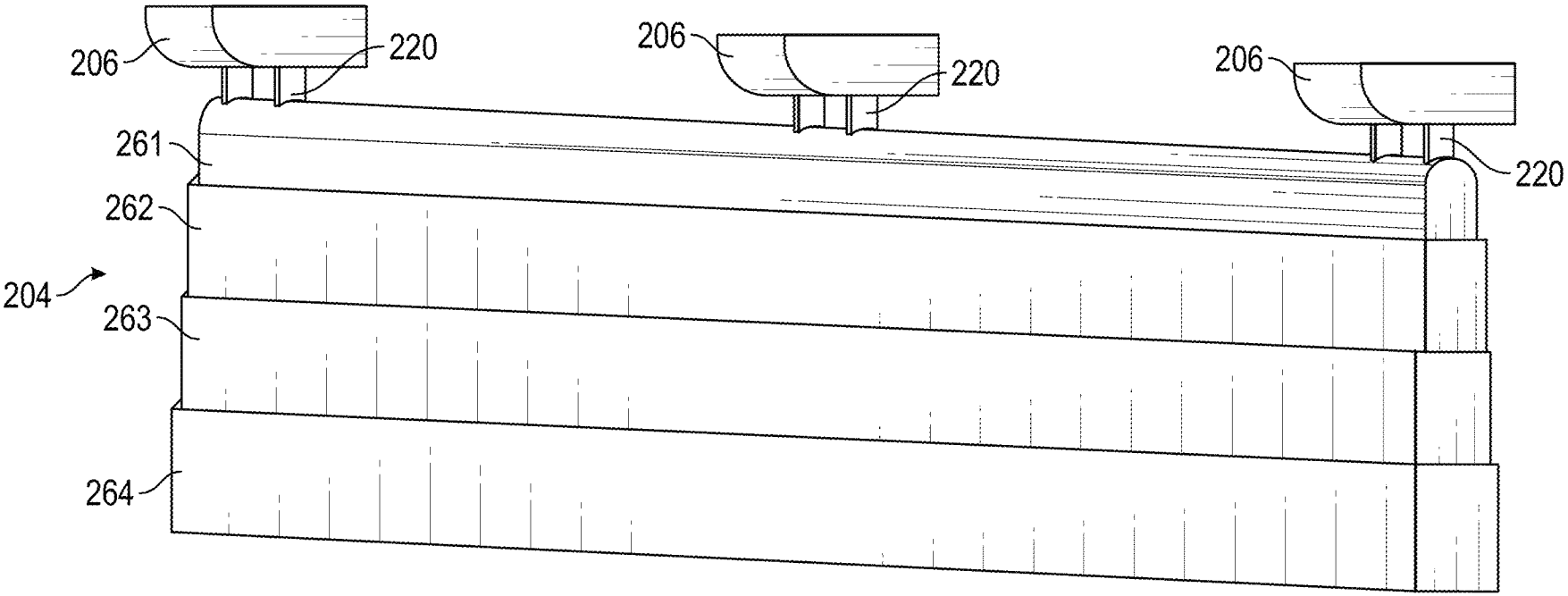
FIG. 14A is a perspective view of another embodiment a skimmer door device that includes a telescoping door.
Figure 14B:
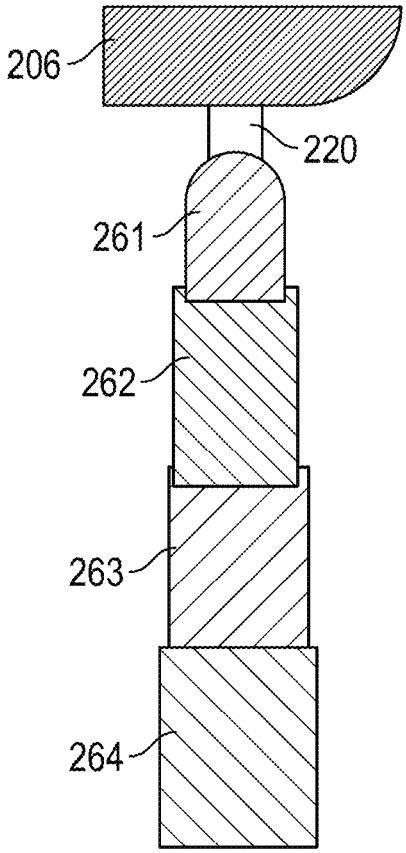
FIG. 14B is a cross-sectional view of the skimmer door device of FIG. 14A in the raised position.
Figure 14C:
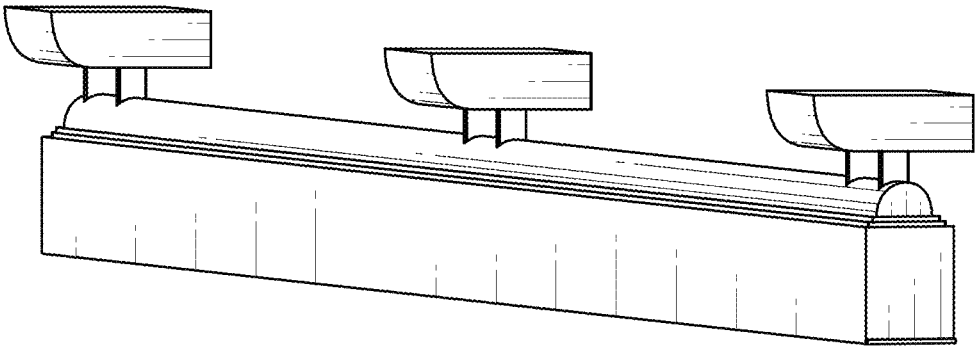
FIG. 14C is a perspective view of the skimmer door device of FIG. 14A with the telescoping door in a lowered position.
Figure 14D:
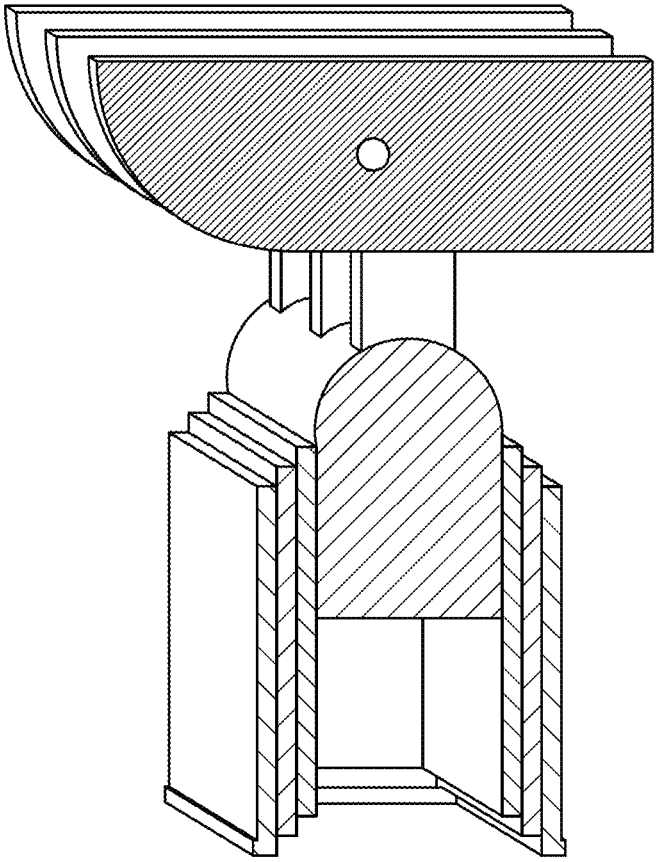
FIG. 14D is a cross-sectional view of the skimmer door device of FIG. 14A with the telescoping door in the lowered positioned.

FIGS. 14A-14D illustrate another embodiment of a skimmer door device 200. In this embodiment, the skimmer door device 200 comprises a telescoping door 204. FIG. 14A is a perspective view that illustrates the telescoping door 204 in a raised position, FIG. 14B is a cross-sectional view of the telescoping door 204 in the raised position, FIG. 14C is a perspective view of the telescoping door 204 in a lowered position, and FIG. 14D is a cross-sectional view of the telescoping door 204 in the lowered positioned.

As shown in FIGS. 14A-14D, the telescoping door 204 of the skimmer door device 200 comprises a plurality of telescoping segments 261, 262, 263, 264. In the illustrated embodiment, four telescoping segments 261, 262, 263, 264 are shown, but other numbers of segments can be used in other embodiments. The top most segment 261 can be attached to floats 206 as shown. The floats 206 float on the surface of the water as described above. Risers 220 (which can be adjustable) can be used to control the depth of the door 204 below the surface of the water as previously described. As shown in FIGS. 14A and 14B, as the water level rises, the telescoping segments extend telescoping segments 261, 262, 263, 264 increasing the total height of the door 204. As shown in FIGS. 14C and 14D, as the water level drops, the telescoping segments 261, 262, 263, 264 collapse into each other, decreasing the overall height of the door 204. However, regardless of the water level, the top edge of the door 204 remains positioned just below the surface of the door 204 inducing flow into the pool skimmer as described above.

Figure 14E:
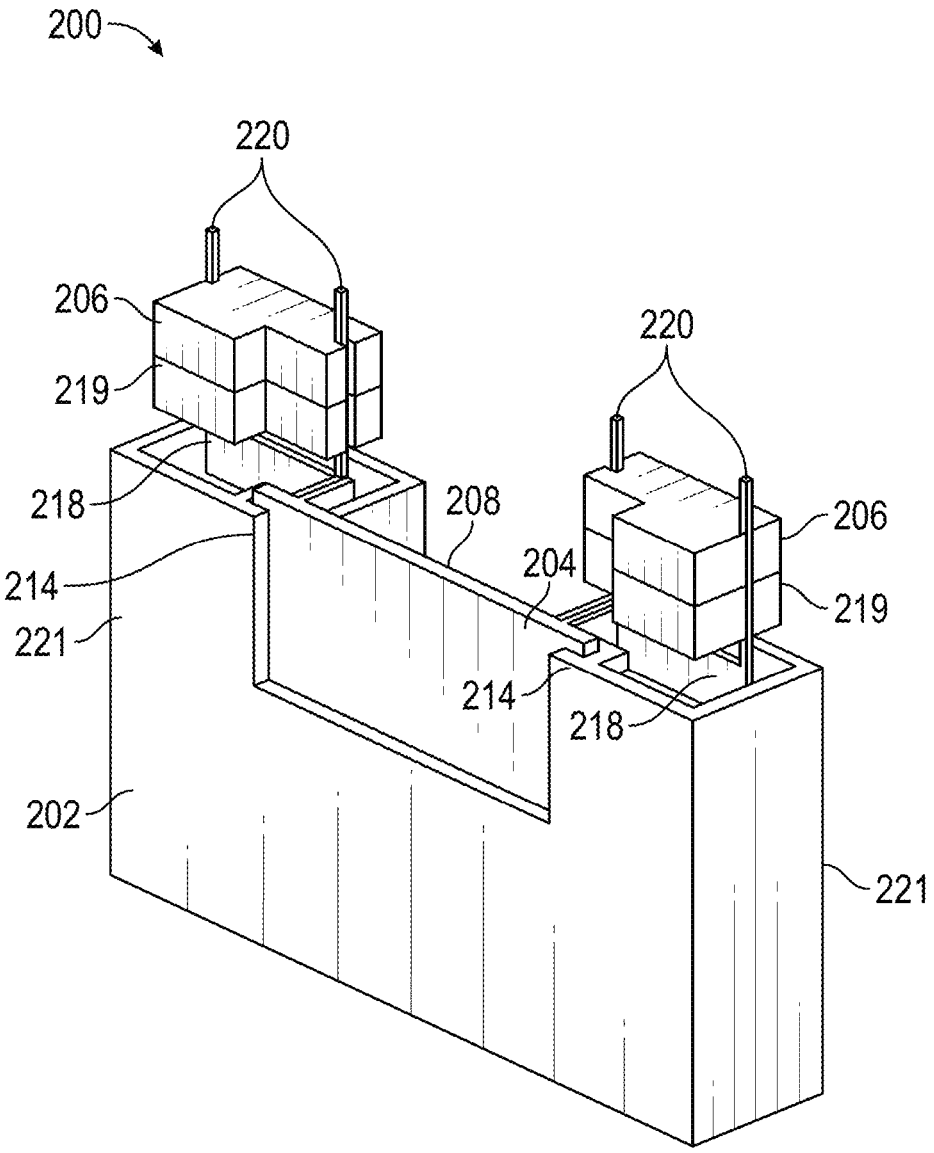
FIGS. 14E, 14F, and 14G illustrate view of another embodiment of a skimmer door device.
Figure 14F:
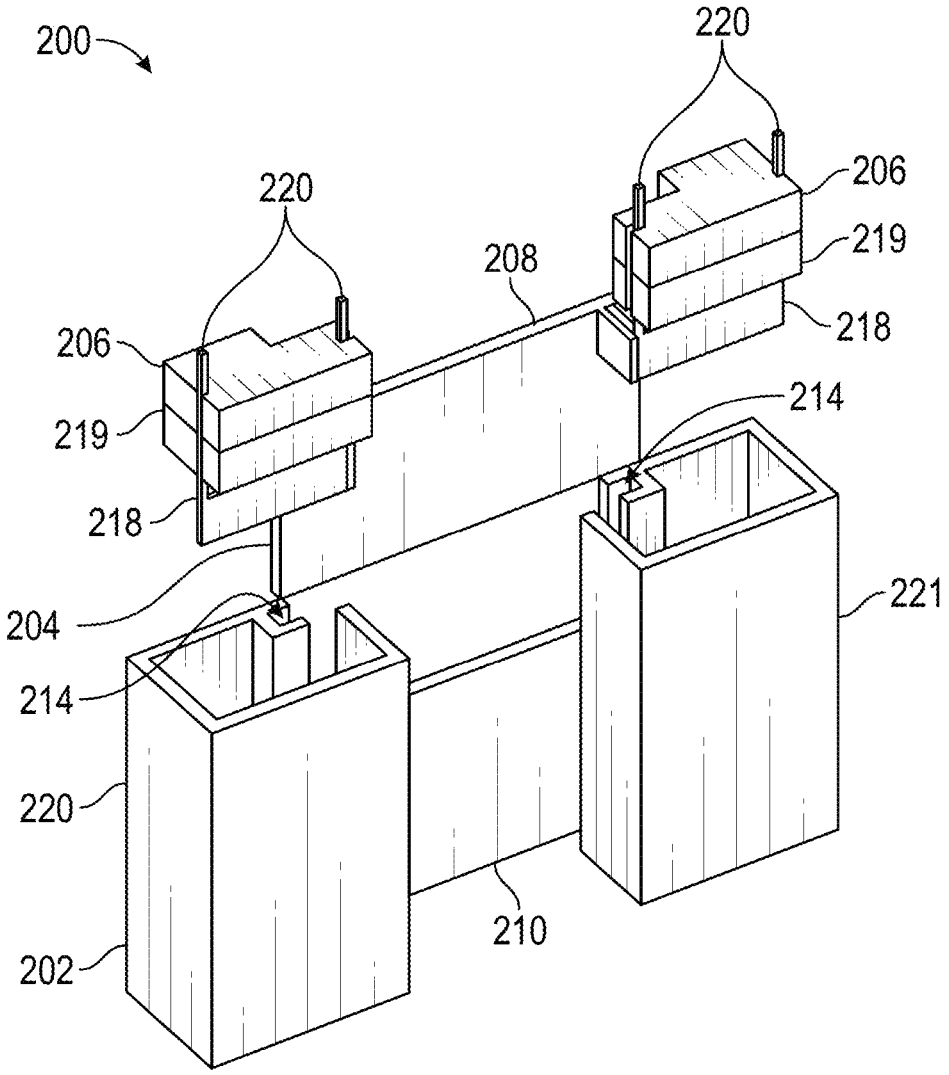
Figure 14G:
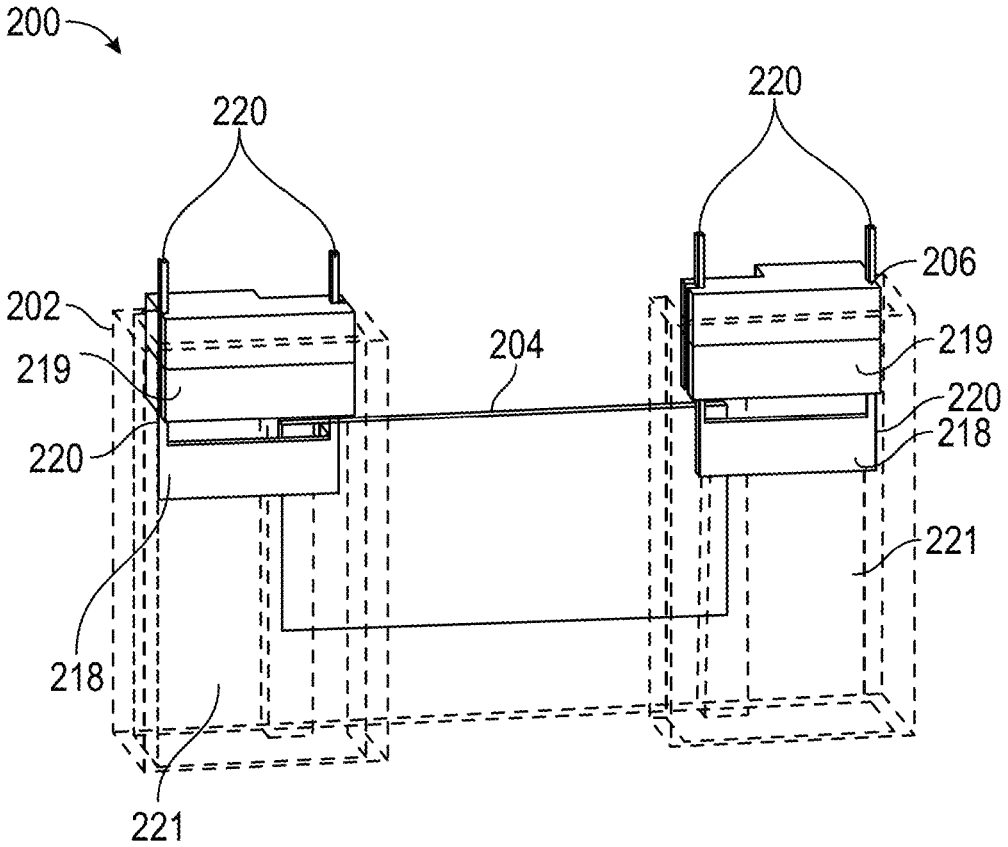

FIGS. 14E-14G illustrate another embodiment of an alternative design for a vertical skimmer door 200. In FIGS. 14E-14G, the door 204 has been greatly shortened in the drawings, to allow the study of the newly designed features. The door 204 can be made from any material, such as, but not limited to, nylon, glass, acrylic, or carbon fiber. As illustrated in FIG. 14E (skimmer side view), the skimmer door device 200 includes a float 206 and a weight 219. The weight 219 is designed to make the door 204 heavy enough to sink with the surface water 5 of the swimming pool. The float 206 is designed to be buoyant enough to float the door 204 and the weight 219 when the surface water 5 in the pool rises.

A float cover 221 is configured to protect the float 206 and weight 219 assembly. In the illustrated embodiment, the float cover 221 is only as high as the maximum door 204 height. However, in other embodiments, they can be raised so that the float 206/weight 219 assembly is always covered by the float cover 221.

FIG. 14F shows the vertical door skimmer device 200 with the door 204 completely raised out of frame 202, which allows for the channels 214 and float covers 220 to be better observed. In FIG. 14G (a pool side view) the frame 202 has been rendered transparent and the door 204 assembly has been lowered into the now transparent frame 202. This allows the observation of the float 206/weight 219 assembly within the float cover 221. Additional features shown in FIGS. 14F-14G can be similar to similarly numbered features that have been previously described.

As discussed in previous sections, swimming pool skimmers 31, such has the one represented in FIG. 2, can be inefficient, requiring a lot of power before they become efficient at removing small floating debris from the surface water of a swimming pool. Pipe size and pipe length of suction lines 25 and return lines 27, in addition to the elevation relative to the water 5 level in the pool of filter 23 and water pump 21 are large factors in the requirement of the power needed to efficiently filter water through a pool skimmer 31. To exacerbate this problem, many pools are improperly installed with suction lines 25 and return lines 27 that are too small in diameter. In addition, these pipes usually travel relatively large distances to get to the pool filter 23 and water pump 21. All of this can decrease the efficiency of the circulation and filtration system of the pool. Therefore, a powered pool skimmer 300 that has the water pump and filter that is in close proximity and lower in elevation than the surface water 5 of a pool would require much less power and would be greatly more efficient. Such devices are described with reference to FIGS. 15A-22E.

FIGS. 15A-20 illustrate a first embodiment of a powered pool skimmer 300. FIGS. 15A and 15B are side and perspective views of the powered pool skimmer 300 (also referred to as powered pool skimmer device 300). The powered pool skimmer 300 shown in FIGS. 15A and 15B provides one such example configuration that places the pool filter 304 inches away from the suction line 25. In this case suction line 25 is an opening with a funnel assembly 313 shown in more detail in FIG. 16A and FIG. 16B.

Figure 15B:
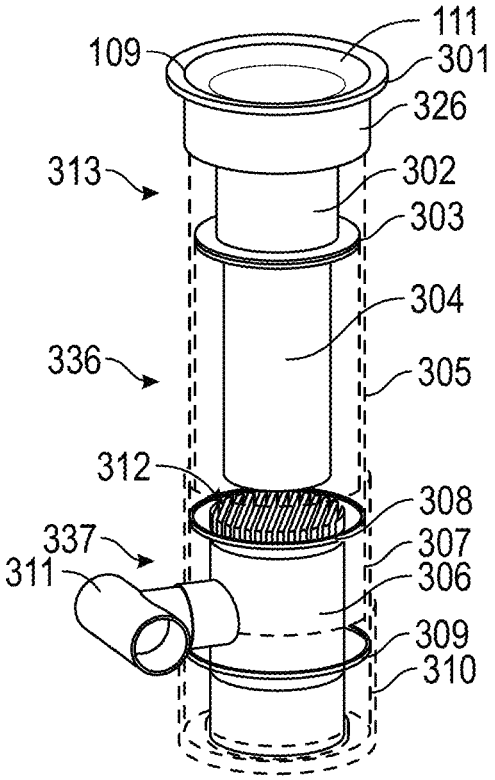
FIG. 15B is a perspective view of the powered pool skimmer device represented in FIG. 15A.
Figure 16A:
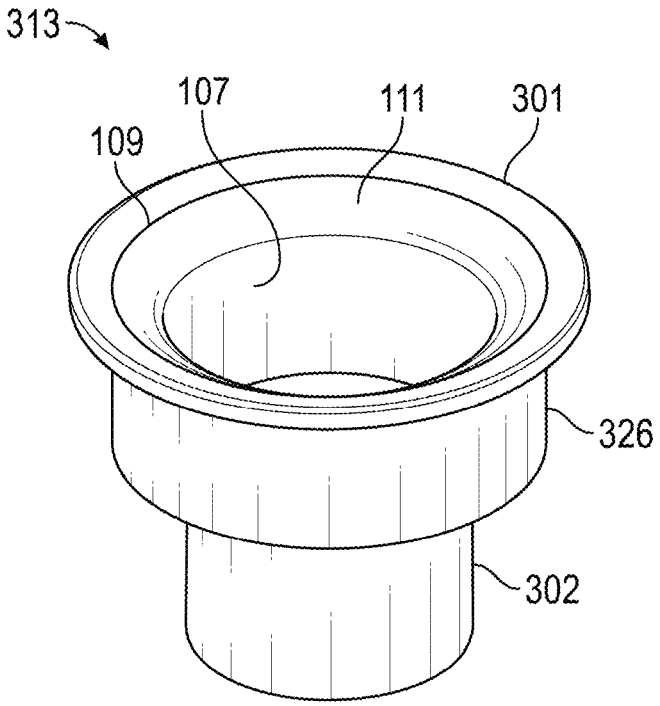
FIG. 16A is an embodiment of a funnel assembly for the powered pool skimmer device represented in FIG. 15A.
Figure 16B:
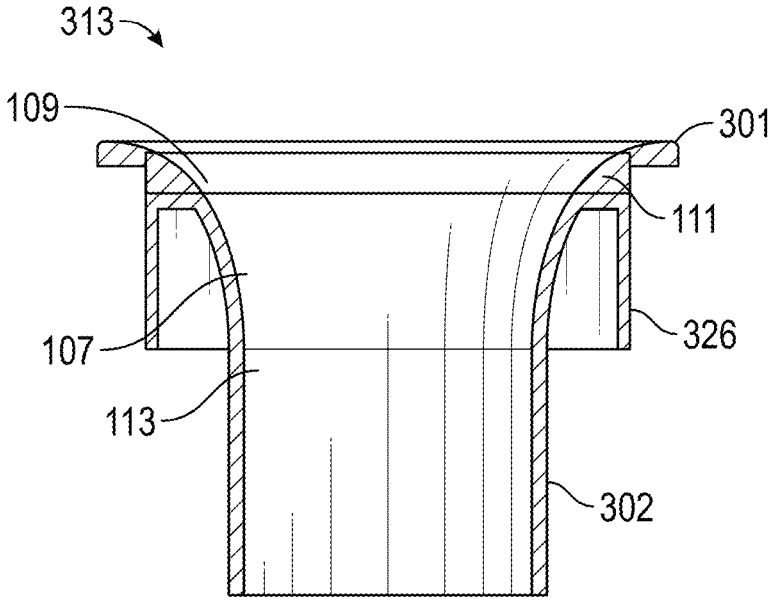
FIG. 16B is a cross-sectional view of the funnel assembly represented in FIG. 16A.

As shown in FIGS. 15A and 15B, the powered pool skimmer 300 comprises a series of component arranged within a main body 305. In some embodiments, the main body 305 can comprise cylindrical pipe, although other constructions for the main body 305. Within the main body 305, the powered pool skimmer 300 comprises a funnel assembly 313, a filter assembly 336, and a pump assembly 337. The pump assembly 337 is configured to pump water through the funnel assembly 313. Debris can be caught within the filter assembly 336. The pump assembly 337 exhausts water through an exhaust tee 311.

The funnel assembly 313 is positioned at the top of the main body 305. The funnel assembly 313 is shown in more detail in FIGS. 16A and 16B, which provide perspective and cross-sectional views, respectively. As shown, the funnel assembly 313 comprises a funnel 107 and a funnel collar 326 to attach the funnel assembly 313 to the main body 305 of the powered skimmer 300. In some embodiments, the funnel lip 109 has a diameter of about 6 inches, with an outer funnel lip 301 that is about 8 inches in diameter. Other dimensions are also possible similar to those described above. Thus, the outer funnel lip 301 can increase the diameter of the funnel 107. In the illustrated embodiment, the outer funnel lip 301 has very little slope and can be used to condition the surface water before it enters into the funnel lip 109.

The funnel lip 109 and outer funnel lip 301 can together form the wide opening 111 of the funnel assembly 313. The narrow funnel opening 113 is concealed within the funnel collar 326. In the illustrated embodiment, the narrow funnel opening is 4 inches, although this is only an example. In the illustrated embodiment, the funnel shape is defined by the formula $-1/x$ shown in FIG. 5A. In this case x is from about 12 to about 16.5. These values for funnel profile, wide opening and narrow opening are not arbitrary, but also are not necessary and accordingly the powered pool skimmer 300 should not be limited to these values. Many embodiments are possible with funnel profiles that work most efficiently for various pool circumstances.

A funnel extension 302 allows the water to fall into the funnel 107, because the water level within the funnel extension 302 should be lower than the surface water 5 in the pool. Since, in this illustrated example, the funnel 107 is shaped like a natural vortex, then the pool surface water 5 falls into the funnel 107 down to the water level within the funnel extension 302. This action of water falling into the skimmer causes all debris on the surface of the water 5 to also fall into the skimmer. And thus, offers little chance of the debris escaping back into the pool.

In some embodiments, the funnel assembly 313 is not rigidly attached to main body 305. Instead, the funnel assembly 313 can be configured to freely float along a central axis of main body 305. In some embodiments, a maximum height limiter can be included, so that the funnel assembly 313 does not float above the water line, and thus, cease water flow into the funnel assembly 313. This can allow the funnel assembly 313 to adjust to changes in the water level 5 in the pool. This auto-adjusting of a floating funnel assembly 313 can be accomplished by equalizing the pressure under the funnel assembly 313 with the force of the water flowing into the assembly. To adjust this equilibrium, there can be one, or more, ports in the main body 305 that will let water into the body 305. The amount of water allowed in, then determines how the funnel assembly 313 will float. In some instances, there can be small primer ports on the funnel assembly 313 that allow the funnel assembly 313 to properly adjust when it has inadvertently raised above the water level 5 in the pool. For example, if the power is switched off and then on again.

A floating funnel assembly 313 can also be included on the skimmer device described above with reference to FIGS. 4A-10D. In these embodiments, then a floating funnel assembly 313 is used instead of a simple funnel, the floats 145 may become unnecessary, because the assembly can float, and the height can be determined by the water flow over the assembly. To accomplish this, the funnel 107 can be replaced with the floating, sliding funnel assembly 313 over the extension body 101 and allowing it to float freely on the central axis of extension body 101. To adjust this equilibrium, there can be one, or more, ports in the extension body 101 that will let water into the body 101. The amount of water allowed in, then determines how the funnel assembly 313 will float. In some embodiments, there can be small primer ports on the funnel assembly 313 that allow the funnel assembly 313 to properly adjust when it has accidently raised above the water level 5 in the pool. For example, if the power is switched off and then on again. This may eliminate the need for telescoping sections 153, 155, and 157.

Returning to FIGS. 15A and 15B, just beneath the funnel extension 302 is the filter assembly 336. The filter assembly 336 is shown in more detail in FIG. 17, and it comprises a filter ring 303 and a filter bag/cartridge 304. The filter ring 303 can be configured to hold the filter in place within the powered pool skimmer's main body 305. In some embodiments, the filter is a bag that can either be cleaned and reused or disposed of. The filter bag 304 in some embodiments comprises cloth with a metal filter ring 303. Such an embodiment may be advantageous because it can cost less than a dollar and can be environmentally friendly.

Figure 18A:
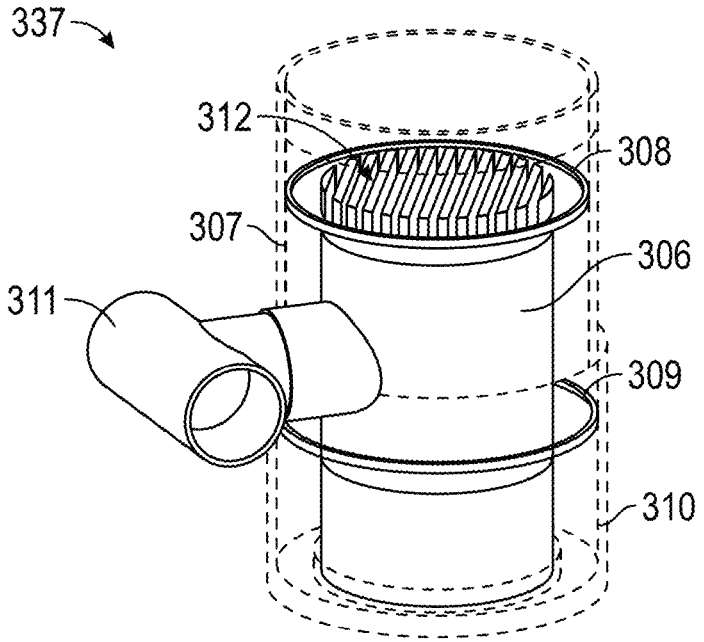
FIG. 18A is a perspective view of an embodiment of a water pump assembly for the powered pool skimmer device of FIG. 15A.
Figure 18B:
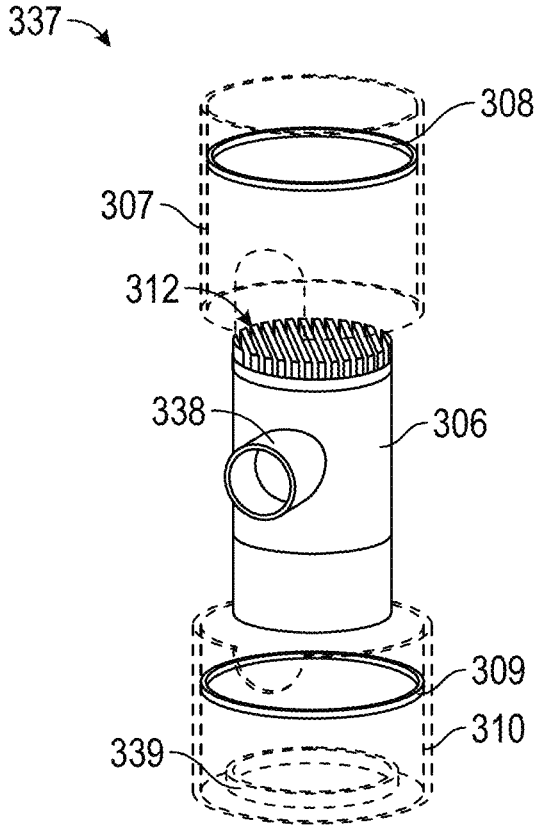
FIG. 18B is an exploded perspective view of the water pump assembly of FIG. 18A.

Below the filter assembly 313 is the water pump assembly 337, represented in FIGS. 18A and 18B. In the illustrated embodiment, the pump assembly 337 comprises a pump 306 positioned within the main body 305. In this section, the main body 305 may comprise an upper pump housing 307 and a lower pump housing 310 which can be separable as shown in FIG. 18B. Each may include a body ring 308, 309, which may facilitate fitting the two pieces together, The pump 306 is configured such that the intake 312 is positioned on a top side of the pump. An exhaust tee 311 extends out from the pump exhaust 338 of the pump 306 through an opening in the main body 305 formed between the upper and lower pump housings 307, 310. As shown in FIG. 18B, the pump 306 may sit on a pump stabilizer ring formed in a bottom surface of the lower pump housing 310.

In the illustrated embodiment, the water pump 306 is an upside-down bilge pump that pumps 4,000 gallons per hour. A pool of 16' by 32' with average depth of 5' is about 20,000 gallons. This means that in this embodiment that the entire contents of the pool can be filtered in just 4 hours (20,000 gallons/4,000 g/h=4 hours). However, if the powered pool skimmer 300 pulls in the surface water 5 at a depth of about 0.25", then at 4,000 gallons an hour, the powered pool skimmer 300 could pull in the entire surface of the pool 5 in less than 30 minutes 5. The 4,000 gallons per hour pump 306 could cycle through the surface water many times in less than an hour. This pump 306, however, is described merely as one example of a pump that can be used. Other pumps can also be used, such as pumps configured for 100 gallons per hour, 500 gallons per hour, 1,000 gallons per hours, 2,000 gallons per hour, or 3,000 gallons per hour.

The exhaust flow of water back into the pool can be so powerful that an exhaust tee 311 to equalize the lateral forces can be desirable on the powered pool skimmer 300.

Figure 17:
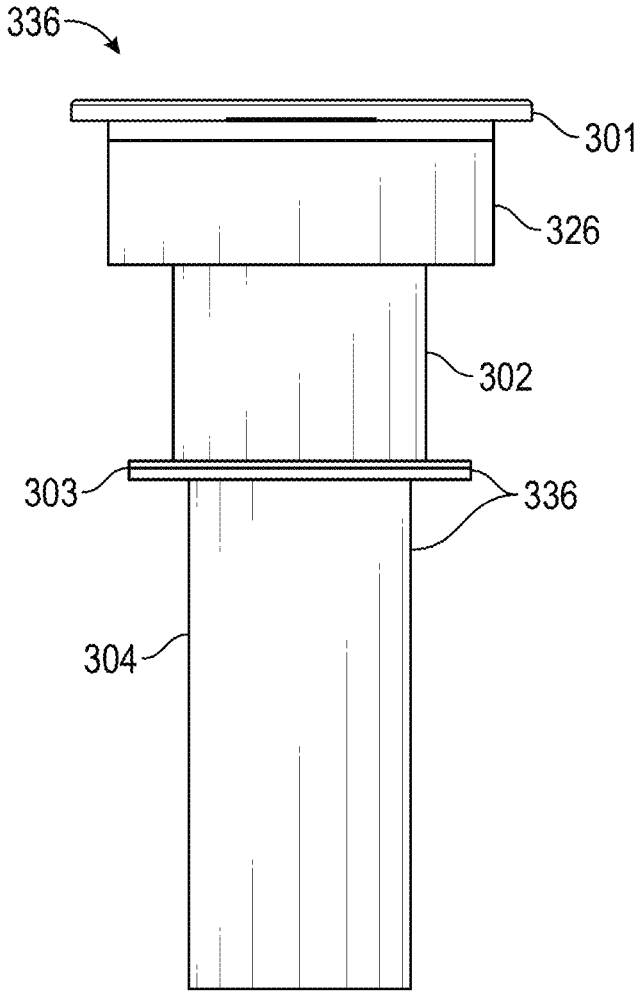
FIG. 17 is an embodiment of a filter for the powered pool skimmer device of FIG. 15A.

With reference to FIGS. 15A-18B, the powered pool skimmer 300 can be connected through the main body 305, which in the illustrated embodiment is a 6" PVC pipe. However, both the diameter and material of the main body 305 is not constricted by this embodiment, but only meant to illustrate one example. At the top of the main body 305, is the funnel assembly 313 (FIGS. 16A and 16B), which is where pool surface water 5 is pulled into the powered pool skimmer 300. The water level within the funnel extension 302 should be lower than the surface water 5 in the pool. Next, and directly under the funnel assembly 313 is the filter assembly 306 (FIG. 17). In the illustrated example embodiment, the filter assembly 313 comprises a 4-inch diameter 5-micron cloth bag 304 but can use bags of different sizes. In addition, filter cartridges can also be used. Positioned one to six inches below the filter assembly 306 in the main body 305 is the water pump assembly 337 (e.g., 1 inch, 2 inches, 3 inches, 4 inches, 5 inches, or 6 inches below the filter assembly 306). In the illustrated embodiment, the pump 306 comprises using an upside-down bilge pump with 4,000 gallons per hour capacity. This bilge pump can be replaced with any water pump with suitable capacity, and therefore the powered pool skimmer 300 is not limited to its selection of water pumps. The water pump 306 is connected to the main body 305 by the upper pump housing 307. The main body 305 rests on the body ring 308 which is located within the upper pump housing 307. Surface water 5 flows into the funnel assembly 313, though the filter assembly 306, through the water pump assembly 337, and then out the pump exhaust 338, and finally it is diffused by the exhaust tee 311.

Figure 19A:
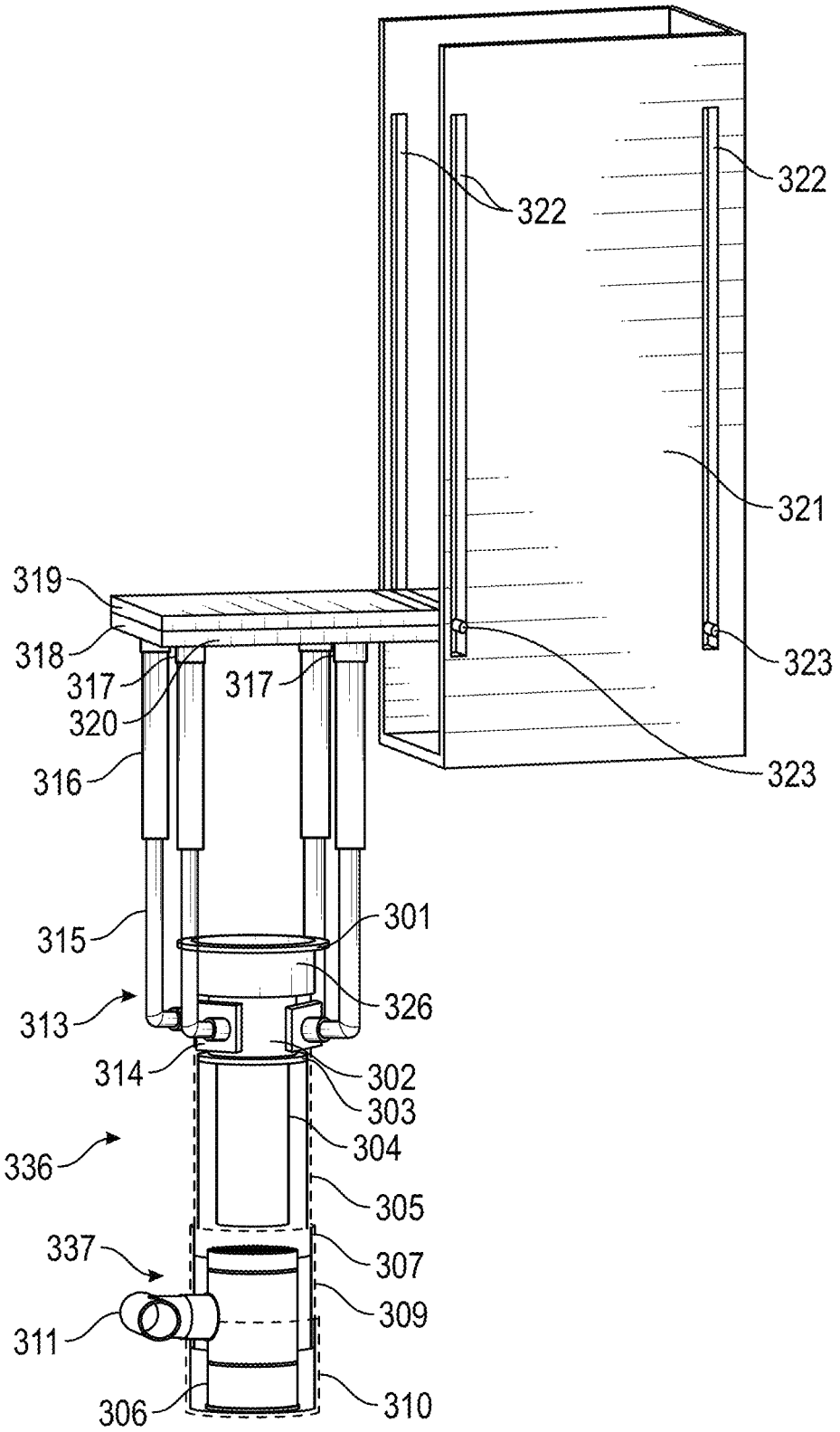
FIG. 19A illustrates an embodiment of a system, including a skimmer storage housing, and using the powered pool skimmer device represented in FIG. 15A, with the powered pool skimmer device illustrated at its lowest position, which would be below the surface of a pool.
Figure 19B:
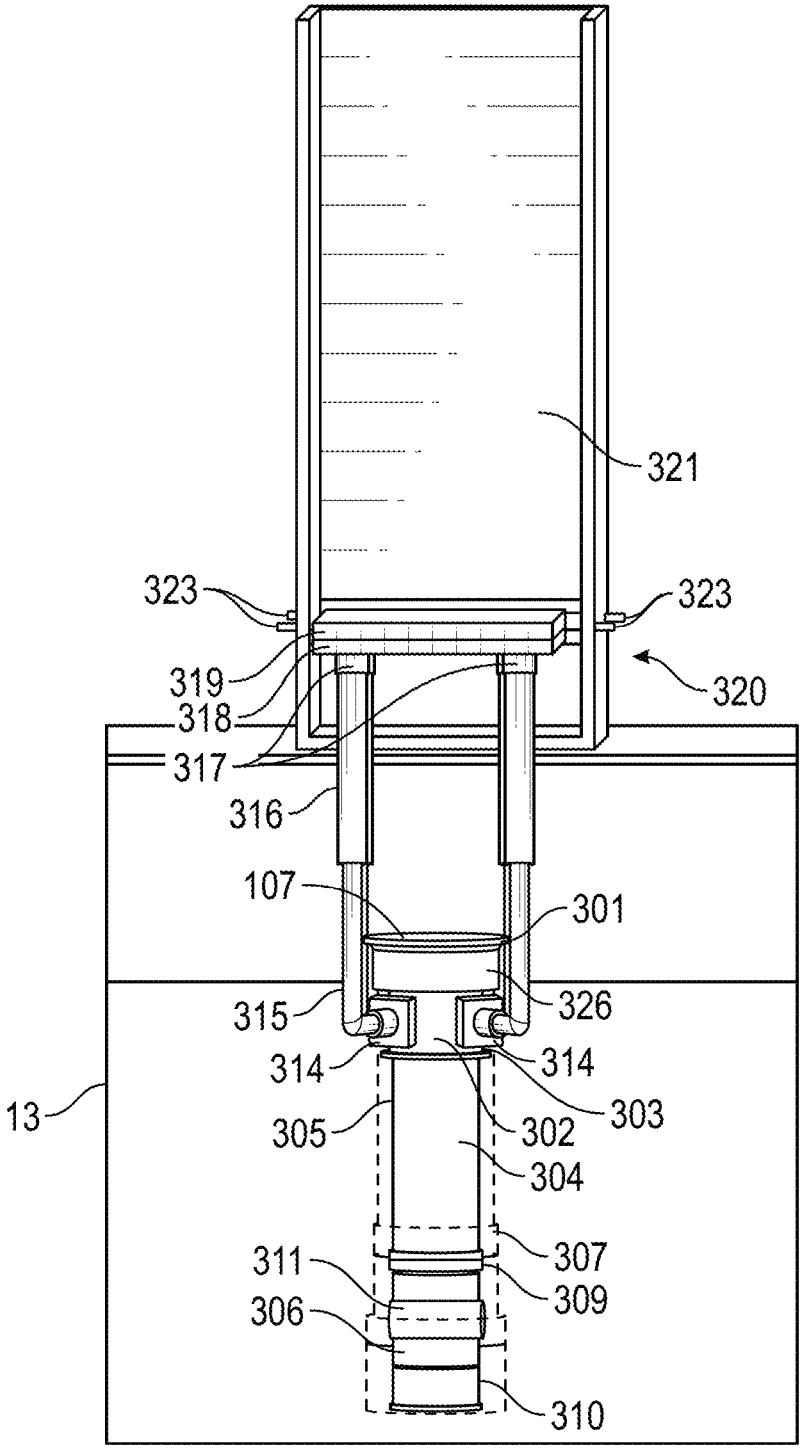
FIG. 19B illustrates the system of FIG. 19A, showing the powered pool skimmer device lowed into a swimming pool.
Figure 19C:
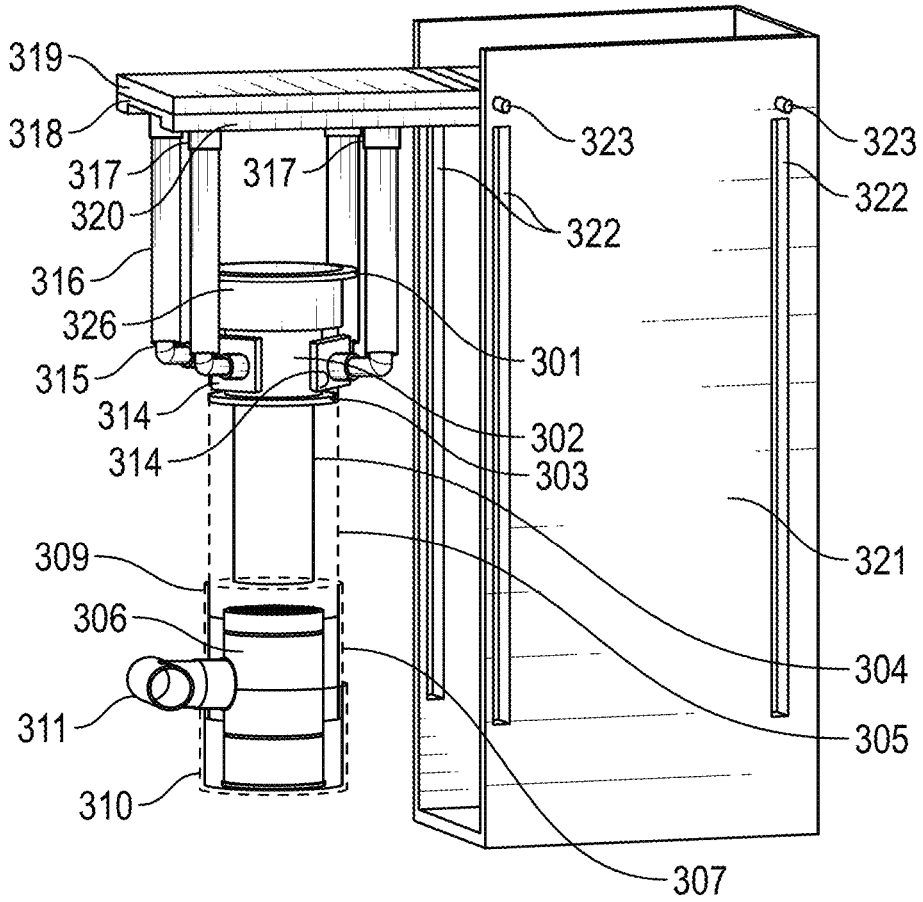
FIG. 19C illustrates the system of FIG. 19A, with the powered pool skimmer device raised out of the pool.
Figure 19D:
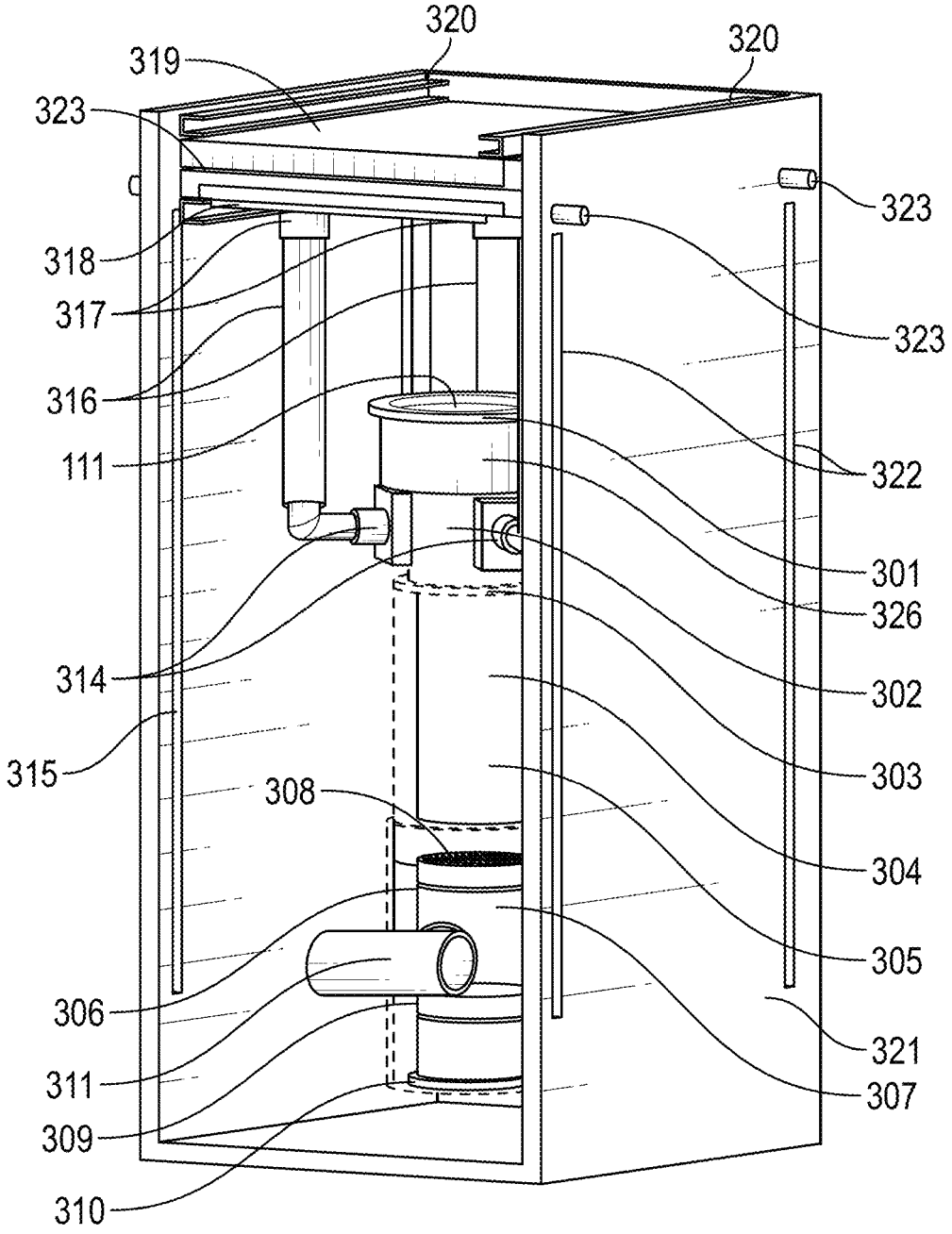
FIG. 19D illustrates the system of FIG. 19A, with the powered pool skimmer device stored in the skimmer storage housing.
Figure 20:
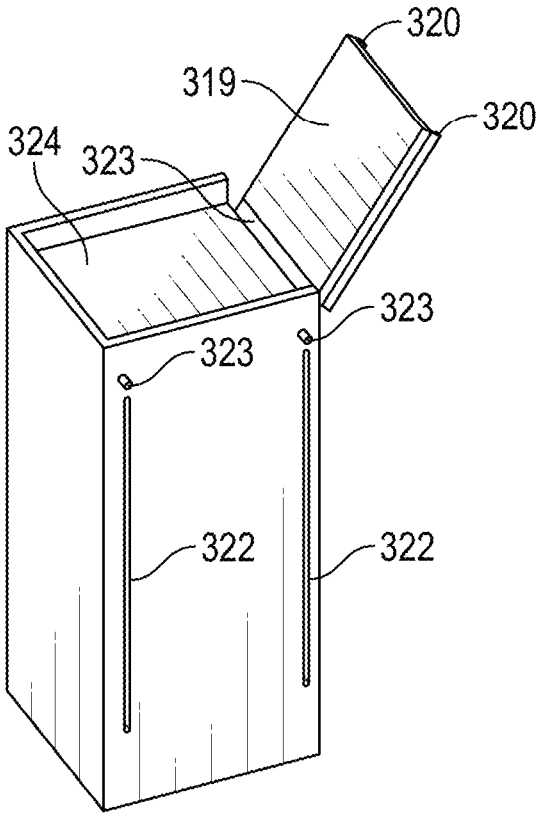
FIG. 20 illustrates an embodiment of the skimmer device housing, which shows an embodiment of a lift/extension board that folds over to form the top of the housing.

FIGS. 19A-20 illustrate an embodiment of a storage housing 321 for the powered pool skimmer 300. The storage housing 321 can serve one or more of the following three purposes: (1) it allows the powered pool skimmer 300 to be easily moved to and from the pool, (2) it provides convenient storage for the powered pool skimmer 300, and (3) it can be configured to lower the powered pool skimmer 300 into the water of a pool.

The powered pool skimmer 300 may function similar to the skimmer devices described above, which position a funnel just below the surface of the water. Accordingly, the storage housing 321 can be configured to allow the powered pool skimmer 300 to be lowered to a position at which the funnel assembly 313 is positioned just below the surface of the water.

As shown in FIG. 19A, the storage housing 321 comprises a box or other enclosure configured in size and shape to receive the powered pool skimmer 300 (see, for example, FIGS. 19D and 20). In this example, the powered pool skimmer 300 is mounted to a lift/extension board 319 and a slide board 318 that is connected to the storage housing 321. The lift/extension board 319 can be configured to slide up and down relative to the storage housing 321 to allow the powered pool skimmer to be lowered into a pool. The slide board 318 is configured to slide horizontally into and out of the storage housing 321 to allow the powered pool skimmer 300 to be moved into and out of the storage housing 321.

FIG. 19A is an embodiment of the storage housing 321 for the powered pool skimmer 300. In the illustrated embodiment, there are no wheels or handles to help transport the powered pool skimmer 300; however, these may be included in some embodiments. In some embodiments, the storage housing 321 is configured with wheels and handles in a manner that is similar to a hand-truck to easily allow the powered pool skimmer 300 to be moved.

As shown in FIG. 19A, the storage housing 321 includes housing slide channels 322 formed in or on the sides thereof. The lift/extension board 329 includes channel pegs 323 that are slidably positioned with the housing slide channels 322. The pegs 323 (and attached lift/extension board 329) can move up and down along the channels to adjust the height of the powered pool skimmer 300 relative to the storage housing 321. As described below, friction knows positioned on the channel pegs 323 can be used to secure the powered pool skimmer 300 at a desired height. The slide board 318 is configured to slide into and out of the storage housing 321, and accordingly, can be mounted on tracks 320 (see FIG. 19C) or other suitable mechanisms.

In the illustrated example, below the slide board 318, the powered pool skimmer 300 is suspended using mounting brackets 317, inner and outer adjustable lift pipes 315, 316, and body mounting brackets 314. The adjustable lift pipes 315, 316 can be configured to allow further adjustment of the height of the powered pool skimmer 300 as described below. In FIG. 19A, the powered pool skimmer 300 is illustrated at its lowest possible position, which means that the lift/extension board 319 is at its lowest position and the adjustable lift pipes 315, 316 are fully extended. FIG. 19A shows the lift/extension board slide channels 320 and lift board channel pegs 323. The inner and outer adjustable lift pipes 315, 316 can be configured to utilize friction. For example, the inner adjustable lift pipe 315 can be partially positioned within the outer adjustable lift pipe 316. The insertion depth of the inner adjustable lift pipe 315 within the outer adjustable lift pip 316 can control the height of the powered pool skimmer 300. In some embodiments, a pipe clamp can be included on each adjustable lift pipe 315, 316. To adjust the relative position of the lift pipes 315, 316, one can open the clamp, adjust the height, then close the clamp to secure the position. This action can also assist in leveling the funnel opening 111 with the surface 54 of the water in the pool. In some embodiments, there can be an apparatus, such as one or more bubble levels for each horizontal axis, to help aid in leveling the funnel.

In the illustrated embodiment, the powered pool skimmer 300 is attached to the adjustable lift pipes 315, 316 by the body mount brackets 314 that mount every 90 degrees around the main body 305. In some embodiments, the spacing need not be 90 degrees. In some embodiments, greater or fewer than four lift pipe pairs and body mount brackets 314 can be used.

FIG. 19B shows the lowered powered pool skimmer 300 in a pool. As shown the storage housing 321 can be moved adjacent to the pool, the powered pool skimmer 300 can be slid out of the storage housing 321, and the powered pool skimmer 300 can be lowered into the water such that the funnel 107 is positioned just below the surface of the water (e.g., as described above).

FIG. 19C shows the powered pool skimmer 300 raised to its highest position. As shown, the lift/extension board 318 has been slid up to the top of the housing slide channels 322. In some embodiments, when the powered pool skimmer 300 is in its highest position it can slide into the skimmer storage housing 321, as shown in FIG. 19D.

FIG. 19D shows the powered pool skimmer 300 in its storage position inside the storage housing 321. Not illustrated is a door that can be closed to conceal or enclose the powered pool skimmer 300. In this embodiment, the lift/extension board 319 has folded to form a top on the storage housing 321. Accordingly, a hinge 323 can be included as shown (and described in more detail below with reference to FIG. 20). When the powered pool skimmer 300 is in this state (e.g., within the storage housing 321), it can easily be transported safely from the edge of the pool (for example, using wheels and similar to a hand-truck as described above).

FIG. 20 illustrates an embodiment of the folding lift/extension board 319 and hinge 323 described above. As illustrated, the storage housing 321 can include two boards (1) a vertical lift board 324, which can be permanently inside the storage housing 321; and the lift/extension board 319. The vertical lift board 324 can include the channel pegs 323 attached to it, which allow for the board to be adjusted vertically within the storage housing 321 (e.g., within channels 322). The lift/extension board 319 folds out to allow the slide board 318, to which the powered pool skimmer 300 is attached, to slide out of the skimmer storage housing 321. When the skimmer 300 is fully in the skimmer storage housing 321, the lift/extension board can be folded back into the housing 321 using the hinge 323.

The powered pool skimmer 300 shown in FIGS. 15A-20 advantageously provides a stand-alone unit which can be quickly and easily used on many pools, and which utilizes the advantageous funnel structure previously described. FIGS. 21A-22E relate to other embodiments of the powered pool skimmer 300 that can be permanently installed within a pool.

Figure 21A:
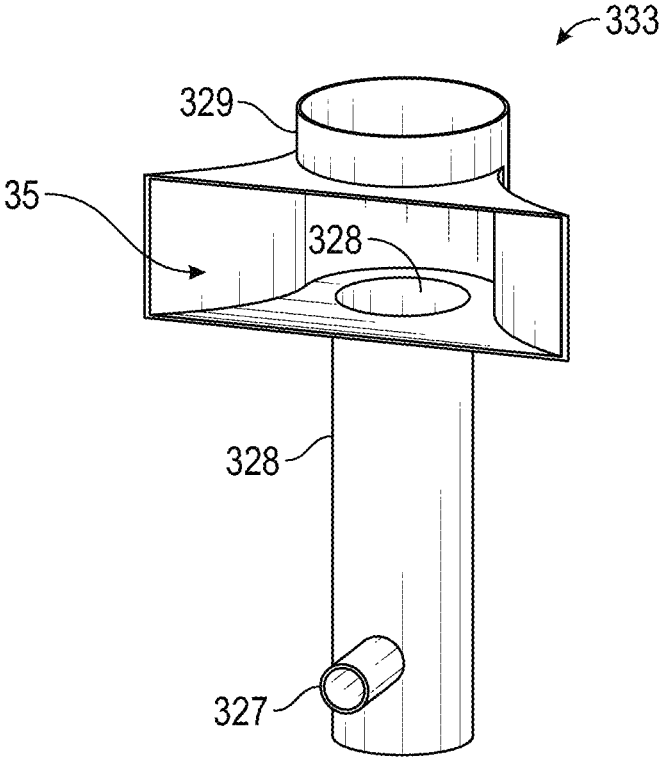
FIG. 21A is a perspective view of an embodiment of a circular skimmer sleeve that can be installed into a swimming pool wall and is configured to receive a powered pool skimmer device to allow for in-pool wall installation of the powered pool skimmer device.

FIG. 21A illustrates an embodiment of a circular powered pool skimmer sleeve 333 that will allow the powered pool skimmer 300 to be permanently installed into a wall of a pool 13. The skimmer sleeve 333 includes a skimmer aperture 35, provided by a skimmer device port 328, that is common to almost all pool skimmers. The skimmer aperture 35 allows surface water 5 from the swimming pool to enter the powered pool skimmer 300 similar to the description provided above with reference to FIG. 2. The skimmer sleeve 333 also includes a skimmer sleeve 328. In the illustrated embodiment, the skimmer sleeve 328 is cylindrical, although other shapes are possible. A top end of the skimmer sleeve 328 includes a skimmer device access 329, which can be open to receive the powered pool skimmer 300. The skimmer sleeve 328 can also include a sleeve exhaust port 327 configured to receive the exhaust of the pump 306.

Figure 21B:
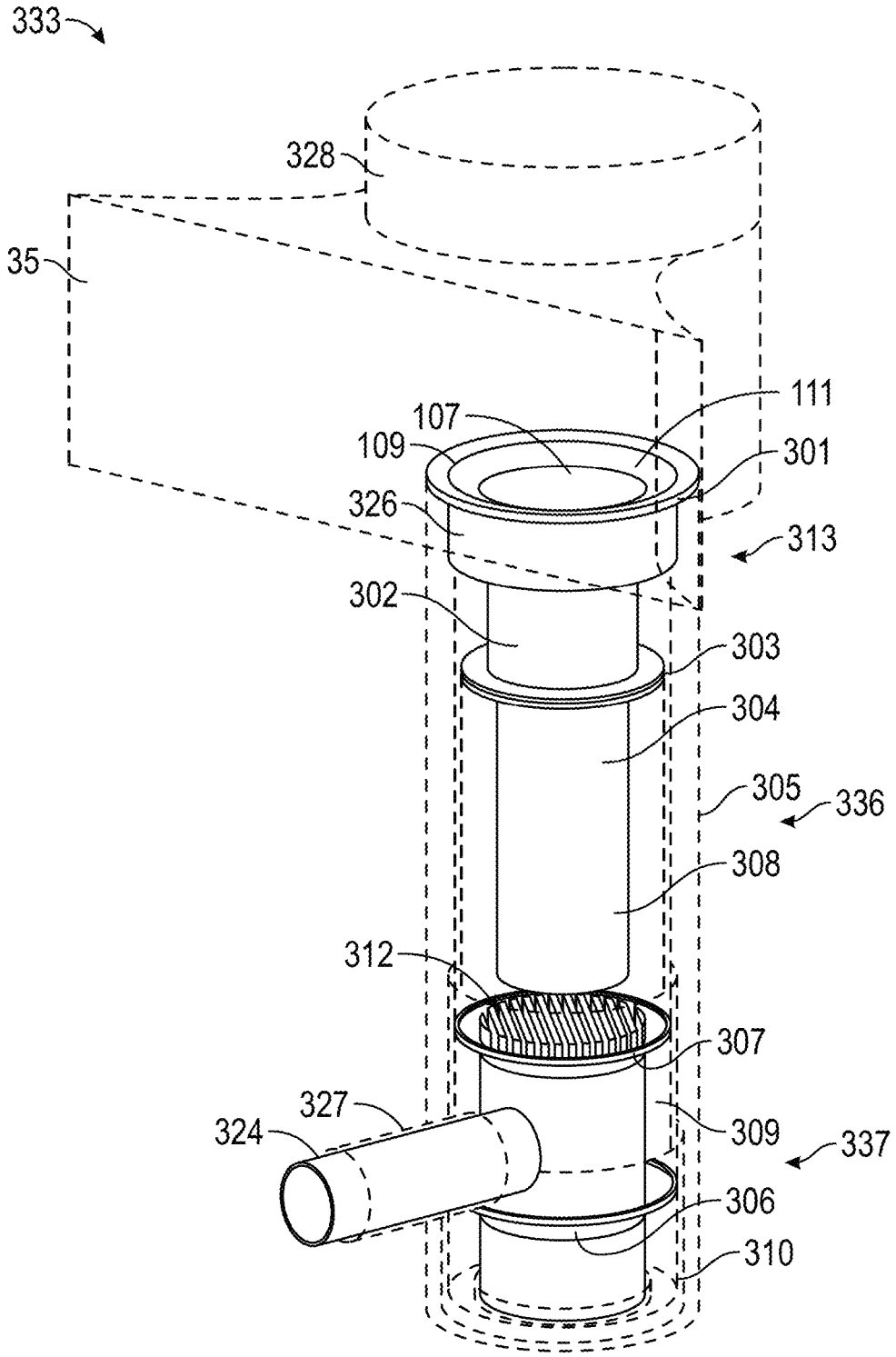
FIG. 21B is a perspective view illustrating an embodiment of a powered pool skimmer device inserted into the circular skimmer sleeve of FIG. 21A.

FIG. 21B shows the circular skimmer device sleeve 328 with the powered pool skimmer 300 inserted therein. Not illustrated in the drawing is a pool skimmer cover, which can be used to close the skimmer device access 329. As shown, the powered pool skimmer 300 is inserted in the skimmer sleeve 328 such that the funnel 107 is positioned below the skimmer aperture.

Figure 21C:
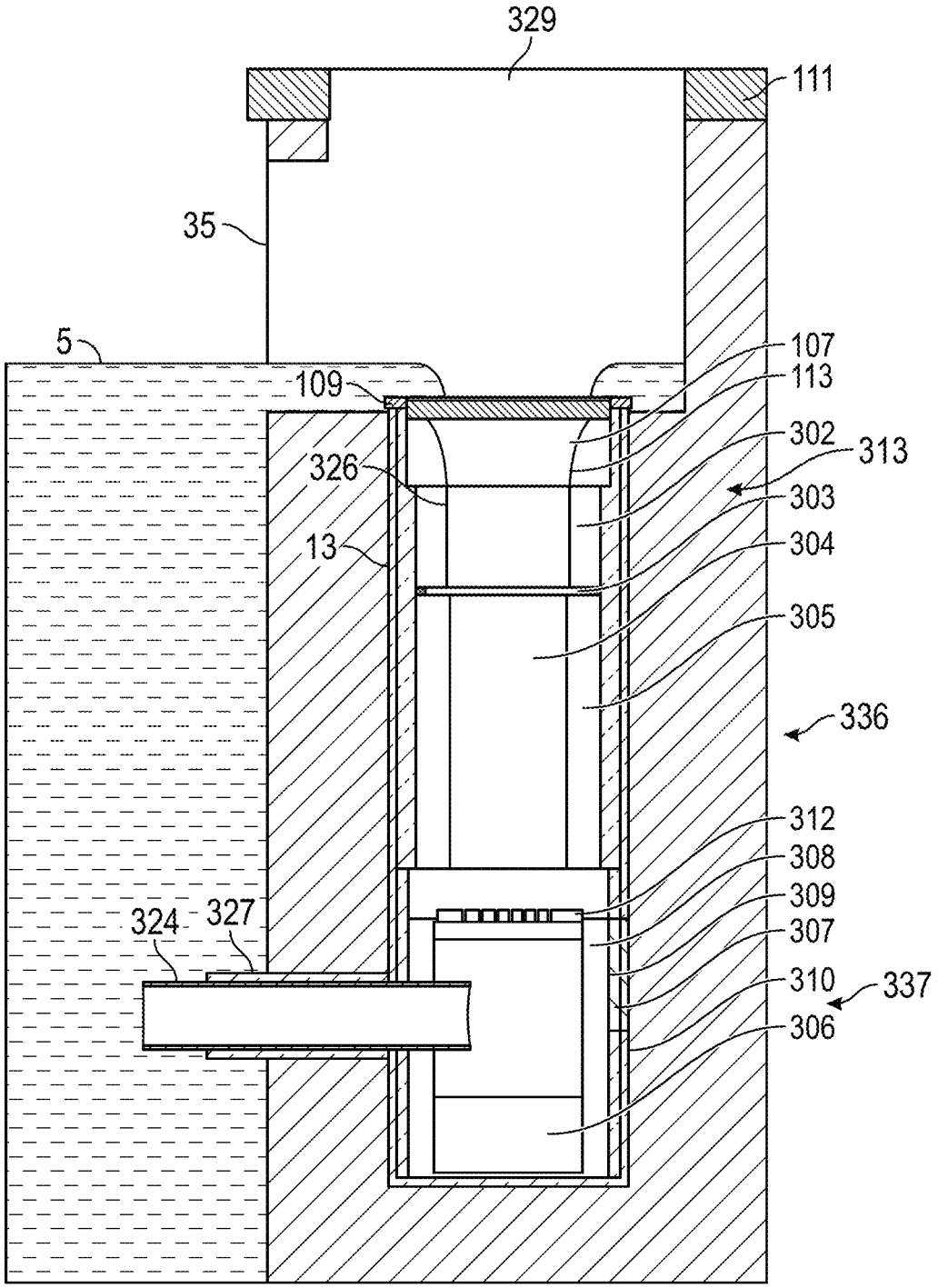
FIG. 21C is a cross-sectional view of a sidewall of a pool illustrating the powered pool skimmer device inserted into the circular skimmer sleeve of FIG. 21A, which has been installed in the sidewall of the pool.

FIG. 21C is a cross-sectional view of the embodiment of the circular powered pool skimmer sleeve 333 mounted inside the wall of a swimming pool 13. The powered pool skimmer 300 is inserted into the sleeve 333. Not shown in the drawing is the wiring harness that supplies power (e.g., 12/24 volts) to the water pump 306. The powered pool skimmer 300 can be removed from the circular skimmer device sleeve 333 by disconnecting the wiring harness, removing the filter exhaust pipe 324, and then pulling the entire powered pool skimmer 300 through the skimmer device access 329. The circular skimmer device sleeve allows for this easy insertion and removal of the powered pool skimmer 300 to perform maintenance or upgrades to the powered pool skimmer 300. To clean or replace the filter 304, the funnel assembly 313 can be removed by lifting it through the skimmer device access 329, which will expose the filter 304. Then, the filter 304 can be lifted through the skimmer device access 329.

FIG. 22A is the embodiment of a rectangular in concrete frame 335, which is permanently installed in the pool wall 13. Not shown is a wiring harness that will provide power (e.g. 12/24 volts DC) to the water pump 306 in the powered pool skimmer 300. Similar to the circular skimmer sleeve 333, the rectangular frame includes a skimmer device access 329.

FIG. 22B illustrates an embodiment of a rectangular skimmer sleeve 334, which allows the powered pool skimmer 300 to be easily installed into the wall of a pool 13. The powered pool skimmer 300 is inserted into the rectangular skimmer sleeve 334 through the skimmer device access 329. The rectangular skimmer sleeve 334 can be received within the rectangular in concrete frame 335.

FIG. 22C shows the powered pool skimmer 300 fully inserted into the rectangular skimmer sleeve 334 and the rectangular skimmer sleeve 334 positioned within the rectangular in concrete frame. The front of the rectangular skimmer sleeve 334 has been illustrated as transparent to allow the orientation of the powered pool skimmer 300 to be observed. To insert the powered pool skimmer 300 the filter exhaust pipe 324 can be removed and powered pool skimmer 300 can be inserted through the skimmer device access 329. Then, power (e.g., the 12/24 volt wiring harness) can be connected the filter exhaust pipe 324 can be reinserted into the water pump 306 through the sleeve exhaust port 327.

FIG. 22D shows the rectangular skimmer sleeve 334, with the powered pool skimmer 300, fully inserted into the rectangular frame 335. The sleeve can easily be removed by disconnecting the 12/24 volt DC wiring harness, and then simply sliding the sleeve 334 out of the frame 335. FIG. 22E illustrates the embodiment of the rectangular in concrete frame 335 installed into the wall 13 of a swimming pool. The rectangular skimmer sleeve 334 is populated with the powered pool skimmer 300 and slid into the frame. In most installations there will be a cover to conceal the powered pool skimmer 300, the rectangular skimmer sleeve 334, and the rectangular in concrete frame 335. Current bottom filter covers have a layer of the pools surface, such as Pebble Tec, to help it match the pool finish. The cover for the rectangular in concrete frame 335 can include such a cover. Once covered, only the sleeve exhaust port 327 and the skimmer aperture 35 will be visible.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the disclosure should not be taken to imply that the terminology is being re-defined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the figures may be combined, interchanged or excluded from other embodiments.

The above description discloses several methods and materials of the present disclosure. This disclosure is susceptible to modifications in the methods and materials, as well as alterations in the fabrication methods and equipment. Such modifications will become apparent to those skilled in the art from a consideration of this disclosure or practice of the disclosure disclosed herein. Consequently, it is not intended that this disclosure be limited to the specific embodiments disclosed herein, but that it cover all modifications and alternatives coming within the true scope and spirit of the disclosure as embodied in the attached claims. Applicant reserves the right to submit claims directed to combinations and sub-combinations of the disclosed disclosures that are believed to be novel and non-obvious. Disclosures embodied in other combinations and sub-combinations of features, functions, elements and/or properties may be claimed through amendment of those claims or presentation of new claims in the present application or in a related application. Such amended or new claims, whether they are directed to the same disclosure or a different disclosure and whether they are different, broader, narrower or equal in scope to the original claims, are to be considered within the subject matter of the disclosures described herein.

What is claimed is:

1. A powered pool skimmer device, comprising:

a funnel assembly comprising a funnel having a wide opening and a narrow opening, and a funnel profile extending between the wide opening and the narrow opening;

a filter assembly positioned below the funnel assembly;

a pump assembly positioned below the filter assembly, the pump assembly including a pump configured to draw water through the funnel assembly and filter assembly and exhaust it through an exhaust; and a main body extending along an axis, wherein the funnel assembly, the filter assembly, and the pump assembly are positioned within the main body and arranged along the axis, wherein the funnel assembly is configured to float within the main body along the axis.

2. The device of claim 1, wherein the pump assembly is no more than 6 inches below the filter assembly.

3. The device of claim 1, wherein the funnel assembly further comprises a funnel extension extending from the narrow opening of the funnel.

4. The device of claim 1, wherein the funnel assembly further comprises a funnel collar surrounding the funnel.

5. The device of claim 1, wherein the filter assembly comprises a filter bag attached to the funnel assembly with a ring.

6. The device of claim 1, wherein the exhaust comprises an exhaust tee.

7. The device of claim 1, further comprising a storage housing configured to:

enclose the main body in a first configuration; and lower the main body into a pool in a second configuration.

8. The device of claim 7, wherein the main body is attached to a lift/extension board of the storage housing by one or more adjustable lift pipes.

9. The device of claim 8, wherein the lift/extension board is slidably connected to a plurality of slide channels of the storage housing.

10. The device of claim 1, wherein the main body is positioned within a skimmer sleeve comprising a skimmer aperture and a skimmer device access.

11. The device of claim 10, wherein the skimmer sleeve is configured to be positioned within an in-concrete frame configured to be installed in a wall of a pool.

12. The device of claim 11, wherein the main body is removable from the skimmer sleeve and the in-concrete frame through the skimmer device access.

13. A powered pool skimmer method, comprising:

positioning a powered pool skimmer comprising a funnel assembly, a filter assembly positioned below the funnel assembly, and a pump assembly positioned below the filter assembly such that the funnel assembly is no more than 2 inches below the surface of water in a pool; and activating a pump of the pump assembly to pump water through the funnel assembly and filter assembly to an exhaust back into the pool.

14. The method of claim 13, further comprising:

positioning a storage housing of the powered pool skimmer on an edge of the pool;

removing the powered pool skimmer from the storage housing; and lowering the powered pool skimmer into the pool.

15. The method of claim 13, wherein position the powered pool skimmer such that the funnel assembly is no more than 2 inches below the surface of the water comprises floating the funnel assembly within a main body of the powered pool skimmer.

16. The method of claim 13, further comprising:

installing an in-concrete frame into a sidewall of the pool;

installing a skimmer sleeve into the in-concrete frame, the skimmer sleeve comprising a pool skimmer aperture extending to the sidewall of the pool; and inserting the powered pool skimmer into the skimmer sleeve.

17. The method of claim 16, wherein inserted the powered pool skimmer into the skimmer sleeve comprises:

removing an exhaust port of the pump assembly;

sliding the powered pool skimmer into the skimmer sleeve; and reinstalling the exhaust port.

18. The method of claim 13, wherein the pump assembly is no more than 6 inches below the filter assembly.

19. The method of claim 13, wherein the funnel assembly further comprises a funnel extension extending from a narrow opening of the funnel.

* * * * *